US006472814B1

(12) United States Patent
Yamanobe et al.

(10) Patent No.: US 6,472,814 B1
(45) Date of Patent: Oct. 29, 2002

(54) ELECTRON-EMITTING DEVICE PROVIDED WITH PORES THAT HAVE CARBON DEPOSITED THEREIN

(75) Inventors: Masato Yamanobe, Machida (JP); Takeo Tsukamoto, Atsugi (JP); Shinichi Kawate, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/191,342

(22) Filed: Nov. 13, 1998

(30) Foreign Application Priority Data

| | | |
|---|---|---|
| Nov. 14, 1997 | (JP) | 9-313338 |
| Oct. 16, 1998 | (JP) | 10-295704 |
| Oct. 16, 1998 | (JP) | 10-295705 |
| Oct. 16, 1998 | (JP) | 10-295706 |
| Nov. 12, 1998 | (JP) | 10-322348 |

(51) Int. Cl.[7] ..... H01J 1/46; H01J 21/10; H01J 1/62; H01J 63/04

(52) U.S. Cl. ..... 313/495; 313/304; 313/306; 313/311

(58) Field of Search ..... 313/304, 306–310, 313/336, 351, 346 R, 495–497; 250/423; 205/122

(56) References Cited

U.S. PATENT DOCUMENTS

| | | | |
|---|---|---|---|
| 4,904,895 A | 2/1990 | Tsukamoto et al. | 313/336 |
| 5,164,632 A | 11/1992 | Yoshida et al. | 313/309 |
| 5,315,206 A | 5/1994 | Yoshida | 313/306 |
| 5,430,300 A | 7/1995 | Yue et al. | 250/423 |
| 5,556,530 A | 9/1996 | Finkelstein et al. | 205/122 |
| 5,572,042 A | 11/1996 | Thomas et al. | 257/10 |

FOREIGN PATENT DOCUMENTS

| | | |
|---|---|---|
| EP | 0 701 265 A1 | 3/1996 |
| JP | 05-198252 | 8/1993 |
| JP | 05-211029 | 8/1993 |
| JP | 09-082214 | 3/1997 |
| JP | 10-012124 | 1/1998 |
| WO | WO 94/03916 | 2/1994 |
| WO | WO 95/07543 | 3/1995 |
| WO | WO 97/39469 | 10/1997 |

OTHER PUBLICATIONS

W.P. Dyke et al., "Field Emission," *Adv. Electronics and Electron Phys.,* vol. VIII (1956) pp. 89–185.

C.A. Spindt et al., "Physical properties of thin–film field emission cathodes with molybdenum cones," *J. Appl. Phys.,* vol. 47, No. 12 (1976) pp.5248–5263.

C.A. Mead, "Operation of Tunnel–Emission Devices," *J. Appl. Phys.,* vol. 32, No. 4 (1961) pp. 646–652.

T. Kusunoki et al., "Fluctuation–Free Electron Emission from Non–formed Metal–Insulator–Metal (MIM) Cathodes Fabricated by Low Current Anodic Oxidation," *Jpn. J. Appl. Phys.,* vol. 32, No. 11B (1993) pp. L1695–L1697.

*Primary Examiner*—Vip Patel
*Assistant Examiner*—Mack Haynes
(74) *Attorney, Agent, or Firm*—Fitzpatrick, Cella, Harper & Scinto

(57) ABSTRACT

An electron-emitting device disclosed has stable electron emission characteristics with little variation, in high electron emission efficiency, in high definition, and at low driving voltage. The electron-emitting device disclosed is constructed in such structure that on a substrate there are a lower electrode, an insulating layer having pores, and an upper electrode stacked in this order, the insulating layer is an anodic oxide layer, and a carbon deposit is formed in the pores.

34 Claims, 30 Drawing Sheets

ELECTRON-EMITTING DEVICE PROVIDED WITH PORES THAT HAVE CARBON DEPOSITED THEREIN

BACKGROUND OF THE INVENTION

1. Field of the Invention

The present invention relates to an electron-emitting device and a production method thereof and, more particularly, to an electron-emitting device having a lower electrode, an insulating layer having pores, and an upper electrode stacked in this order on a substrate, and a method for producing the electron-emitting device.

2. Related Background Art

The conventionally known electron-emitting devices are generally classified under two kinds, thermionic emission devices and cold cathode emission devices. The cold cathode emission devices include field emission type (FE type) devices, metal/insulator/metal type (MIN type) devices, surface conduction electron-emitting devices, and so on.

The FE type devices are disclosed, for example, in W. P. Dyke & W. W. Dolan, "Field emission," Advance in Electron Physics, 8, 89 (1956) or in C. A. Spindt, "PHYSICAL Properties of thin-film field emission cathodes with molybdenum cones," J. Appl. Phys., 47, 5248 (1976).

The tip of an electron-emitting body of the field emission type electron-emitting devices is one called a cone having the three-dimensionally sharp-pointed shape and an electron beam is emitted from the tip of the cone by placing a strong electric field between a gate electrode with an aperture, disposed above the cone, and an electron-emitting region.

In order to overcome the problem in the production method of the above field emission devices, which is the need for complicated steps and expensive apparatus for forming a recessed portion for formation of the electron-emitting region, Japanese Laid-open Patent Applications No. 5-298252 and No. 5-211029 describe examples in which holes of an anodic oxide film of aluminum are used as apertures of the gate electrode and in which electron-emitting regions are formed in the holes of the anodic oxide film. These conventional examples will be described referring to FIGS. 32 and 33.

FIG. 32 is a sectional view of the electron-emitting device in Japanese Laid-open Patent Application No. 5-198252. FIG. 33 is a sectional view of the electron-emitting device in Japanese Laid-open Patent Application No. 5-211029. In FIG. 32, reference numeral 161 designates an insulating substrate, 162 an electroconductive layer, 163 an insulating film, 164 through holes, 165 the gate electrode, and 166 cathodes. The insulating film 163 is the anodic oxide film of aluminum and the tip of the cathodes 166 is of the cone shape similar to that of the electron-emitting body of the field emission devices. In FIG. 33, reference numeral 171 designates a metal layer, 172 the Al anodic oxide film, 172*a* micropores, and 173 cylindrical electrodes. The application describes that in FIG. 33 the distance can be made constant between the cylindrical electrodes 173 and the gate electrode or between the needlelike electrodes and the anode electrode, so as to make electron emission efficiency constant.

The MIM type devices are disclosed, for example, in C. A. Mead, "Operation of Tunnel-Emission Devices," J. Appl. Phys., 32, 646 (1961).

Recent researches on the MIM type are seen in Toshiaki Kusunoki, "Fluctuation-free electron emission from non-formed metal-insulator-metal (MIM) cathodes fabricated by low current anodic oxidation," Jpn. J. Appl. Phys. vol. 32 (1993) pp L1695, Mutsumi Suzuki et al., "An MIM cathode array for cathode luminescent displays," IDW '96 (1996) p529, and so on.

An MIM type electron-emitting device according to Kusunoki or Suzuki et al. described above will be described referring to FIG. 34. FIG. 34 is a schematic sectional view of the MIM type electron-emitting device. In the same figure, reference numeral 1 denotes a substrate, 2 a lower electrode, 3 an insulating layer, and 4 an upper electrode. The electron-emitting device is made by a production method for first forming $SiO_2$ on the Si substrate by sputtering, depositing Al as the lower electrode, further forming an anodic oxide film of high quality in the thickness of 5.5 nm while controlling oxidation rates, using ethylene glycol and tartaric acid, and thereafter forming Au of the upper electrode in the thickness of 9 nm. It is described that good electron emission characteristics were achieved by applying voltage between the anode of the upper electrode and the cathode of the lower electrode thus formed. Specifically, according to Kusunoki et al., negative resistance does not appear in the device current flowing against the voltage applied to the device. The "negative resistance" herein is a phenomenon in which the device current decreases as the device voltage increases. In addition, fluctuation does not occur in the emission current. Here, the "fluctuation" means temporal change of the emission current. It is also described that dependence of the emission current on the device voltage varies depending upon the thickness of the insulating layer and that the thicker the insulating layer, the higher the device voltage that has to be applied. It is further described that with anodic oxide films made at high oxidation rates, the negative resistance appears in the electron emission characteristics and the fluctuation occurs large.

An example of the surface conduction electron-emitting device with improved electron emission characteristics is described in Japanese Laid-open Patent Application No. 9-82214. This will be described referring to FIGS. 35A and 35B. In the figures, reference numeral 191 denotes a substrate, 192 an electron-emitting region, 193 an electroconductive film, 194 a cathode device electrode, 195 an anode device electrode, 196 a fissure, and 197 a field correcting electrode. In the surface conduction electron-emitting device of this example, electrons emitted move in an electric field established by the cathode and the anode and a singular point of the electric field above the anode device electrode affects the ratio of electrons reaching the anode electrode, provided to sandwich a vacuum with the electron emitting element i.e., the electron emission efficiency. This device is an example in which the field correcting electrode is provided outside the device electrodes in order to improve the electron emission efficiency.

SUMMARY OF THE INVENTION

According to the studies by Spindt et al., the conventional FE type electron-emitting devices, however, had a problem of a spread of the electron beam, which was hindrance against enhancement of definition. In the example of application of the holes of the anodic oxide film to the apertures of the gate electrode, there remained a problem of poor repeatability in formation of the cone of the electron-emitting region. In the example in which the electron-emitting regions were formed in the cylindrical shape, there also arose problems of poor repeatability of the electron emission characteristics and high driving voltage. In the surface conduction electron-emitting device provided with the correcting electrode, the electron emission efficiency was increased, but the potential of the correcting electrode was high, which was a problem in driving.

In the conventional MIM type electron-emitting devices, first, the thickness of the insulating layer was thin, several nm, and the thickness greatly affected the electron emission characteristics. In an electron source equipped with many devices, variations in the thickness of the insulating layer are directly bound to variations in the emission current, so that control of variations is difficult. When an image pickup device or an image forming device is constructed using the electron source; there will arise a problem of degradation of image quality. Second, the quality of the insulating layer did not affect only the electron emission characteristics, but also affected the device current. In the case of the electron source equipped with many devices, variations in the quality of the insulating layer are directly bound to variations in the emission current. Particularly, in the case of a large area, control of variations is difficult. In the image pickup device or the image forming device using the electron source, there will arise the problem of degradation of image quality. Third, repeatability was poor as to occurrence of the negative resistance and occurrence of the fluctuation of the device current and control thereof was difficult.

In the conventional surface conduction electron-emitting device provided with the correcting electrode, the electron emission efficiency was increased, but the potential of the correcting electrode was high, which was the problem in driving.

An object of the present invention is thus to provide an electron-emitting device having stable electron emission characteristics with less variation that can achieve high electron emission efficiency, high definition, and low driving voltage.

For accomplishing the above object, the present invention provides an electron-emitting device comprising a lower electrode, an insulating layer having a pore, and an upper electrode stacked in this order on a substrate, wherein a carbon deposit is provided in the pore.

The present invention also provides an electron-emitting device comprising a lower electrode, an insulating layer having a pore, and an upper electrode stacked in this order on a substrate, wherein an electron-emitting region is provided in the pore, the electron-emitting region is comprised of a small gap between the lower electrode and the upper electrode, and the small gap is formed by a rim-shape electroconductive body formed along an inner wall of the pore, and the upper electrode.

The present invention further provides an electron-emitting device comprising a lower electrode, an insulating layer having a pore, and an upper electrode stacked in this order on a substrate, wherein an electron-emitting body is provided in the pore, and where when a thickness of the upper electrode is t, a length of the pore is L, and a mean free path of electron transmission of the upper electrode is $\lambda$, they satisfy the following condition: $0.5\times L \leqq t < 2\lambda$.

The present invention also provides an electron-emitting device having a lower electrode, an insulating layer having a pore, and an upper electrode stacked in this order on a substrate, the electron-emitting device having an electron-emitting region in the pore, wherein the electron-emitting region is comprised of a small gap between the lower electrode and the upper electrode and wherein a distance from the small gap to a top surface of the upper electrode is not more than 200 nm.

The present invention further provides a production method for producing an electron-emitting device comprising a lower electrode, an insulating layer having a pore, and an upper electrode stacked in this order on a substrate, the electron-emitting device having a carbon deposit in the pore, the production method comprising a step of forming the lower electrode of a metal or a semiconductor on the substrate, a step of forming an anodic oxide layer on a surface of the lower electrode, a step of producing the carbon deposit in the pore of the anodic oxide layer by applying a voltage under existence of an organic material, and a step of forming the upper electrode.

The present invention further provides a production method for producing an electron-emitting device comprising a lower electrode, an insulating layer having a pore, and an upper electrode stacked in this order on a substrate, the electron-emitting device having a carbon deposit in the pore, the production method comprising a step of forming the lower electrode of a metal or a semiconductor on the substrate, a step of forming an anodic oxide layer on a surface of the lower electrode, a step of forming the upper electrode on the lower electrode after formation of the anodic oxide layer, and a step of producing a carbon deposit in the pore of the anodic oxide layer by applying a voltage to the upper electrode and the lower electrode under existence of an organic material.

In the electron-emitting devices of the present invention, the holes are formed in the porous structure in the insulating layer such as the oxide film formed by anodic oxidation, at least the carbon deposit being the electron-emitting body is formed in the holes of the porous structure, and the gap is provided between the lower electrode and the upper electrode; therefore, with application of the voltage between the lower electrode and the upper electrode so as to keep the upper electrode at a higher potential, the electrons injected from the lower electrode tunnel through the gap between the carbon, formed on the lower electrode, and the upper electrode into a vacuum, whereby the electrons are emitted.

DESCRIPTION OF THE PREFERRED EMBODIMENTS

Embodiments of the present invention will be described by reference to the drawings.

First Embodiment

Figure 1A:
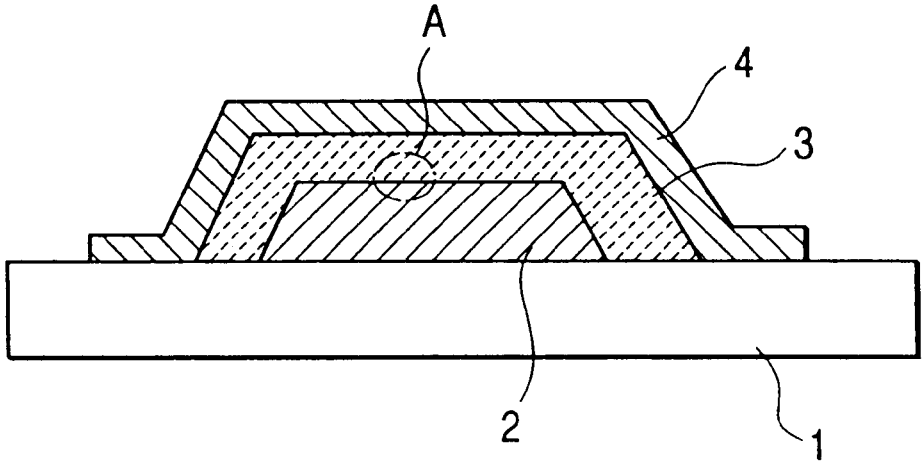
FIG. 1A and FIG. 1B are a sectional view and a perspective view of an electron-emitting device in the first embodiment of the present invention.
Figure 1B:
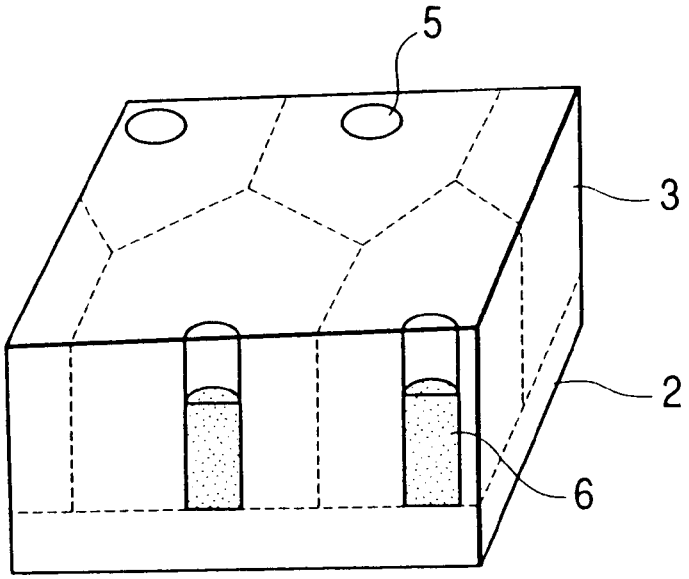

FIG. 1A is a schematic, sectional view to show an example of the electron-emitting device according to the present invention. FIG. 1B is a partly enlarged, schematic view of part A of FIG. 1A. In FIG. 1A, numeral 1 designates a substrate, 2 a lower electrode, 3 an anodic oxide layer, and 4 an upper electrode. In FIG. 1B, numeral 5 represents pores in the porous structure, and 6 carbon electrically connected to the lower electrode.

The substrate 1 to be employed herein can be selected from quartz glass, glass with a decreased content of impurity such as Na, soda lime glass, a glass substrate obtained by depositing $SiO_2$ on soda lime glass by sputtering or the like, ceramics such as alumina, an Si substrate, an Si substrate with a deposited layer of $SiO_2$, and so on. Particularly, when the substrate 1 is a semiconductor substrate, a driver or the like for driving the electron-emitting device can also be mounted simultaneously.

The lower electrode 2 is selected from metals, such as Al, Ta, Nb, Ti, Zr, Hf, or Si, and semiconductors that can undergo anodic oxidation. The thickness of the lower electrode 2 is properly determined according to the thickness of the anodic oxide layer, the electrical resistance of the lower electrode, and so on.

The anodic oxide layer 3 is formed by anodic oxidation of the lower electrode in part. In the anodic oxide layer 3 there exist regular or irregular pores 5. This will also be called porous structure in the present specification. The regular or irregular pores 5 can be formed by selecting anodic oxidation conditions including a composition of an anodic oxidation bath, the temperature of the bath, the voltage, the time, etc., according to the material for the lower electrode 2. Preferably, the regular pores are selected. Diameters of the pores range from several ten nm to several hundred nm and depths thereof from several ten nm to several hundred nm. The density of the pores is $10^8$ to $10^{12}$ pores/cm$^2$ and corresponds to the density of electron-emitting points. Here, an electron-emitting point indicates a small area where electrons are emitted. In each pore 5, carbon 6, which is an electron-emitting body electrically connected to the lower electrode 2, is deposited on the wall of hole or is formed in a pole shape filling a part of each pore. The carbon may also be formed in the similar fashion from the side of the upper electrode 4.

There is a gap created between the carbon, formed on the lower electrode 2, and the upper electrode or, in the case where the carbon is also formed from the side of the upper electrode 4, between the carbon from the upper electrode 4 side and the carbon formed on the lower electrode 2. This gap is preferably several nm to several ten nm, and is properly determined according to the time of the step of applying the voltage to the upper electrode and lower electrode under existence of the organic material detailed hereinafter, the voltage applied, and so on.

The upper electrode is formed on the anodic oxide layer and is preferably made of a metal with excellent electron transmission characteristics, for example, Al.

Figure 2A:
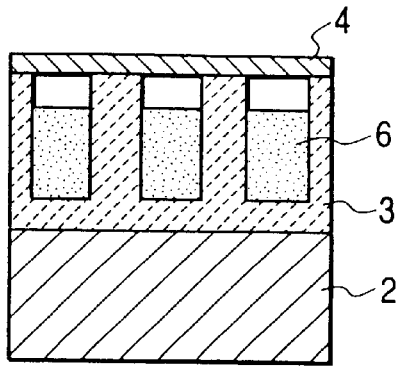
FIG. 2A, FIG. 2B, FIG. 2C, and FIG. 2D are sectional views for explaining structures of the electron-emitting device of the first embodiment.
Figure 2B:
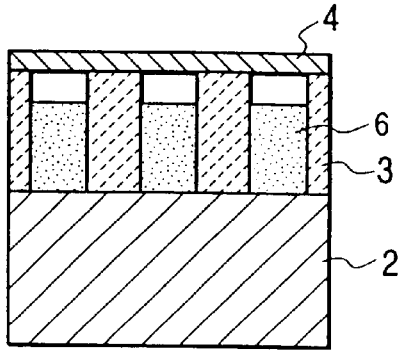
Figure 2C:
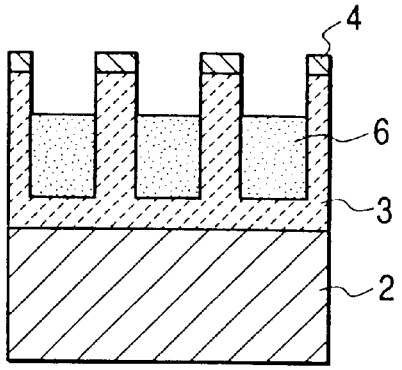
Figure 2D:
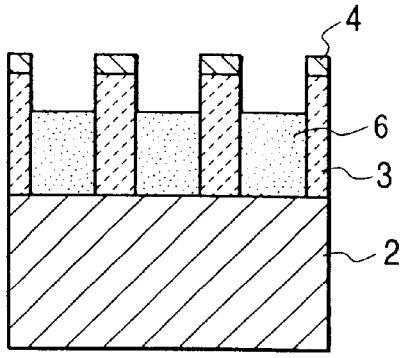

Structural examples of the above electron-emitting device of the present invention will be explained using the schematic sectional views of FIGS. 2A to 2D. In FIGS. 2A to 2D, the same portions as those in FIGS. 1A and 1B are denoted by the same reference numerals. There are four kinds of structures illustrated in FIGS. 2A to 2D, but other structures may also be employed, without having to be limited to these illustrated structures. The following describes examples using the metal for the upper electrode and the lower electrode, but they may also be made of a semiconductor. The structure of FIG. 2A is metal (lower electrode) 2/metal oxide layer 3/pores, each having an electron-emitting body 6/vacuum/metal (upper electrode) 4. The structure of FIG. 2B is metal (lower electrode) 2/pores, each having an electron-emitting body 6/vacuum/metal (upper electrode) 4. The structure of FIG. 2C is metal (lower electrode) 2/metal oxide layer 3/pores, each having an electron-emitting body 6/vacuum/metal (upper electrode) 4 formed in regions except for regions above the pores. The structure of FIG. 2D is metal (lower electrode) 2/pores, each having an electron-emitting body 6/vacuum/metal (upper electrode) 4 formed in regions except for regions above the pores.

In the structures of FIG. 2A and FIG. 2C, the metal oxide layer 3 is obtained on the occasion of anodic oxidation of the lower electrode, and two structural regions, a dense film structural region without pores and a film structural region with pores, can be obtained in this metal oxide layer 3, depending upon the anodic oxidation conditions. As illustrated in FIG. 2A and FIG. 2C, the formation of the dense film structural region of the above metal oxide layer between the lower electrode 2 and the electron-emitting bodies 6 in the pores results in forming a nonlinear device in the structure of metal/insulator/electron-emitting bodies (carbon), so as to impart the function of current limitation, which can prevent current fluctuation in discharge or the like on the occasion of driving the electron-emitting device of the present invention and which can in turn prevent damage to the electron-emitting device. A specific production method of the above metal oxide layer will be described hereinafter, but it is first formed, for example, under conditions for forming porous metal oxide and thereafter the thickness of the dense film structural region is adjusted in a widening step of described hereinafter.

The structures of FIG. 2B and FIG. 2D do not have the metal oxide layer without the pores and the electron-emitting bodies (carbon) in the pores are electrically connected directly to the lower electrode. These structures are obtained by anodizing the lower electrode, thereafter sufficiently widening the pores by the widening step of pores hereinafter and thereafter the electron-emitting bodies (carbon) are formed in the pores, whereby the electron-emitting bodies are electrically connected to the lower electrode. In another method, the metal oxide layer without the pores between the lower electrode and the metal oxide layer with the pores is electrically broken by pulse voltage applied in the step of forming the electron-emitting bodies (carbon) in the pores of the anodic oxide layer described hereinafter, so that the electron-emitting bodies are electrically connected to the lower electrode. In the structures of FIG. 2B and FIG. 2D, the electron-emitting device is also provided with the nonlinear characteristics by tunneling between the electron-emitting bodies and the vacuum. The above "vacuum" is one equivalent to the vacuum ambience in which the substrate with the electron-emitting device formed thereon is set.

When the upper electrode 4 is present in the portions above the pores as in the structures of FIG. 2A and FIG. 2B, the electron-emitting bodies formed in the pores are in contact with the vacuum through the upper electrode. When the upper electrode 4 is absent in the portions above the pores on the other hand as in the structures of FIG. 2C and FIG. 2D, the electron-emitting bodies formed in the pores are in direct contact with the vacuum.

With consideration to aspects of heat resistance of the electron-emitting device of the present invention, stability of electron emission characteristics, improvement in repeatability, and so on, the carbon deposit for forming the electron-emitting bodies is preferably at least one of graphite, amorphous carbon and diamondlike carbon.

Figure 3:
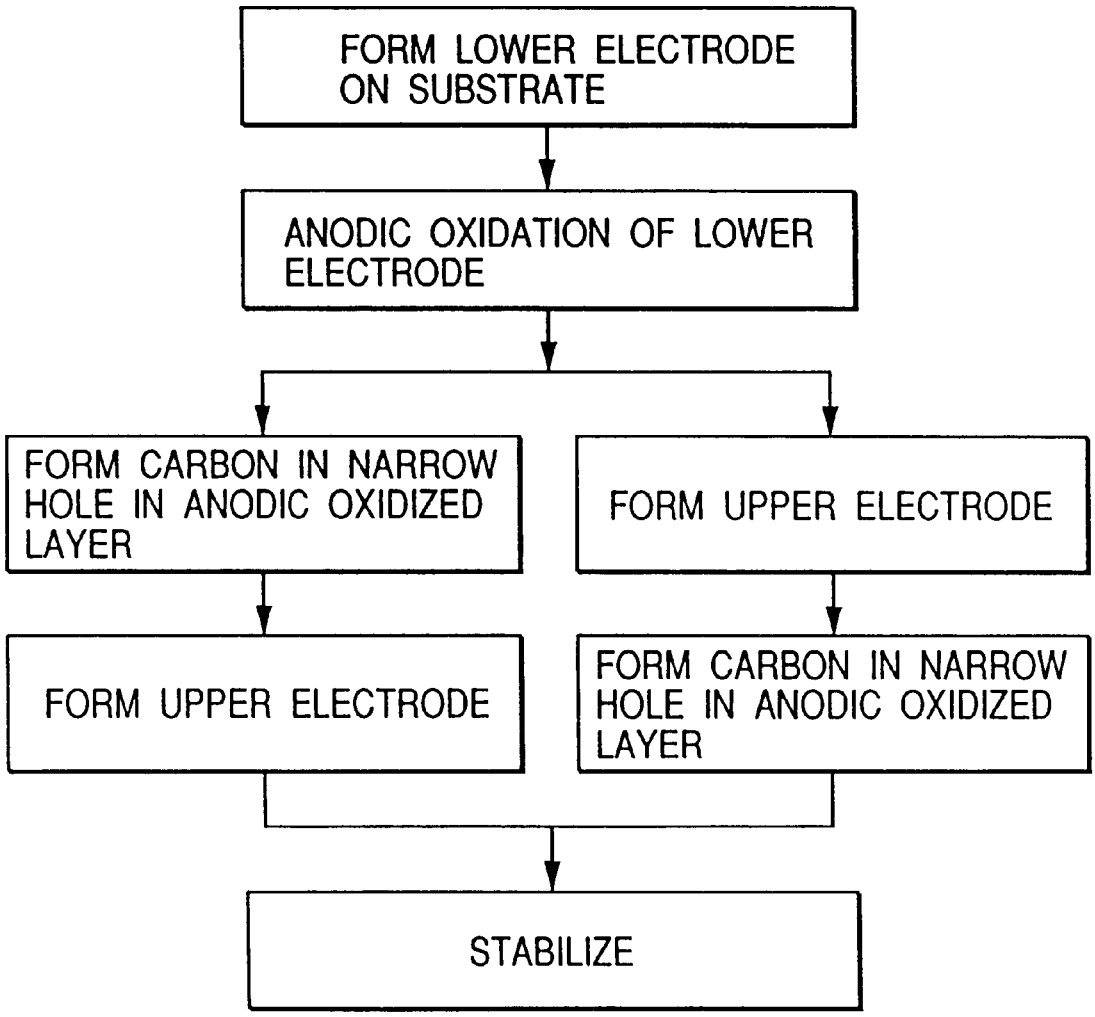
FIG. 3 is a flowchart of a process for producing the electron-emitting device of the first embodiment.

There are various methods for producing the above-stated electron-emitting device, among which an example is schematically illustrated in a step diagram of FIG. 3. A first production method for producing the structures of FIG. 2C and FIG. 2D will be described below.

The first step is a step of forming the lower electrode of the metal or the semiconductor on the substrate. The substrate 1 is cleaned well with detergent, pure water, and organic solvent or the like, a material for the lower electrode is deposited by vacuum evaporation, sputtering, or the like, and thereafter the lower electrode 2 is formed on the substrate, for example, by the photolithography technology. The lower electrode may also be formed by plating.

Figure 4:
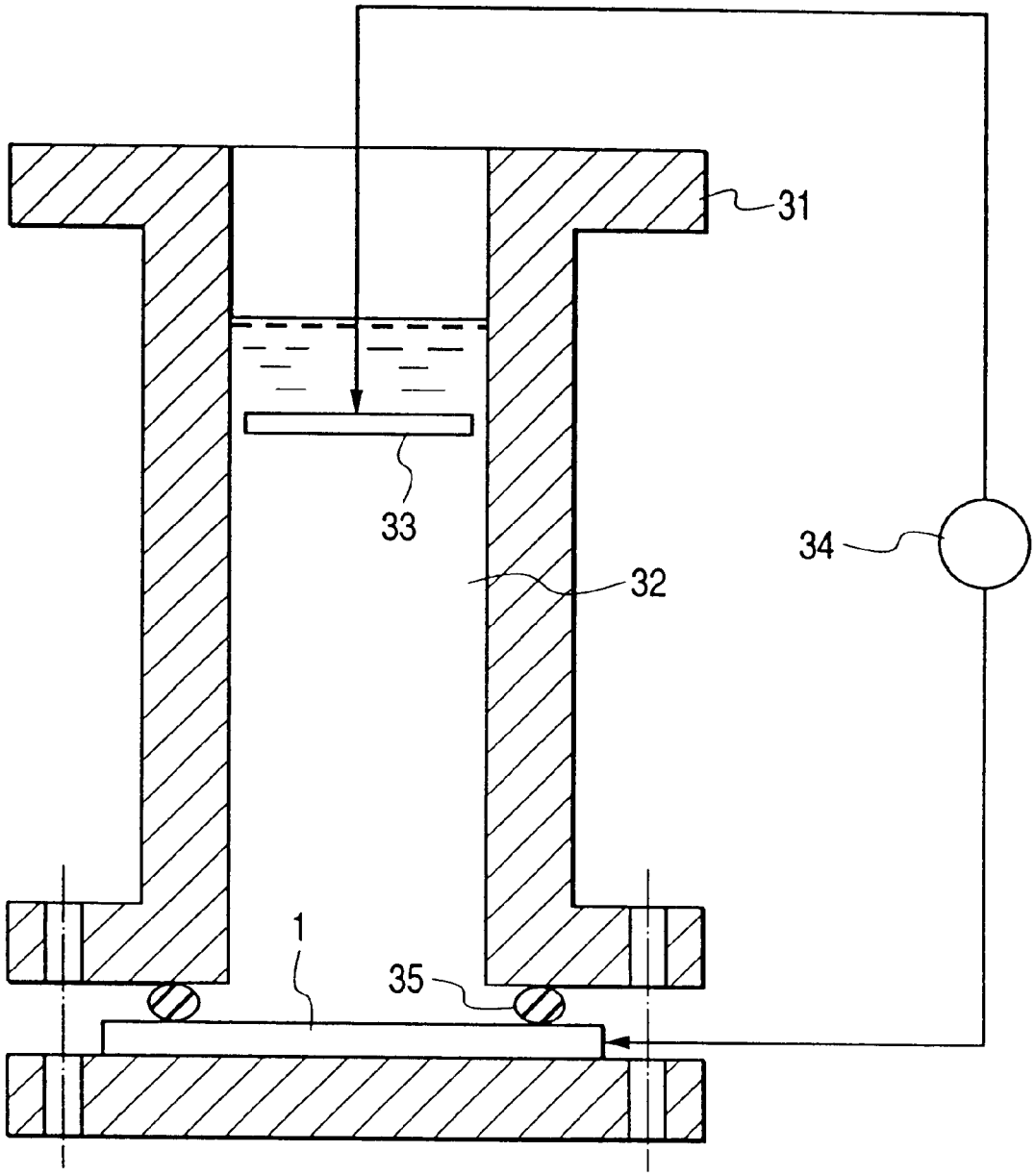
FIG. 4 is a sectional view of an anodic oxidation system used in production of the electron-emitting device.

The second step is a step of anodizing the lower electrode. An anodic oxidation system will be described herein using the conceptual drawing thereof illustrated in FIG. 4. In FIG. 4, numeral 1 represents a substrate, 31 an anodic oxidation tank, 32 an anodic oxidation electrolyte solution, 33 an electrode, 34 a power supply, and 35 an O-ring. The anodic oxidation electrolyte solution 32 for the metal such as Al is an aqueous solution of one selected from inorganic acids such as sulfuric acid, sulfamic acid, and phosphoric acid, and organic acids such as oxalic acid, malonic acid, and succinic acid, and a substance added thereto as solvent is polyhydric alcohol such as ethylene glycol, glycerin, or dextrin. On the other hand, the electrolyte solution for Si is an aqueous solution of HF. Further, an oxidation process such as thermal oxidation may by further added. The electrode 33 is the metal such as Pt. The anodic oxidation of the lower electrode is effected by energization from the power supply 34 with the electrode 33 as a cathode and the substrate 1 as an anode. The geometrical structure of the anodic oxide layer can be controlled by production conditions. Specifically, the spacing between the pores can be controlled by the anodic oxidation voltage, the depths of the pores by the anodic oxidation time, and the diameters of the pores by such conditions as the composition of the electrolyte solution, the voltage, the current. Further, control of the regular pores or the irregular pores can also be made by control of these conditions. Next, the substrate on which the anodic oxide layer was thus formed thereon is dipped in the anodic oxidation electrolyte solution or the like to adjust the diameter of pores and thickness of the dense oxide film (this process will be called widening) and is washed well with water and thereafter dried in vacuum.

The third step is a step of forming the upper electrode on the metal or the semiconductor thus anodized. The upper electrode is formed in the thickness of several nm to several ten nm on the above anodic oxide layer in the same manner as the lower electrode as described above.

The fourth step is a step of forming the electron-emitting bodies in the pores of the anodic oxide layer. This step is a step of forming carbon in the pores of the aforementioned anodic oxide layer by applying the voltage to the upper electrode and lower electrode under existence of the organic material of a gas state. The carbon formed in this step is graphite. The graphite herein is either of so-called HOPG, PG, and GC. HOPG indicates almost perfect graphite crystal structure, PG somewhat disordered crystal structure. having crystal grains of 20 nm or so, and GC more disordered crystal structure having crystal grains of 2 nm or so. In addition, the carbon herein may also be non-crystalline carbon. The non-crystallin carbon herein includes amorphous carbon and, a mixture of amorphous carbon with fine crystals of graphite.

Figure 5:
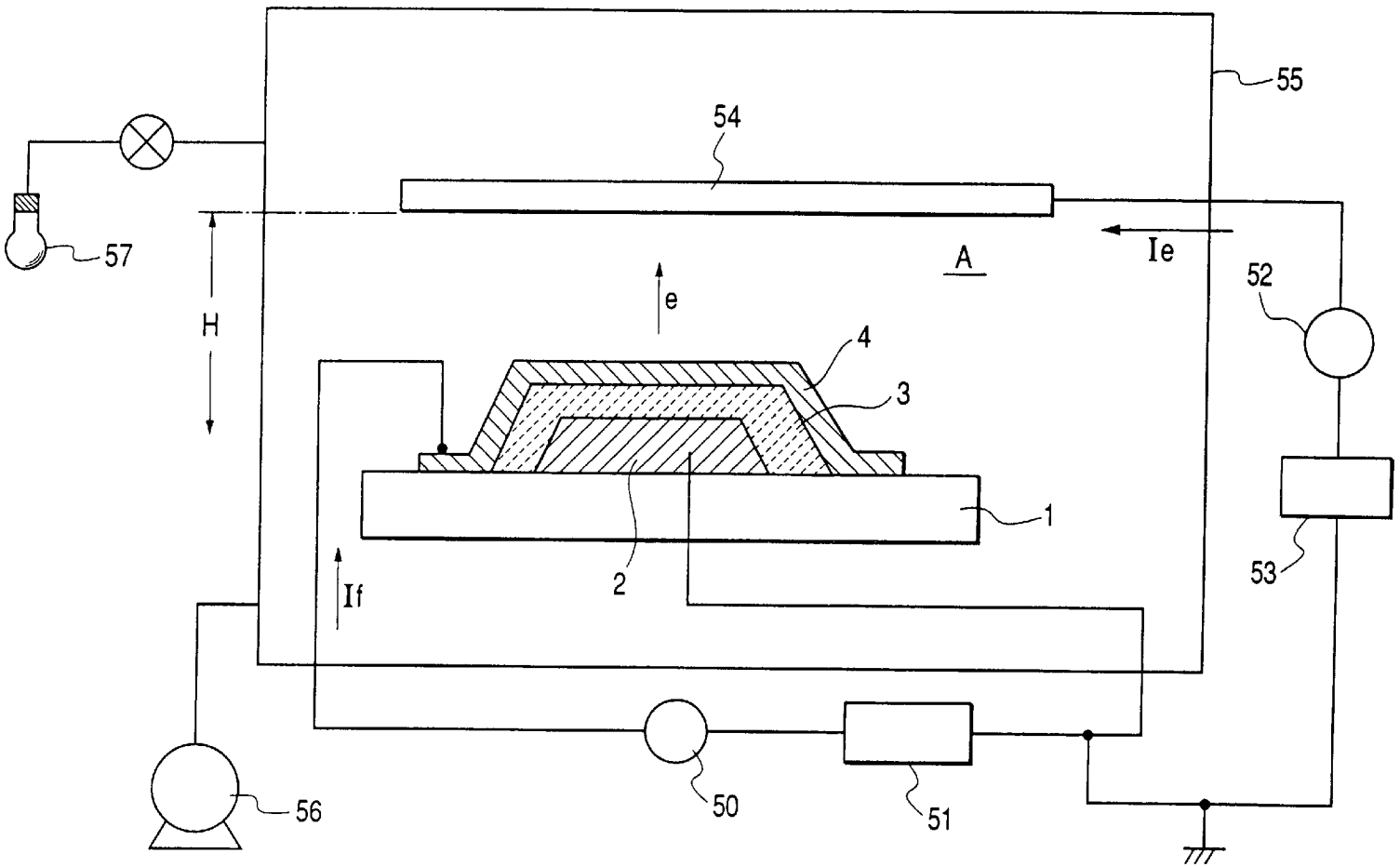
FIG. 5 is a sectional view of a vacuum process system used in production of the electron-emitting device.

Now, a vacuum process system used in the fourth step will be described referring to FIG. 5. In FIG. 5, the same portions as those illustrated in FIGS. 1A, 1B and 2A to 2D are denoted by the same reference numerals. In FIG. 5, numeral 55 indicates a vacuum vessel, 56 an exhaust pump, and 57 a supply of organic gas used in formation of carbon in the pores of the anodic oxide layer of the electron-emitting device according to the present invention. The electron-emitting device of the present invention is placed in the vacuum vessel 55. Specifically, numeral 1 represents the substrate, 2 the lower electrode, 3 the anodic oxide layer, and 4 the upper electrode. Further, numeral 51 denotes a power supply for applying the device voltage Vf to the electron-emitting device, 50 a current meter for measuring the device current If flowing in the lower electrode 2 and the upper electrode 4, and 54 an anode electrode for capturing the emission current Ie of electrons emitted from the device. Numeral 53 designates a high voltage supply for applying the voltage to the anode electrode 54, and 52 a current meter for measuring the emission current Ie emitted from the electron-emitting device. As an example, supposing the voltage of the anode electrode is in the range of 0 to 10 kV, measurement can be carried out while the distance H between the anode electrode and the electron-emitting device is set in the range of 10 $\mu$m to 8 mm. There is provided equipment necessary for the measurement under a vacuum ambience, such as a vacuum gage not illustrated, in the vacuum vessel 55, so as to permit measurement and evaluation under a desired vacuum ambience. The exhaust pump 56 is composed of an ordinary high-vacuum system consisting of a turbo pump or a rotary pump and an ultrahigh vacuum system consisting of an ion pump or the like. The whole of the vacuum process system shown herein can be heated up to 350° C. by a heater not illustrated.

The substrate 1 is set in the vacuum vessel and the vacuum vessel is evacuated into a vacuum ambience. Thereafter, the organic gas is introduced from the supply of organic gas 57 into the vacuum vessel 55 and the voltage is applied to the upper electrode and lower electrode under the ambience containing the gas of organic substance. The waveform of the voltage is a waveform of pulses, which are repetitively applied. A method for applying the voltage may be selected from a method illustrated in FIG. 6A for continuously applying pulses with their pulse peak values of a constant voltage, and a method illustrated in FIG. 6B for applying voltage pulses with increasing pulse peak values.

In the method of the fixed application direction of the pulse voltage wherein either the upper electrode or the lower electrode is fixed at a higher potential while the other at a lower potential (FIG. 6A), supposing the upper electrode is fixed at the lower potential than the lower electrode, the carbon is formed mainly on the lower electrode side which is kept at the higher potential. In the method for applying the higher potential alternately to the upper electrode and to the lower electrode (FIG. 6B), the carbon is formed both on the upper electrode and on the lower electrode.

Figure 6A:
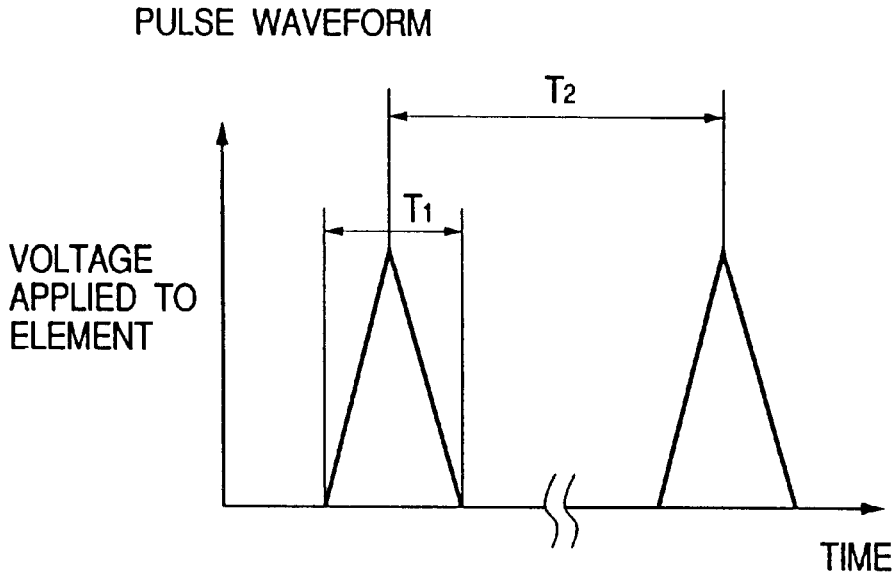
FIG. 6A and FIG. 6B are waveform diagrams of voltage pulses applied in a step of forming carbon in the pores of the anodic oxide layer.

In FIG. 6A, T1 and T2 represent the pulse width and the pulse spacing of pulses in the voltage waveform. Normally, T1 is set in the range of 1 microsecond to 10 milliseconds and T2 in the range of 10 microseconds to 100 milliseconds. The peak values of the triangular waves are properly selected according to the form of the electron-emitting device. Under such conditions the voltage is applied, for example, for several minutes to several ten minutes. The pulse waves are not limited only to the triangular waves, but desired waveforms may be employed including the rectangular waves. Further, T1 and T2 in FIG. 6B can be the same as those illustrated in FIG. 6A. The peak values of the triangular waves can be increased, for example, by steps of about 0.1 V.

The preferred gas pressure of the organic substance for formation of the carbon differs depending upon the aforementioned application form, the shape of the vacuum vessel, the type of the organic substance, and so on and is thus properly determined according to the circumstances. An appropriate organic substance can be selected from aliphatic hydrocarbons of alkane, alkene, and alkyne, aromatic hydrocarbons, alcohols, aldehydes, ketones, amines, organic acids such as phenol, carboxylic acid, and sulfonic acid, and so on. Specific examples of such substances include saturated hydrocarbons represented by $C_nH_{2n+2}$ such as methane, ethane, and propane, unsaturated hydrocarbons represented by the composition formula of $C_nH_{2n}$ or the like such as ethylene and propylene, benzene, toluene, methanol, ethanol, formaldehyde, acetaldehyde, acetone, methyl ethyl ketone, methylamine, ethylamine, phenol, formic acid, acetic acid, propionic acid, and so on. The organic gas is also selected according to the diameter of the pores formed in the anodic oxide layer. This is because adsorption of the organic gas is also dependent on the diameter of the pores.

During this process carbon is deposited from the organic substance present in the ambience into the pores in the anodic oxide layer, whereby the device current If and emission current Ie change remarkably.

Completion of the fourth step is determined while measuring the device current If and the emission current Ie. The apertures of the upper electrode 4 above the pores, illustrated in FIGS. 2C and 2D, are formed in the initial stage of application of the above-stated voltage pulses in this step.

The fifth step is a stabilization step. Namely, this step is a step of stabilizing the characteristics of the electron-emitting device produced by the first to the fourth steps. The fifth step is a step of removing intermediate products of the organic material and also removing the organic gas, water, oxygen, etc. adsorbing to the substrate etc. from the carbon in the pores of the anodic oxide layer, whereby the step can impart to the device such a property that the device current and the emission current monotonically increase above a certain threshold against the voltage applied to the device. This step is a step of exhausting the organic substance in the vacuum vessel and an evacuation apparatus for evacuating the vacuum vessel is preferably one not using oil in order to avoid influence of the oil from the apparatus on the characteristics of the device. Specifically, the evacuation apparatus can be selected from a sorption pump, an ion pump, and so on.

The partial pressure of the organic component in the evacuation apparatus is set to a partial pressure under which there is little carbon or carbon compound newly deposited, and is preferably not more than $1\times10^{-8}$ Torr and particularly preferably not more than $1\times10^{-10}$ Torr. It is further preferred that the whole of the vacuum apparatus be heated during evacuation of the inside of the vacuum apparatus so as to facilitate removal of molecules of the organic substance adsorbing to the inner wall of the vacuum apparatus and to the electron-emitting device. The heating condition at this time is desirably the temperature of 150 to 300° C. and the heating time of not less than several hours, but the heating condition is not limited particularly to this condition.

The ambience during driving after completion of the stabilization step is preferably maintained in the ambience at the end of the above stabilization operation, but it is not limited to this. Sufficient characteristics can be maintained by an ambience from which the organic substance is removed adequately but the vacuum degree of which is a little degraded. By employing such a vacuum ambience, deposition of new carbon substance can be suppressed, whereby the device current If and emission current Ie are stabilized as a result.

Next, a second production method, which is a method for forming carbon or diamondlike carbon in a liquid, will be described referring to the step diagram of FIG. 3. The following describes an example for producing the structures of FIG. 2A and FIG. 2B.

The first step is a step of forming the lower electrode of the metal or the semiconductor on the substrate, which is carried out in the same manner as the method described in the first step of the first production method.

The second step is a step of anodizing the lower electrode, which is similar to the method described in the second step of the first production step, but in which after the anodic oxidation, the substrate with the anodic oxide layer formed thereon is washed with water, dipped in the anodic electrolyte solution (that is "widening") and then is taken into the electrolytic tank of step 3.

The third step is a step of forming the electron-emitting bodies in the pores of the anodic oxide layer under existence of a liquid organic material. This step is a step of forming the electron-emitting bodies in the pores of the aforementioned anodic oxide layer by applying the voltage to the electrode 33 and the lower electrode of FIG. 4. Using the same apparatus as illustrated in FIG. 4, electrolysis is effected in an electrolyte solution of alcohol with the lower electrode as an anode and with the electrode 33 of FIG. 4 as a cathode, whereby diamondlike carbon can be deposited into the pores formed by the anodic oxidation from the lower electrode side. The diamondlike carbon grows in a columnar shape in the pores with a lapse of the electrolytic time.

The fourth step is a step of forming the upper electrode on the metal or the semiconductor thus anodized, in which the upper electrode is formed in the thickness of several nm to several ten nm over the above anodic oxide layer in the same manner as the aforementioned lower electrode was.

The fifth step is a stabilization step, which is carried out in the same manner as the stabilization step described in the fifth step of the first production method.

Example 1 of the First Embodiment

Figure 7A:
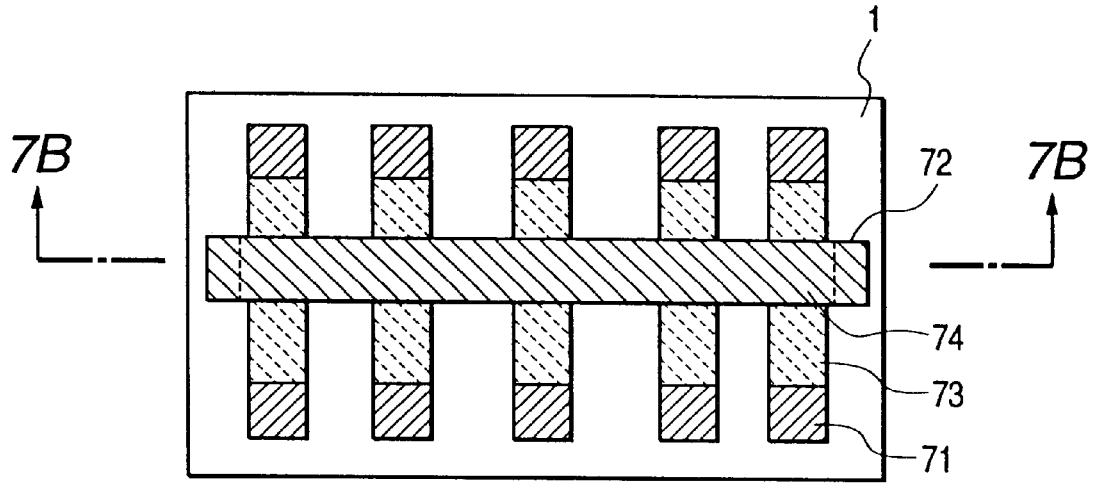
FIG. 7A and FIG. 7B are a plan view and a sectional view of electron-emitting devices in Example 1 of the first embodiment.
Figure 7B:
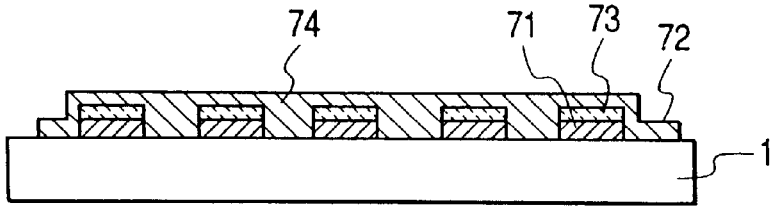

FIG. 7A is a plan view of a substrate on which five electron-emitting devices of the present invention are placed and FIG. 7B is a schematic sectional view along 7B–7B of FIG. 7A.

In FIGS. 7A and 7B, numeral 1 denotes a substrate, 73 anodic oxide layers, 71 lead wires of the lower electrodes, 72 a lead wire of the upper electrodes, and 74 intersections between the lead wires 71 of the lower electrodes and the lead wire 72 of the upper electrodes, at which the electron-emitting devices of the present invention are placed.

In the present example, substrates, each including five electron-emitting devices in either one of the structures of the four types illustrated in FIGS. 2A, 2B, 2C, and 2D, will be called substrates A, B, C, and D, respectively.

A production method of the present example will be described specifically.

(Step 1: Step of Forming the Lower Electrode of Metal on the Substrate)

The substrate 1 of quartz glass was washed well with detergent, pure water, and organic solvent or the like, the material of Al for the lower electrode was deposited in the thickness of 200 nm by sputtering, and thereafter the lower electrode wires 71 were formed in a stripe pattern on the substrate 1 by the photolithography technology. The lower electrode wires 71 were covered in part by a known mask resin for plating in order to use parts of the lower lead wires 71 as terminals.

(Step 2: Step of Anodizing the Lower Electrodes)

Using the anodic oxidation system illustrated in FIG. 4, the lower electrodes of Al prepared in step 1 were anodized. For the substrates B and D, an aqueous solution of oxalic acid 30 g/l was used as an anodic oxidation electrolyte solution (32 in FIG. 4). A Pt electrode was used as the electrode (33 in FIG. 4). The anodic oxidation was carried out at the constant voltage of 45 V from the power supply (34 in FIG. 4) with the electrode (33 in FIG. 4) as a cathode and the lower wires (71 in FIGS. 7A and 7B) provided on the substrate 1, as anodes. On this occasion, the initial current density was 400 mA/cm$^2$, but it decreased with progress of anodic oxidation. Next, the substrate with the anodic oxide layers formed thereon was dipped in $H_3PO_4$ solution, washed well with water and thereafter dried in vacuum. The above anodic oxidation step resulted in forming the pores in the anodic oxide layers. For the substrates A and C, the anodic oxide layers with pores were formed under the same anodic oxidation conditions as in the case of the substrates B and D. A thickness of dense film is controlled by dipping in phosphoric acid solution in a shorter time than that of the cases of the substrates B and D.

(Step 3: Step of Forming the Upper Electrode on the Metal or the Semiconductor Thus Anodized)

The upper electrode 72 was formed in the thickness of 10 nm on the above anodic oxide layers of each of the substrates A, B, C, and D in the same manner as the above lower electrodes had been formed.

(Step 4: Step of Forming Carbon in the Pores of the Anodic Oxide Layers (Under Existence of a Gas Organic Material))

The substrate 1 was placed in the vacuum chamber also serving as a measuring device and the voltage was applied to the upper electrode and lower electrode under an ambience containing gas of acetone at $10^{-1}$ Pa. The voltage was applied for thirty minutes in the form of rectangular waves having the pulse width T1 of 1 ms and the pulse spacing T2 of 10 ms in the pulse waveform of FIG. 6A. At the same time, the current of device was monitored. The voltage was 10 V in the substrate A, B, C, or D. Apertures are formed in the upper electrode above the pores by the application of the above-stated voltage pulses in this step.

(Step 5: Stabilization Step)

Next, the acetone gas was exhausted well and thereafter the system was evacuated for ten hours while being heated at 250° C.

(Step 6: Step of Again Forming the Upper Electrode)

For the substrates A and B, the upper electrode was again formed in the same manner as above, thereby forming the structures of FIGS. 2A and 2B.

Comparative Example (Step 1) to (step 4) were carried out under the production conditions of substrate B, thereby separately preparing a substrate without execution of (step 5: stabilization step). This will be called substrate E.

Results

Figure 8A:
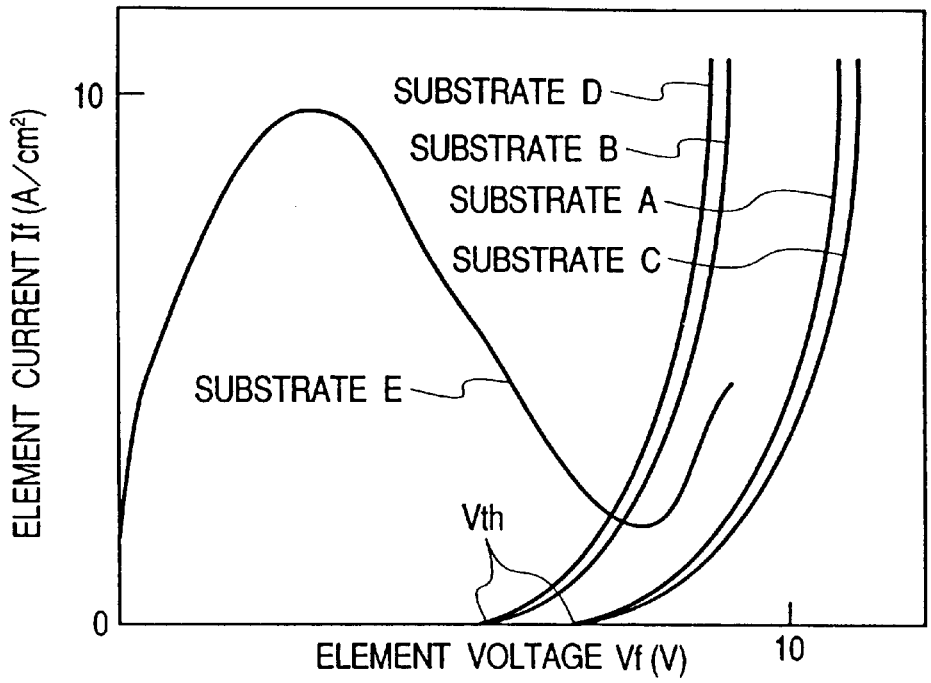
FIG. 8A and FIG. 8B are graphs to show characteristics of electron-emitting devices in Example 1 of the first embodiment.
Figure 8B:
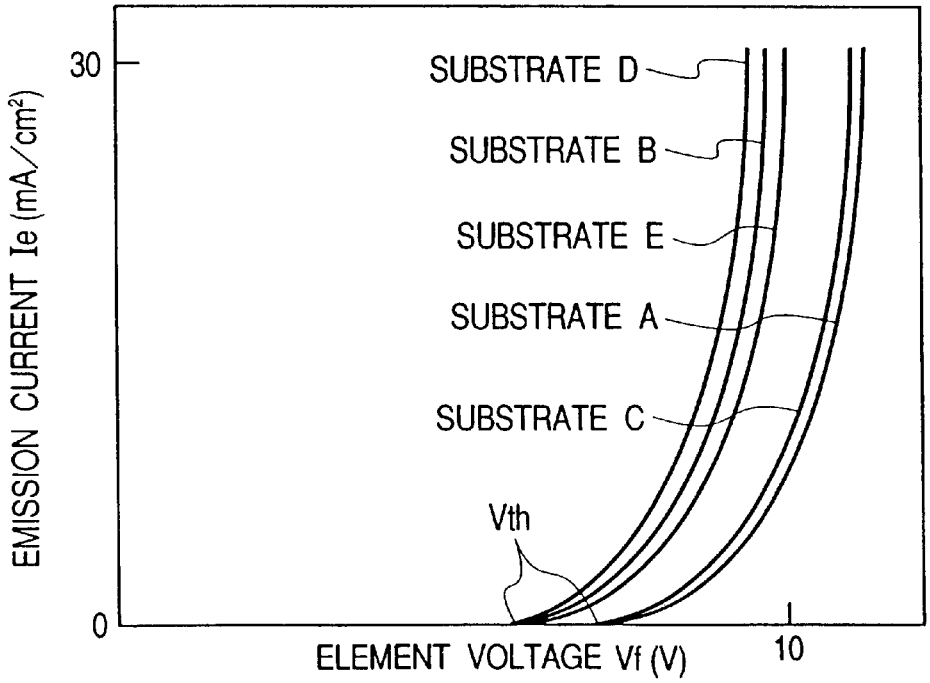

Then the substrate A, B, C, D, or E was set in the vacuum process system of FIG. 5, the voltage was applied to the lower electrode and upper electrode of each device, and to the anode electrode under an ultrahigh vacuum, and the currents (the device current and emission current) and device voltage characteristics were measured. FIGS. 8A and 8B show the current/voltage characteristics. At the same time, it was checked whether the voltage-controlled negative resistance (VCNR characteristics) occurred with slowly sweeping the device voltage. Further, emission of electron beam was observed by emission of a fluorescent member placed at the anode. After the measurements, the samples thus formed were then observed with an electron microscope, plane TEM, and so on.

As apparent from the current/voltage characteristics of FIGS. 8A and 8B, the device current and emission current of the substrates A, B, C, and D demonstrate monotonically increasing characteristics above their threshold. The current was negligible below the threshold (which will be called Vth). These verify that the devices are nonlinear devices demonstrating the nonlinear characteristics of the device current and emission current. On the other hand, it is seen that the substrate E of the comparative example demonstrates the emission current of characteristics that are not the voltage-controlled negative resistance characteristics (VCNR characteristics), but the device current of the voltage-controlled negative resistance characteristics (VCNR characteristics).

Since the substrates A and C have the structure of the dense anodic oxide layer/the anodic oxide layer having the pores, formed on the lower electrode, it is seen that this structure shifts Vth to the higher device voltage than that of the substrates B and D. The diameter of the electron beam observed at the anode electrode was nearly equal to the overlapping part of the upper electrode with the lower electrode.

When the devices were observed with the electron microscope, the regular pores as illustrated in FIG. 1B were observed in the anodic oxide layer in either of the substrates. The diameter of the pores was 200 nm and the density of the pores was $3\times10^8$ pores/cm$^2$.

The upper electrode exists above the pores in the substrates A and B, whereas the upper electrode does not exist above the pores but does exist around the pores in the substrates C and D. This is because the upper electrode above the pores was removed in the case of the substrates C and D on the occasion of applying the pulse voltage in the step of forming the electron-emitting bodies.

Further, plane TEM samples were prepared and observed, and it was verified that graphite-nature carbon existed in the pores in either sample. It seemed that more carbon was deposited in the pores in the substrate E. The deposit further contained carbon other than graphite.

The present example substantiated the following. First, graphite-nature carbon can be formed in the pores of the anodized layer obtained by anodic oxidation of metal. Second, the devices obtained can function as electron-emitting devices. Third, the stabilization step does not cause the voltage-controlled negative resistance characteristics (VCNR characteristics) and both the device current and emission current exhibit the monotonic increase characteristics. Fourth, where the anodic oxide layer is the one having the dense anodic oxide layer functioning as an insulating layer and the anodic oxide layer having the pores, the current/voltage characteristics are shifted to the higher voltage side of the device voltage. Fifth, the diameter of the electron beam observed at the anode electrode is nearly equal to the overlapping part of the upper electrode with the lower electrode and there is thus a little divergence of the beam.

Example 2 of the First Embodiment

The present example is an example in which diamondlike carbon is formed in the pores of the insulating layer, in liquid. A production method of the present example will be described specifically, again referring to FIG. 3.

(Step 1: Step of Forming the Lower Electrode)

A P-type Si wafer was used as a substrate. Here, the P-type wafer substrate functions as a lower electrode.

(Step 2: Step of Anodizing the Lower Electrode)

Using the apparatus of FIG. 4, the anodic oxidation operation was carried out in the aqueous solution of HF with the P-type Si wafer as an anode and Pt as a cathode (33 in FIG. 4), and thereafter the wafer was washed with water and then taken into the electrolytic tank of step 3.

(Step 3: Step of Forming the Electron-emitting Bodies in the Pores of the Anodic Oxide Layer (Under Existence of Liquid Organic Material))

This step is a step of forming carbon in the pores of the anodic oxide layer by applying the voltage under existence of an organic material of a liquid state. Using the system similar to that of FIG. 4, electrolysis was carried out in the electrolyte solution of ethyl alcohol for one hour by applying the voltage between the anode of the lower electrode side of device and the cathode Pt (the electrode 33 of FIG. 4). During the electrolysis the temperature of the solution was controlled at 60° C. by heating the solution with an unrepresented heater. Then the substrate with the anodic oxide layer was washed well with water and thereafter dried in vacuum.

(Step 4: Step of Forming the Upper Electrode)

A Pt film was deposited as an upper electrode in the thickness of 10 nm by sputtering.

(Step 5: Stabilization Step)

The stabilization step was carried out in the same manner as in Example 1 above.

In the last stage, the above sample was set in the vacuum process system of FIG. 5, and the voltage was applied to the lower electrode and the upper electrode, and to the anode electrode to measure the currents (device currents and emission current) and the device voltage characteristics in the same manner as in Example 1. At the same time, it was checked whether the voltage-controlled negative resistance characteristics (VCNR characteristics) appeared with slowly sweeping the device voltage. After the measurements, the sample thus formed was observed with the electron microscope, the plane TEM, and so on.

The current/voltage characteristics of both the device current and emission current were the monotonically increasing characteristics over their threshold and the current was negligible below the threshold, as in Example 1. These verified that the device was a nonlinear device demonstrating the nonlinear characteristics of both the device current and emission current. The emission current was five times greater than those of the devices of Example 1. This is conceivably because of decrease of work function of carbon in the pores or influence of shape.

In observation with the electron microscope, the holes of the porous structure were observed. Further, Raman and plane TEM samples were prepared and observed, and it was proved thereby that diamondlike carbon existed in the holes.

Example 3 of the First Embodiment

Figure 9A:
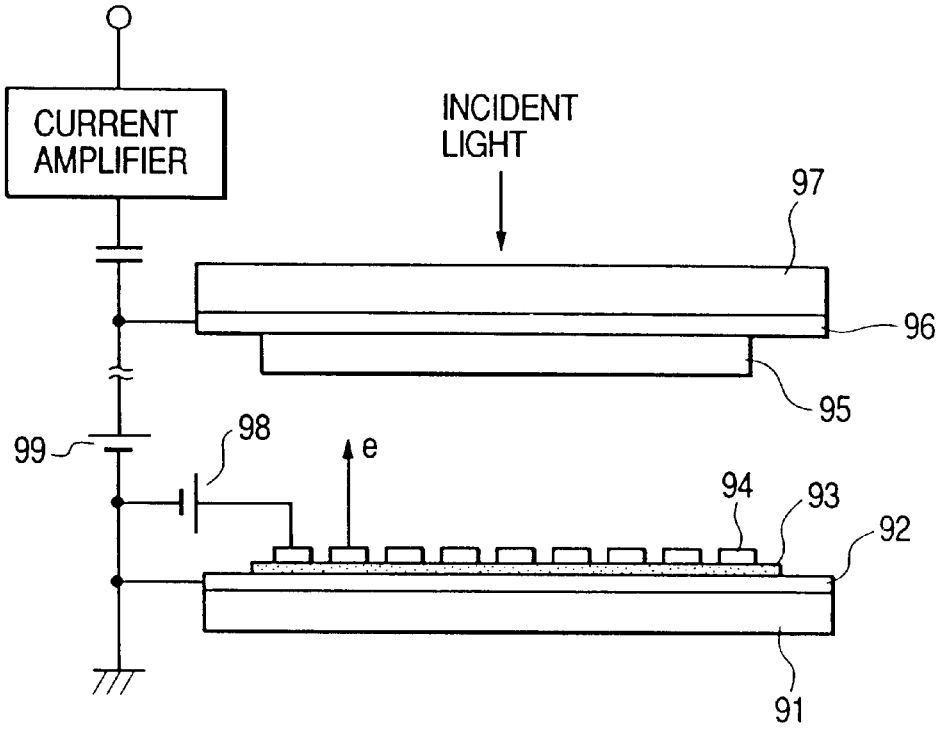
FIG. 9A and FIG. 9B are a sectional view and a plan view of an image pickup device in Example 3 of the first embodiment.
Figure 9B:
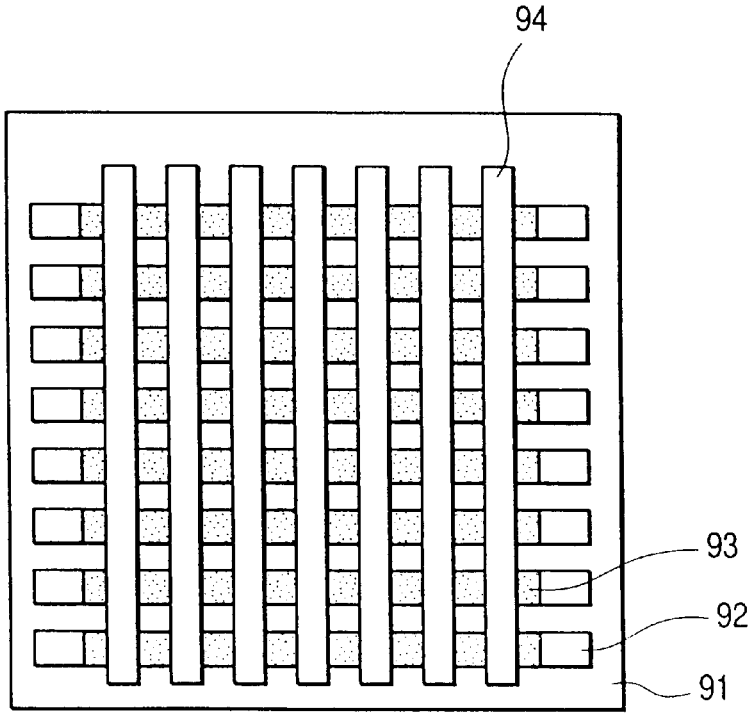

The present example is an example of application to an image pickup device in which a plurality of electron-emitting devices, which were prepared by a method similar to that in Example 1, are placed in a two-dimensional array on a substrate. FIG. 9A and FIG. 9B are schematic views of the image pickup device of the present invention. FIG. 9A is a sectional view of an image pickup tube of the present invention and FIG. 9B is a plan view of the substrate on which the electron-emitting devices are placed. In FIGS. 9A and 9B, numeral 91 designates an electron-emitting device substrate (an electron source substrate), 92 lower electrodes (wires), 93 anodic oxide layers, 94 upper electrodes (wires), 95 a photoconductive member, 96 a transparent electrode, 97 a photoconductive member substrate, 98 a device voltage applying source, and 99 a power supply for applying the voltage to the photoconductive member. In FIG. 9A, the electron-emitting device substrate and the photoconductive member substrate are bonded to a support frame not illustrated, thereby composing a hermetically closed container. The inside of the container is maintained in a high vacuum. Although FIG. 9A is illustrated so that one of the upper electrodes is connected to the device voltage applying source, it is noted that all the upper electrodes are connected to the device voltage applying source.

Next described is the principle of the image pickup device of the present example. The operation of the image pickup device of the present example is similar to that of the conventional image pickup tubes, but the image pickup device of the present example is different from the conventional image pickup tubes in that an image is read using electron beams from the electron-emitting devices arrayed in the two-dimensional pattern and in that the image pickup device does not have a converging system for converging the electron beams. When light is incident to the photoconductive member 95, holes are created in the photoconductive member 95 by the incident light. The holes are accelerated toward the electron-emitting device substrate 91 by an electric field applied to the photoconductive member 95, so as to undergo avalanche multiplication. On the other hand, electron beams emerge from the electron-emitting device substrate 91. Electrons are injected into the photoconductive member 95 in the number corresponding to the holes accumulated therein, and excessive electron beams return to the electron-emitting device substrate 91 to flow in the upper wires 94. In this way, signal current according to the holes generated in response to the incident light is outputted from a signal current amplifier.

Next, the structure of the image pickup device of the present example will be described. Over the electron-emitting device substrate 91, the anodic oxide layers 93 are formed in regions except for the lead portions of wires on the lower electrode wires 92, and the upper wires 94 are formed perpendicularly to the lower electrode wires 92. Intersecting portions between the lower electrode wires 92 and the upper wires 94 constitute the electron-emitting regions similar to those in FIGS. 1A and 1B. The size of the electron-emitting device is 50 $\mu$m square. The photoconductive member 95 is made of Se and the thickness thereof is 4 $\mu$m. The separation between the electron-emitting device substrate 91 and the photoconductive member substrate 97 is 1 mm.

A method for producing the image pickup device of the present example will be described below. The side of electron-emitting device substrate 91 was prepared in the same manner as in the example. Further, the photoconductive member 95 was deposited by a resistance heating evaporation method of Se. The electron-emitting device substrate and the photoconductive member substrate thus prepared were bonded to the unrepresented support frame. After the inside was evacuated through an exhaust pipe not illustrated, a hermetically closed container was formed. Then the image pickup device thus produced was operated based on the principle of operation described previously and the signal current was obtained in 1:1 correspondence to the size of the electron-emitting devices. The operation was thus confirmed.

Example 4 of the First Embodiment

Figure 10A:
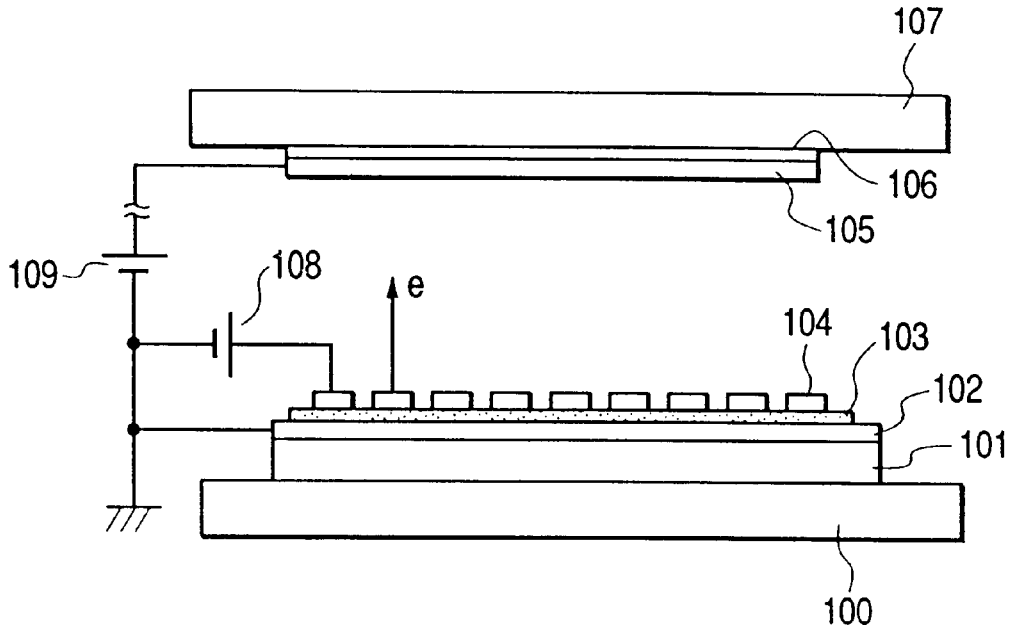
FIG. 10A and FIG. 10B are a sectional view and a plan view of a display device in Example 4 of the first embodiment.
Figure 10B:
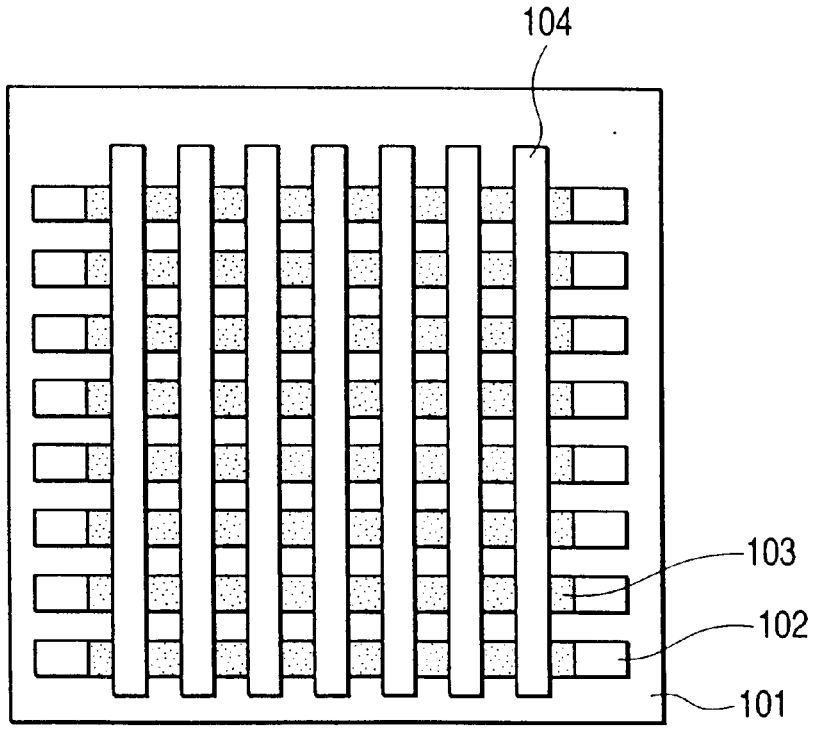

The present example is an example of construction of a display device in which a plurality of electron-emitting devices, which were prepared in a method similar to that in Example 2, are placed in a two-dimensional array on a substrate. FIGS. 10A and 10B are schematic views of the display device of the present invention. FIG. 10A is a schematic sectional view of the display device of the present invention and FIG. 10B is a plan view of the substrate on which the electron-emitting devices are placed. In FIGS. 10A and 10B, numeral 100 represents a rear plate, 101 an electron-emitting device substrate (an electron source substrate), 102 lower electrodes (wires), 103 anodic oxide layers, 104 upper electrodes (wires), 105 a metal back, 106 a fluorescent member, 107 a face plate, 108 a device voltage applying source, and 109 a high voltage supply for the anode. In FIG. 10A, the electron-emitting device substrate and the face plate are bonded to an unrepresented support frame to compose a hermetically closed container and the inside thereof is maintained in a high vacuum. Although FIG. 10A is illustrated so that one of the upper electrodes is connected to the device voltage applying source, it is noted that all the upper electrodes are connected to the device voltage applying source. The fluorescent member 106 is formed in a stripe pattern in which black stripes divide fluorescent materials of R (red), G (green), and B (blue) not illustrated, from each other.

Next described is the principle of the display device of the present example. In the display device of the present example, each electron-emitting device line in the two-dimensional array is selected by a scanning signal from the outside and electron beams are emitted from the devices in the electron-emitting device line selected with being modulated by a modulation signal from the outside. The electron beams emitted diverge a little in the electron-emitting devices of the present invention. Thus, the electron beams are accelerated without using a converging system of electron beam and are incident to the metal back/the fluorescent member to cause luminescence. An image is displayed in this way.

The structure of the display device of the present example will be described below. Over the electron-emitting device substrate 101 the anodic oxide layers 103 are formed in regions except for the lead portions of wires on the lower electrode wires 102, and the upper wires 104 are formed perpendicularly to the lower electrode wires 102. Intersecting portions between the lower electrode wires 102 and the upper wires 104 constitute the electron-emitting devices similar to that in FIGS. 1A and 1B. The display device was composed of 200×(160×3 (i.e., R, G, and B)) electron-emitting devices. FIGS. 10A and 10B show those in part. The size of the electron-emitting device is 40 $\mu$m square. The fluorescent member 106 was high-acceleration fluorescent material P22 for CRT. The separation between the electron-emitting device substrate 101 and the face plate 107 was 2 mm. The voltage of 5 kV was applied to the metal back 105.

A method for producing the display device of the present example will be described below.

(Step 1: Step of Forming the Lower Electrodes of the Metal or the Semiconductor on the Substrate 101)

The substrate was an n-type Si wafer. A plurality of stripes of P-type portions were formed in the n-type Si wafer. The stripes of the P-type portions function as the lower electrodes.

(Step 2: Step of Anodizing the Lower Electrodes)

Using the apparatus of FIG. 4, the anodic oxidation operation was carried out in the aqueous solution of RF with the P-type portions of the Si wafer as anodes and Pt as a cathode, and thereafter the wafer was washed with water and then taken into the electrolytic tank of step 3. The anodic oxide layers were selectively formed in the stripes of the P-type portions.

(Step 3: Step of Forming the Electron-emitting Bodies in the Pores of the Anodic Oxide Layers (Under Existence of Organic Material of Liquid State))

This step is a step of forming the electron-emitting bodies in the pores of the anodic oxide layers by applying the voltage to the upper electrodes and lower electrodes under existence of an organic material of a liquid state. Using the apparatus similar to that of FIG. 4, electrolysis was brought about in the electrolyte solution of ethyl alcohol for one hour between the cathode of the lower electrode side and the anode. During the electrolysis the temperature of the solution was controlled at 60° C. by heating the solution by the heater not illustrated. Then the substrate with the anodic oxide layers was washed well with water and thereafter dried in vacuum.

(Step 4: Step of Forming the Upper Electrodes on the Metal or Semiconductor Thus Anodized)

The upper electrodes were formed in the thickness of 10 nm by sputtering of Pt.

(Step 5: Stabilization Step)

The stabilization step was carried out in the same manner as in above Example 1.

The fluorescent materials of R, G, and B were formed in stripes on the face plate 107 and after filming thereof, the metal back 105 was deposited by evaporation. The electron-emitting device substrate 101 prepared as described above was placed on the rear plate 100 and the face plate 107 was bonded to the unrepresented support frame. After the Inside was evacuated through an exhaust pipe not illustrated, a hermetically closed container was constructed.

Then the display device thus produced was operated based on the principle of operation described previously and it was verified that a bright image was displayed in high definition.

Second Embodiment

Figure 11A:
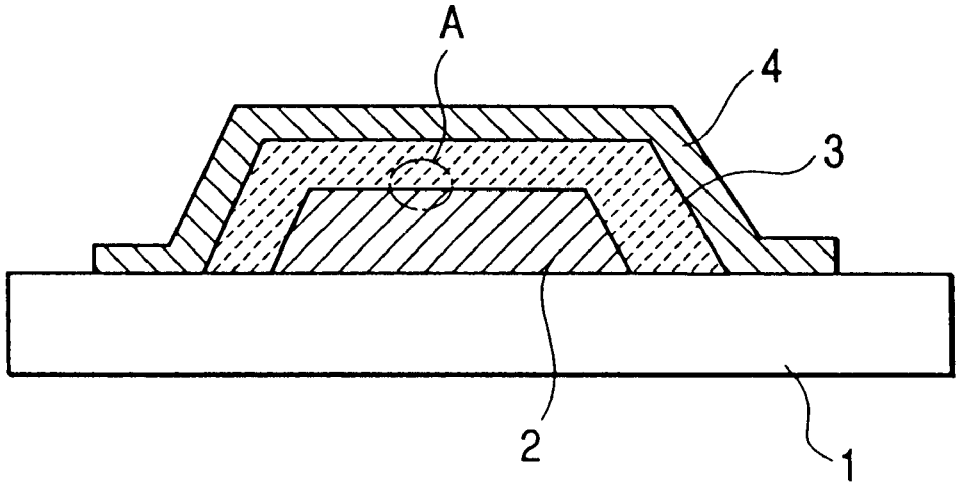
FIG. 11A and FIG. 11B are a sectional view and a perspective view of an electron-emitting device in the second embodiment of the present invention.
Figure 11B:
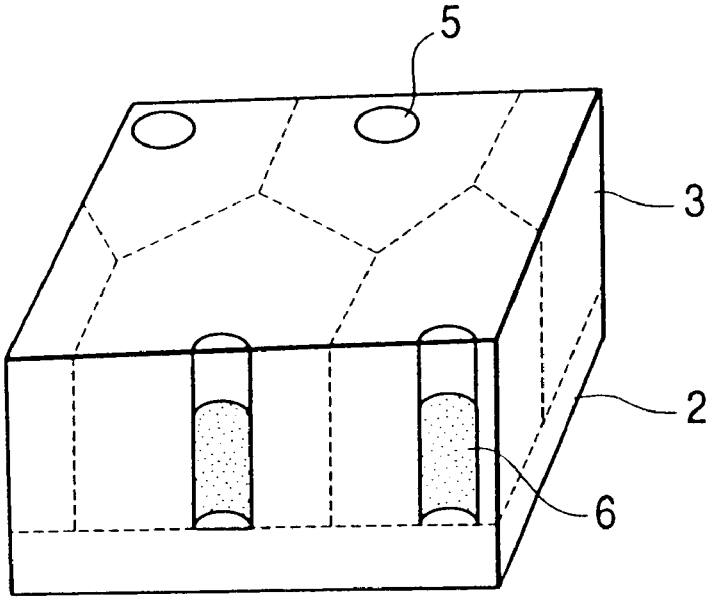

FIG. 11A is a sectional view of the second embodiment. FIG. 11B is a partly enlarged, schematic view of part A in the sectional view of FIG. 11A. The present embodiment uses the anodic oxide layer for the insulating layer. In FIG. 11A reference numerals are given in the similar fashion to those in FIGS. 1A and 1B.

The substrate 1 to be employed herein can be selected from quartz glass, glass with a decreased content of impurity such as Na, soda lime glass, a glass substrate obtained by depositing $SiO_2$ on soda lime glass by sputtering or the like, ceramics such as alumina, an Si substrate, an Si substrate with a deposited layer of $SiO_2$, and so on. Particularly, when the substrate 1 is a semiconductor substrate, a driver or the like for driving the electron-emitting device can also be mounted simultaneously.

The lower electrode 2 is selected from metals, such as Al, Ta, Nb, Ti, Zr, Hf, or Si, and semiconductors that can undergo anodic oxidation. The thickness of the lower electrode 2 is properly determined according to the thickness of the anodic oxide layer, the electrical resistance of the lower electrode, and so on. The materials for the lower electrode are not limited to only the metals that can be anodized, but they may also be of a stack form of a metal that cannot be anodized and a metal that can be anodized.

The anodic oxide layer 3 is formed by anodic oxidation of the lower electrode in part. In the anodic oxide layer 3 there exist regular or irregular pores 5. This will also be called porous structure in the present specification. The regular or irregular pores 5 can be formed by selecting anodic oxidation conditions including a composition of an anodic oxidation bath, the temperature of the bath, the voltage, the time, etc., according to the material for the lower electrode 2. Preferably, the regular pores are selected. Diameters of the pores range from several ten nm to several hundred nm and depths thereof from several ten nm to several thousand nm. The density of the pores is $10^8$ to $10^{12}$ pores/cm$^2$. The shape of the pores is not limited only to the circle, but the ellipse, square, etc. can also be applied to the electron-emitting devices of the present invention. The variety of shapes can also be formed using the focused ion beam or the like. Therefore, the expression "length of pore" will also be used in place of the diameter of pore in the present invention. In each pore 5, carbon 6 electrically connected to the lower electrode 2 is formed in a rim shape along the inner wall of pore. Electrons are emitted from the rim-shape part on the inner wall in each pore, thus achieving linear electron emission from each pore according to the shape of the pore.

The carbon may also be formed in the similar fashion from the side of the upper electrode 4.

There is a gap created between the carbon formed on the lower electrode 2, and the upper electrode or, in the case where the carbon is also formed from the side of the upper electrode 4, between the carbon from the upper electrode 4 side and the carbon formed on the lower electrode 2. This gap is preferably several nm to several ten nm, and is properly determined according to the time of the step of applying the voltage to the upper electrode and lower electrode under existence of the organic material detailed hereinafter, the voltage applied, and so on.

The upper electrode is formed above the anodic oxide layer and is made preferably of a material having a high melting point, such as Pt, W, Mo, or Hf.

Structural examples of the above electron-emitting device of the present invention will be explained using the schematic sectional views of FIGS. 12A to 12D. In FIGS. 12A to 12D, the same portions as those in FIGS. 11A and 11B are denoted by the same reference numerals. In the figures reference numeral 7 designates an electroconductive member of metal or the like and 8 a small gap between the upper electrode and the electron-emitting bodies. There are four kinds of structures illustrated in FIGS. 12A to 12D, but other structures may also be employed, without having to be limited to these illustrated structures. The following describes examples using the metal for the upper electrode and the lower electrode, but they may also be made of the semiconductor.

Figure 12A:
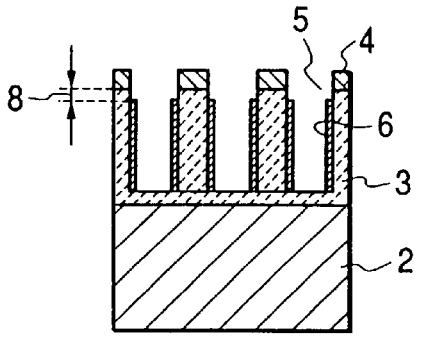
FIG. 12A, FIG. 12B, FIG. 12C, and FIG. 12D are sectional views for explaining structures of the electron-emitting device of the second embodiment.
Figure 12B:
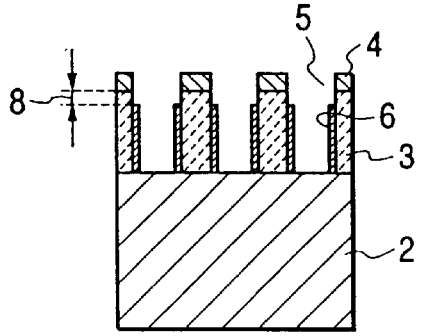
Figure 12C:
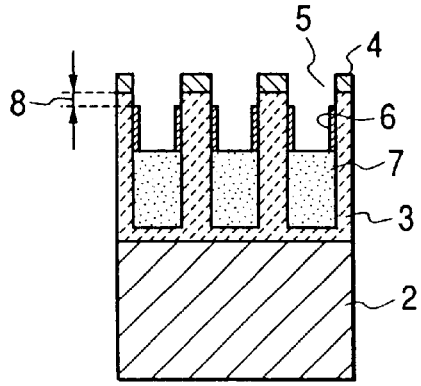

The structure of FIG. 12A is metal (lower electrode)/metal oxide layer/pores, each having a rim-shape electron-emitting body 6 along the inner wall of pore/vacuum/metal (upper electrode) 4 formed in the regions except for the regions above the pores. The structure of FIG. 12B is metal (lower electrode)/pores, each having a rim-shape electron-emitting body 6 along the inner wall of pore/vacuum/metal (upper electrode) 4 formed in the regions except for the regions above the pores. The structure of FIG. 12C is metal (lower electrode)/metal oxide layer/pores, each having a pole-shaped electroconductive member 7 and a rim-shape electron-emitting body 6 along the inner wall of pore/vacuum/metal (upper electrode) 4 formed in the regions except for the regions above the pores. The structure of FIG. 12D is metal (lower electrode)/pores, each having a pole-shaped electroconductive member 7 and a rim-shape electron-emitting body 6 along the inner wall of pore/vacuum/metal (upper electrode) 4 formed in the regions except for the regions above the pores.

In the structures of FIG. 12A and FIG. 12C, the metal oxide layer 3 is obtained on the occasion of anodic oxidation of the lower electrode, and two structural regions, a dense film structural region without pores and a film structural region with pores, can be obtained in this metal oxide layer 3, depending upon the anodic oxidation conditions. As illustrated in FIG. 12A and FIG. 12C, the formation of the dense film structural region of the above metal oxide layer between the lower electrode 2 and the electron-emitting bodies 6 in the pores results informing a nonlinear device in the structure of metal insulator/rim-shape electron-emitting bodies, so as to impart the function of current limitation, which can prevent current fluctuation in discharge or the like on the occasion of driving the electron-emitting device of the present invention and which can in turn prevent damage to the electron-emitting device. A specific production method of the above metal oxide layer will be described hereinafter, but it is first formed, for example, under conditions for forming the porous metal oxide and thereafter the thickness of the dense film structural region is adjusted in a widening step of pores described hereinafter.

Figure 12D:
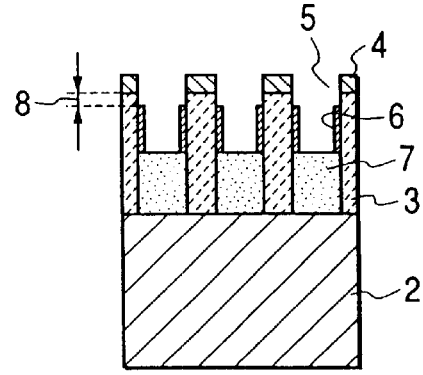

The structures of FIG. 12B and FIG. 12D do not have the metal oxide layer without the pores and the electron-emitting bodies (carbon) in the pores are electrically connected directly to the lower electrode. This structure is constructed by anodizing the lower electrode, thereafter sufficiently widening the pores by the widening step of pores described hereinafter, and further forming the electron-emitting bodies (carbon) in the pores, whereby the lower electrode becomes electrically connected to the electron-emitting bodies. On this occasion, the metal oxide layer without the pores between the lower electrode and the metal oxide layer with the pores may be electrically broken by the pulse voltage applied in the step of forming the carbon in the pores of the anodic oxide layer described hereinafter, so that the electron-emitting bodies are electrically connected to the lower electrode in some cases.

In the structures of FIG. 12B and FIG. 12D, the electron-emitting device is also provided with the nonlinear characteristics by tunneling between the electron-emitting bodies and the vacuum. In the structures of FIG. 12C and FIG. 12D, there are the pole-shaped electroconductive bodies and the rim-shaped electron-emitting bodies along the inner walls of pores, in the pores. In these cases, the conductive bodies decrease the resistance of the region from the lower electrode to the electron-emitting bodies, so that the insulating layer can be formed in larger thickness, so as to decrease the capacitance between the lower electrode and the upper electrode, which is advantageous in terms of driving.

The electrical connection with the lower electrode can also be achieved in such a way that the metal is precipitated by alternating current into the pores of the anodic oxide film by the coloring method of the anodic oxide film conventionally well known whereupon the precipitating metal into the pores migrates into the dense anodic oxide film to implement the electrical connection. The above "vacuum" is one equivalent to the vacuum ambience in which the substrate with the electron-emitting device formed thereon is set.

In the electron-emitting device of the present invention described above, the carbon making the electron-emitting bodies is preferably at least one of graphite, amorphous carbon, and diamondlike carbon, particularly, in terms of heat resistance, stability of electron emission characteristics, and improvement in repeatability, as stated previously.

Next described is an electron-emitting mechanism of the electron-emitting device of the present invention in the structural examples of FIGS. 12A to 12D. In the surface conduction electron-emitting device stated previously in the related background art, according to Japanese Laid-open Patent Application No. 9-82214, electrons are once emitted into the vacuum outside the anode from a certain position on the anode side (which is also called the higher potential side) of the fissure region, in the fissure region of the surface conduction electron-emitting device. The electrons once emitted move in the electric field created by the cathode (which is also called the lower potential side) and the anode, and electrons flying over the singular point (hereinafter referred to as a stagnation point) of the electric field are attracted to the anode plate by the electric field created by the voltage applied thereto. The electrons that do not reach the singular point of the electric field drop onto the anode, and some of electrons are scattered here to be deflected and again emitted into the vacuum. Electrons moving over the singular point of the electric field as a result of repetition of this scattering also reach the anode plate.

It is described in the prior art application that, in order to largely increase the electron emission efficiency, the electric field needs to be set in such conditions that most of the electrons once emitted are attracted to the anode plate without dropping onto the anode in the above mechanism of electron emission and that the electron emission efficiency can be increased by providing the field correcting electrode outside the device electrode and applying a sufficiently higher voltage thereto than the voltage applied to the device for emission of electron.

In contrast with it, in the case of the electron-emitting device of the present invention, when the higher potential is applied to the upper electrode and the lower potential than that to the upper electrode is applied to the lower electrode, a potential difference between them is placed in the small gap between the upper electrode 4 and the electron-emitting bodies 6, whereupon electrons are emitted from the electron-emitting bodies into the vacuum. Since a strong electric field is placed in the small gap corresponding to the fissure of the aforementioned prior art, the electrons emitted from the electron-emitting bodies 6 into the vacuum collide with the upper electrode 4 to be scattered, just as in the case of the surface conduction electron-emitting device described previously in the related background art. It is, however, assumed that, in the case of the electron-emitting device of the present invention, the electrons reach the anode plate over the singular point of the electric field without repetition of scattering.

Figure 13:
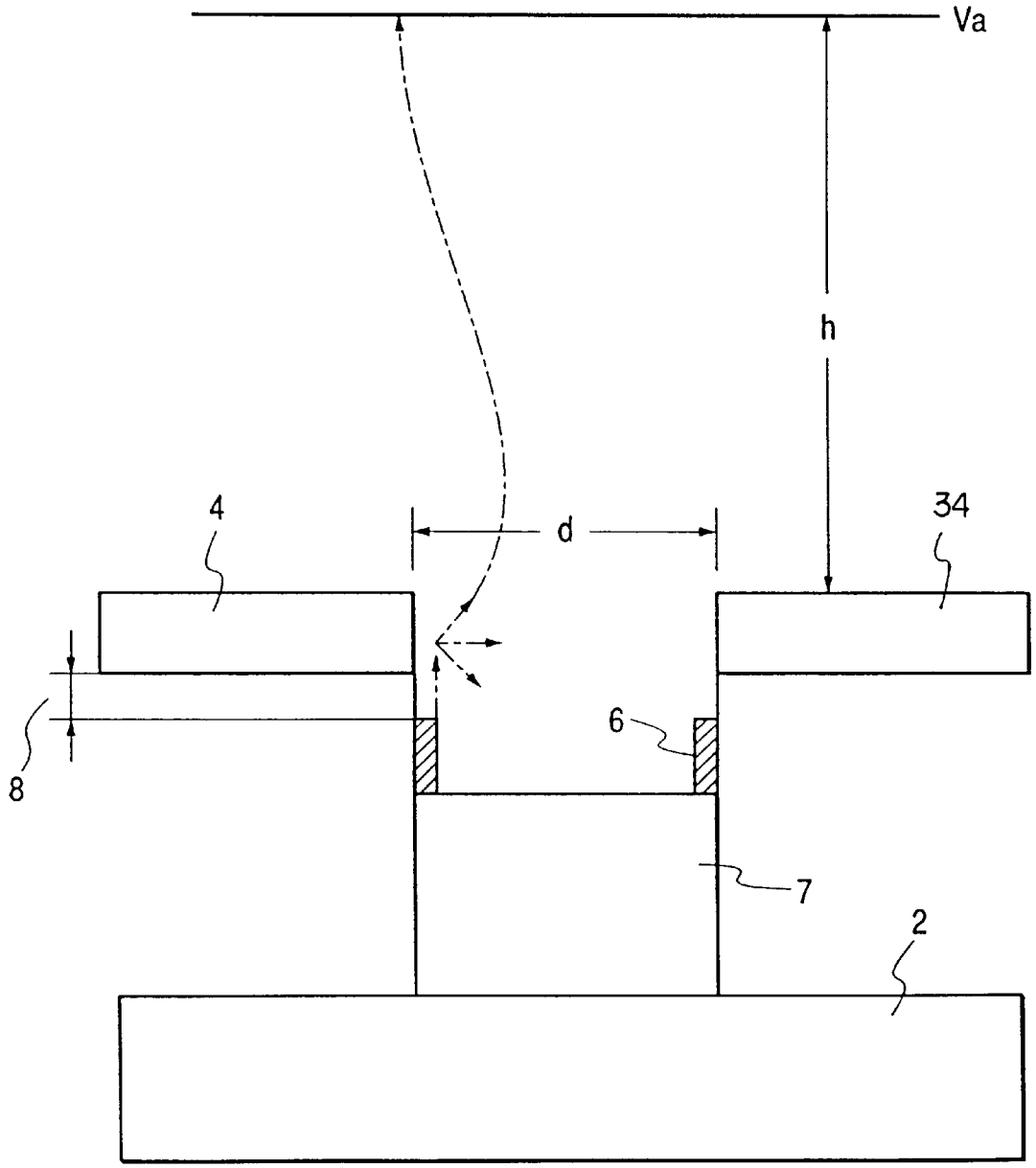
FIG. 13 is a sectional view for explaining the principle of operation of the electron-emitting device in the second embodiment.

FIG. 13 is a diagram to show the principle of the electron-emitting device of the present invention. FIG. 13 is a schematic sectional view of FIG. 12D. In FIG. 13 the portions denoted by the same reference numerals as those in FIG. 12D indicate the same portions. In the figure, h indicates the distance between the electron-emitting device and the anode plate, d the length of pore, and Va the potential of the anode plate.

The following discussion is made with focusing attention on electrons emitted from the electron-emitting body 6 on one side. The electrons emitted from the electron-emitting body 6 into the vacuum collide with the upper electrode 4 because of the electric field placed in the small gap to be first scattered isotropically. Since the strong electric field from the upper electrode 34 present at the very close distance considerably decreases the stagnation point described above, as compared with that in the conventional surface conduction electron-emitting device, the electrons isotropically scattered reach the anode plate without repetitive scattering, mostly after scattered only once. On the other hand, where the thickness of the upper electrode 4 is small, the electrons also reach the anode plate, mostly after scattered only once, without repetitive scattering. It is considered that the above accounts for the increase of the electron emission efficiency.

An important factor for the effect of the electric field of the upper electrode opposite to the upper electrode 4 is the diameter of the aperture. Supposing the work function of the conductive electron-emitting body is 4 to 5.5 eV, the electric field for emission of electrons into the small gap is not less than $10^7$ V/cm. When the stagnation point being the singular point of the electric field as defined in the aforementioned prior art is applied to the prior art electron-emitting device and the present invention, the distance Xs of the stagnation point without 34 is represented by the following equation.

$$Xs=h\cdot Vf/(\pi\cdot Va)$$

On the other hand, the stagnation point Xs' with 34 is indicated by the following equation.

$$Xs'=h\cdot Vf/\{\pi\cdot Va+h\cdot Vf/(\pi\cdot d)\}$$

Therefore, the smaller the diameter of the aperture, the more the stagnation point is constricted. Particularly, from the reason that the constriction effect of the stagnation point can be expected even at the upper electrode voltage of several ten V, the diameter of the aperture is preferably not more than 0.5 $\mu$m and more preferably not more than 0.2 $\mu$m. Further, since the conductive electron-emitting body is present along the inner wall of pore, the wall in the pore is kept at one potential, which further constricts the aforementioned stagnation point. This further increases the electron emission efficiency.

The effect of the formation of the rim-shape electron-emitting body on the electron emission efficiency can be expected before the depth of the pore indicating the same potential becomes nearly equal to the diameter of the pore.

Further, the thickness of the upper electrode is preferably as thin as possible in order to suppress the repetitive scattering and, from examples, the thickness is preferably not more than 0.2 $\mu$m in terms of the efficiency. For specifying the condition by the thickness of the upper electrode, the small gap contributing to the emission of electrons has to be present at the edge of the upper electrode. From the viewpoint of suppressing the repetitive scattering, it corresponds to the distance from the small gap to the upper surface of the upper electrode.

The driving voltage is a low driving voltage, because the gap is small. Since the direction of the voltage to draw the electrons is coincident with the direction toward the anode plate, a spread of the electron beam, though scattered isotropically, is suppressed relatively.

Figure 14:
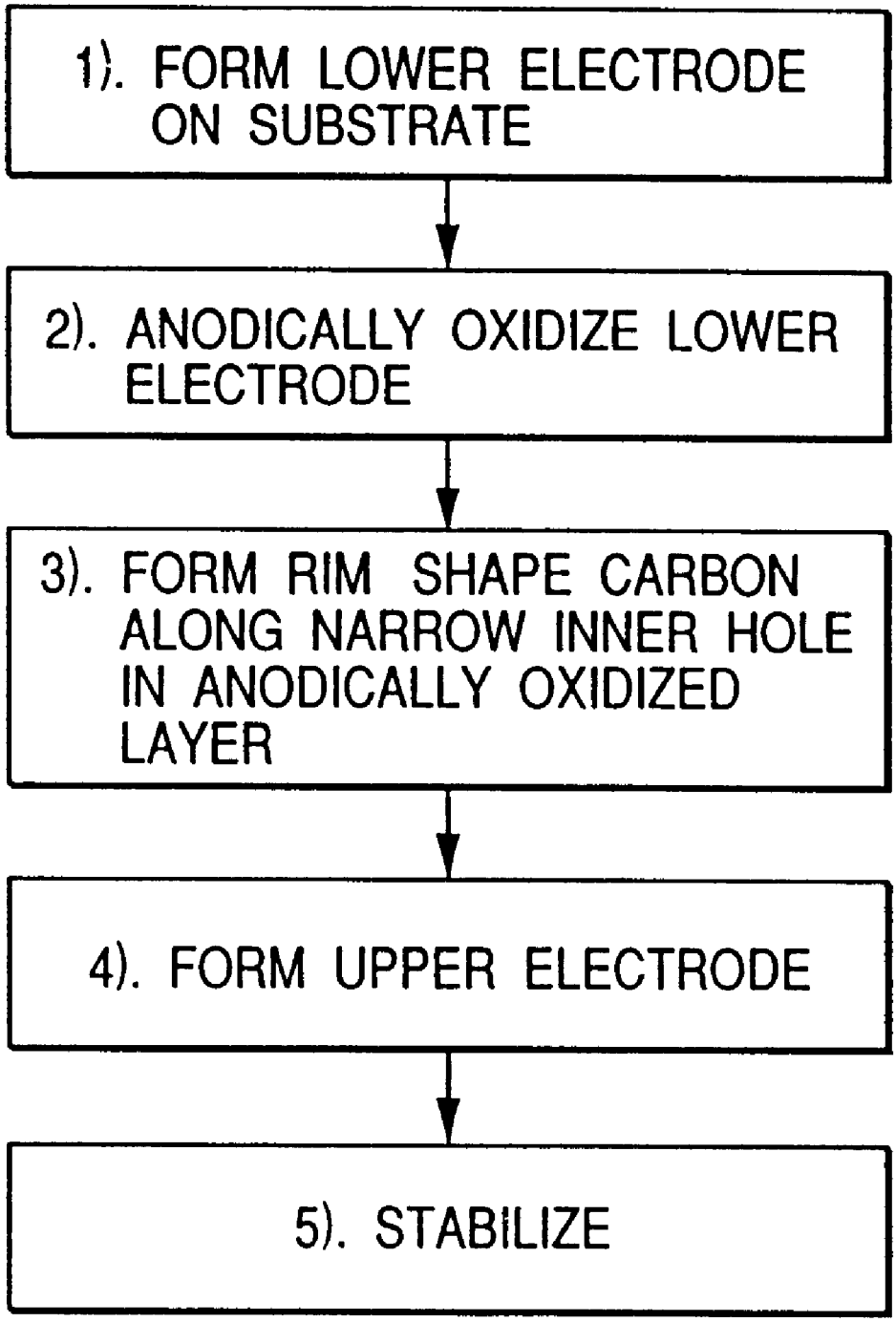
FIG. 14 is a flowchart of a process for producing the electron-emitting device of the second embodiment.

There are a variety of methods for producing the electron-emitting device described above, among which an example will be described referring to the step diagram of FIG. 14.

(Step 1) Step of Forming the Lower Electrode of the Metal or the Semiconductor on the Substrate The substrate 1 is cleaned well with detergent, pure water, and organic solvent or the like, the material for the lower electrode is deposited by vacuum evaporation, sputtering, or the like, and thereafter the lower electrode 2 is formed on the substrate, for example, by the photolithography technology. The lower electrode may also be formed by electrolytic crystallization.

(Step 2) Step of Anodizing the Lower Electrode

Figure 15:
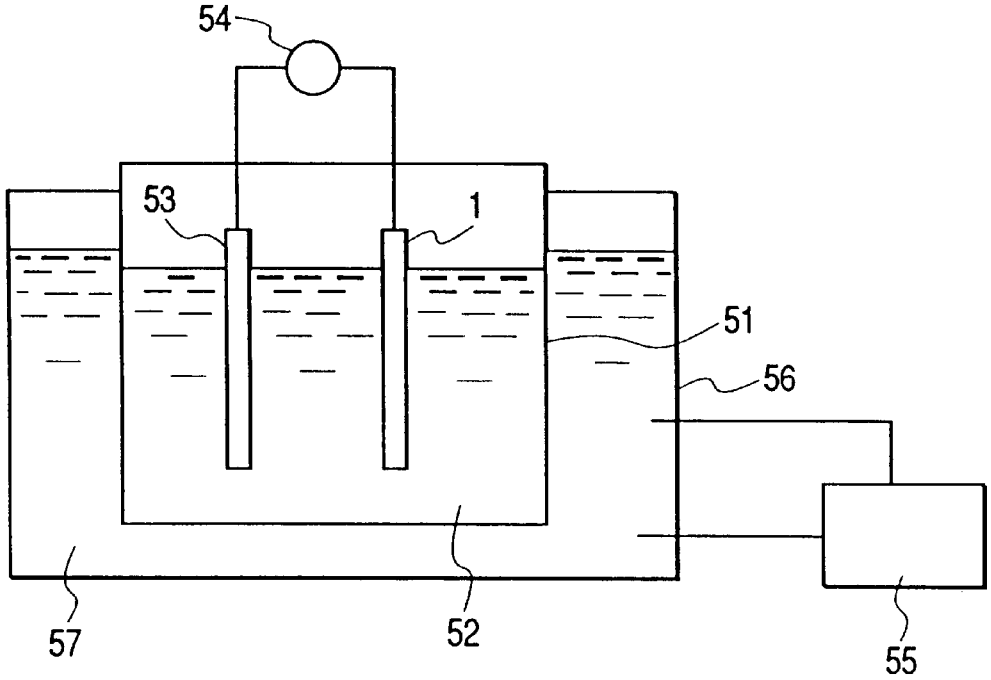
FIG. 15 is a sectional view of another anodic oxidation system used in production of the electron-emitting device.

An anodic oxidation system will be first described herein using the conceptual drawing thereof illustrated in FIG. 15. Numeral 51 denotes an anodic oxidation tank, 52 an anodic oxidation electrolyte solution, 53 an electrode, 54 an anodic oxidation power supply, 55 a temperature controller for controlling the temperature of the anodic oxidation electrolyte solution 52, 56 a vessel for water circulating in the temperature controller, and 57 the circulating water for control of temperature.

The anodic oxidation electrolyte solution 52 for the metal such as Al is an aqueous solution of one selected from inorganic acids such as sulfuric acid, sulfamic acid, and phosphoric acid, and organic acids such as oxalic acid, malonic acid, and succinic acid, and the substance added thereto as solvent is polyhydric alcohol such as ethylene glycol, glycerin, or dextrin. On the other hand, the electrolyte solution for Si is an aqueous solution of HF. Further, an oxidation process such as thermal oxidation may be further added.

The electrode 53 is the metal such as Pt. The anodic oxidation of the lower electrode is effected by energization from the power supply 54 with the electrode 53 as a cathode and the substrate 1 with the lower electrode formed thereon, as an anode. The geometrical structure of the anodic oxide layer can be controlled by production conditions. Specifically, the spacing between the pores can be controlled by the anodic oxidation voltage, the depths of the pores by the anodic oxidation time, and the diameters of the pores by such conditions as the composition of the electrolyte solution, the voltage, the current. Further, control of the regular pores or the irregular pores can also be made by control of these conditions.

Next, the substrate with the anodic oxide layer formed thereon is dipped in the anodic oxidation electrolyte solution or the like to adjust the diameter of the pores and the thickness of the dense oxide film. (This step will be called widening.) Then the substrate is washed well with water and then dried in vacuum.

(Step 3) Step of Forming the Upper Electrode on the Metal or the Semiconductor Thus Anodized The upper electrode is formed in the thickness of not more than 200 nm in the same manner as the lower electrode was.

(Step 4) Step of Forming the Electron-emitting Bodies in the Pores of the Anodic Oxide Layer (Under Existence of Organic Material of Gas State)

This step is a step of forming carbon in the pores of the aforementioned anodic oxide layer by applying the voltage to the upper electrode and lower electrode under existence of the organic material of a gas state. The carbon formed in this step is, for example, graphite (including so-called HOPG, PG, and GC). HOPG indicates the almost perfect graphite crystal structure, PG somewhat disordered crystal structure having crystal grains of 20 nm or so, and GC more disordered crystal structure having the crystal grains of 2 nm or so. In addition, the carbon herein may also be non-crystalline carbon (which means amorphous carbon and, a mixture of amorphous carbon with fine crystals of the aforementioned graphite).

Example 1 of the Second Embodiment

The electron-emitting devices were produced in the same structure as in FIGS. 7A and 7B.

Production steps of the present example will be described specifically referring to FIG. 14.

(Step 1: Step of Forming the Lower Electrodes of Metal on Substrate)

The substrate 1 was prepared by depositing $SiO_2$ in the thickness of 1 $\mu$m on soda lime glass and the substrate 1 was washed well with detergent, pure water, and organic solvent or the like. Then the material of Al for the lower electrodes was deposited in the thickness of 500 nm on the substrate by sputtering and thereafter the lower electrode wires 71 were formed in stripes on the substrate 1 by the photolithography technology. For using parts of the lower lead wires 71 as terminals, they were covered with a known mask resin for plating.

(Step 2: Step of Anodizing the Lower Electrodes)

Using the apparatus of FIG. 15, the anodic oxidation was carried out to anodize parts of the Al lower electrodes prepared in (step 1). The anodic oxidation electrolyte solution 52 was an aqueous solution of oxalic acid 30 g/l. The electrode 53 was the Pt electrode. The anodic oxidation was carried on at 5° C. for five minutes by the constant voltage of 40 V from the power supply 55 with the cathode of the electrode 53 and the anode of the lower wires 71 provided on the substrate 1. On this occasion, the initial current density was 300 mA/cm$^2$, but the current density decreased with progress of the anodic oxidation and thereafter increased once to be saturated. Then the substrate with the anodic oxide layers was immersed in an aqueous solution of phosphoric acid for thirty minutes to remove the dense anodic oxide layer and thereafter washed well with water.

(Step 3: Step of Forming Columnar Metal in the Pores of the Anodic Oxide layers)

Figure 16:
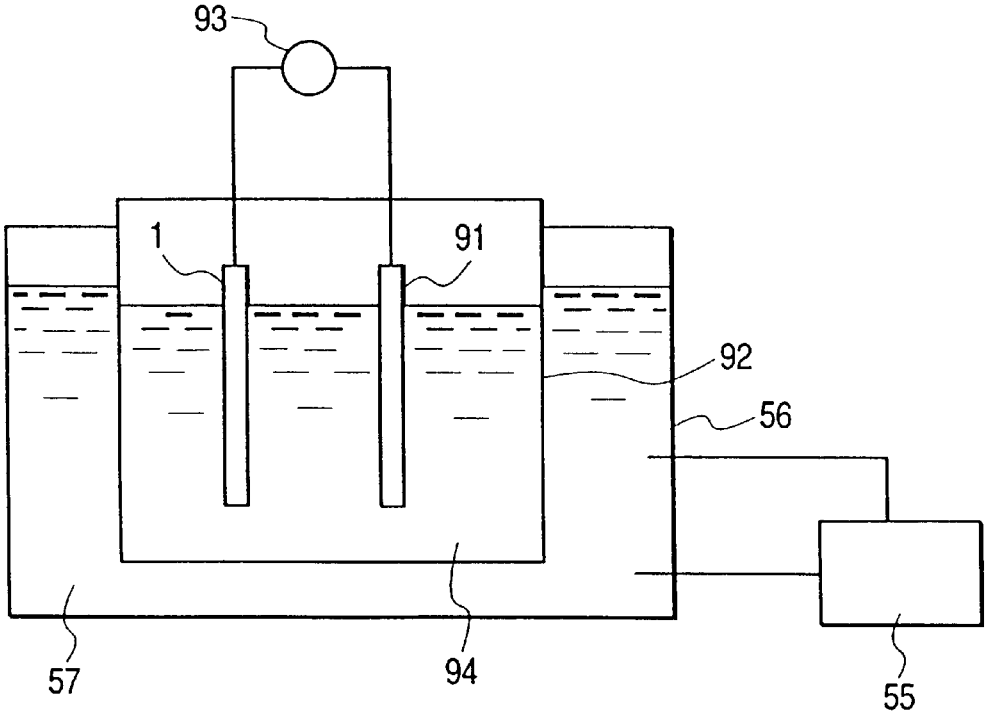
FIG. 16 is a sectional view of a columnar metal forming system used in production of the electron-emitting device.

Formation of the columnar metal in the pores was carried out using the system of FIG. 16.

In FIG. 16, portions with the same reference numerals as those in FIG. 15 indicate like portions. Numeral 91 represents a counter electrode for electrolytic deposition of metal, which is a counter electrode made of an inactive electrode such as carbon or Pt or the same material as the electrodeposited metal. Numeral 92 indicates a container for a metal electrodeposition liquid, 93 a power supply for electrodeposition, and 94 an electrodeposition solution containing the metal.

In this step Ni was electrodeposited by the constant current at the current density of 1 mA/cm$^2$, using the Pt electrode as the counter electrode 91 and 5% $NiSO_4$ and 4% $H_3BO_3$ as the electrodeposition solution 94 containing the metal. An electrodeposition amount of columnar Ni was controlled by time and the columnar Ni was formed in each pore. The electrodeposition time was 100 seconds.

(Step 4: Step of Forming the Upper Electrode on the Metal or the Semiconductor Thus Anodized)

The upper electrode 82 was formed in the thickness of 10 nm in the same manner as the lower electrodes were.

(Step 5: step of Forming Carbon in the Pores of the Anodic Oxide Layers (Under Existence of Organic Material of Gas State))

The substrate 1 was set in the vacuum chamber also serving as a measuring device and the voltage was applied to the upper electrode and lower electrodes under an ambience containing gas of benzonitrile at $10^{-4}$ Pa. In step 5, three devices out of the five devices were processed by applying the rectangular waves of the voltage waveform having the pulse width T1 of 1 ms and the pulse spacing T2 of 10 ms in the pulse. waveform of FIG. 6A with the lower electrode side at the higher potential for twenty minutes. After that, the upper electrode side was kept at the higher potential and the voltage was applied for 20 minutes. Further, the current of the devices was monitored at the same time. The voltage was 17 V. The two remaining devices out of the five devices were processed similarly by applying the voltage of 17 V in the pulse waveform of FIG. 6B for 20 minutes.

(Step 6: Stabilization Step)

Then the benzonitrile gas was exhausted sufficiently and thereafter the system was evacuated for two hours while being heated at 300° C.

Then the substrate was set in the vacuum process system of FIG. 5 and the voltage was applied to the lower electrode and upper electrode of each device, and to the anode electrode to measure the currents (the device current and emission current) and the device voltage characteristics. Further, electron beams were observed by luminescence of the fluorescent member placed at the anode. After the measurements, the sample thus formed was then observed with the electron microscope, TEM, and so on.

The device current and emission current both of each device demonstrated the monotonically increasing characteristics over their threshold. The current was negligible below the threshold (called Vth). Values of emission current of the devices obtained with application of the pulses of FIG. 6A were equivalent to those of the devices obtained with application of the pulses of FIG. 6B and, therefore, their emission efficiencies were also equivalent.

In observation with the electron emission, the regular pores were observed in the anodic oxide layers. The density of the pores was $1\times10^9$ pores/cm$^2$.

Figure 17A:
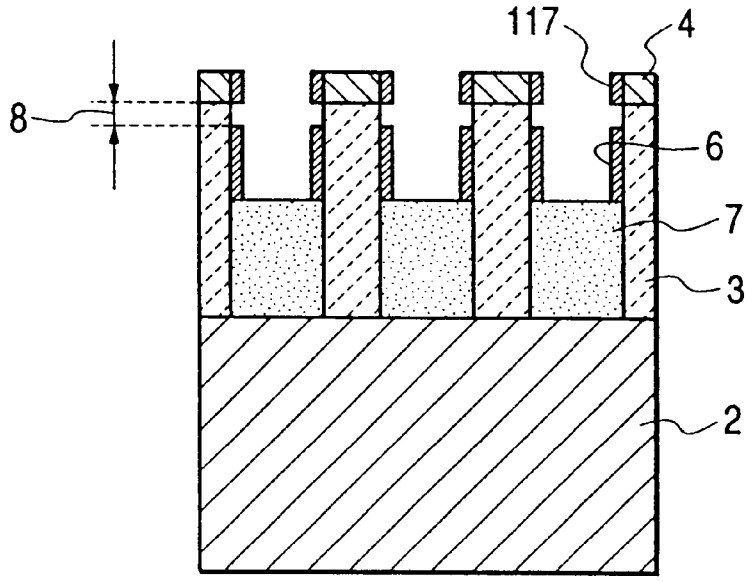
FIG. 17A and FIG. 17B are sectional views for explaining sectional configurations of the electron-emitting device of the second embodiment.
Figure 17B:
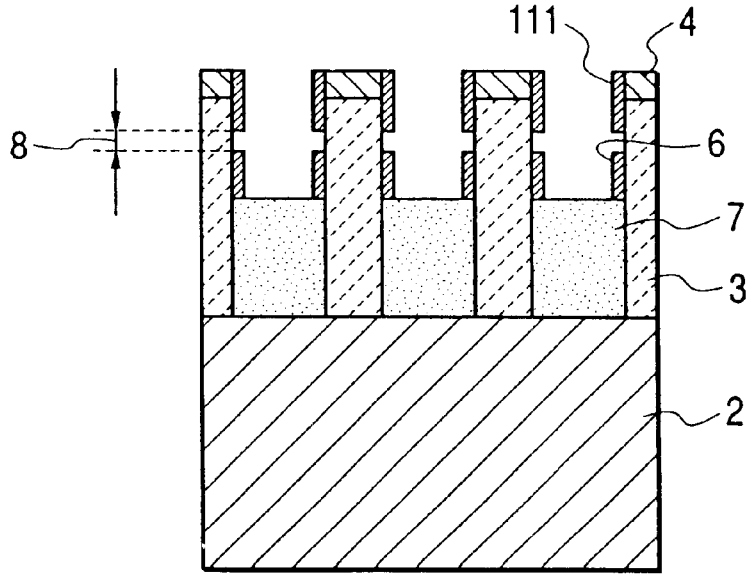

Further, cross-sectional samples were prepared and the inside of the pores was observed. The cross sections of the devices were as illustrated in FIG. 17A and FIG. 17B. In FIGS. 17A and 17B, the same reference symbols as those in FIGS. 12A to 12D denote like portions. FIG. 17A is a cross section of the devices in which carbon was formed by applying the pulses of FIG. 6A in step 5, while FIG. 17B is a cross section of the devices in which carbon was formed by applying the pulses of FIG. 6B in step 5. Numerals 111 and 117 indicates the carbon formed on the upper electrode side.

As illustrated in FIG. 17A, where the carbon was formed with application of the pulses of FIG. 6A, the Ni metal was deposited in the columnar shape 110 nm high in the pores from the lower electrode 2 of Al and rim-shape amorphous carbon was further formed along the inner walls of the pores on the top surface of columnar Ni. Further, amorphous carbon was also formed similarly on the side of the upper electrode 4. A small gap was formed between the carbon on the upper electrode 4 side and the carbon on the lower electrode 2 side and the gap was formed at the edge of the upper electrode. The gap was several nm. The thickness of the anodic oxide film was 150 nm.

Figure 6B:
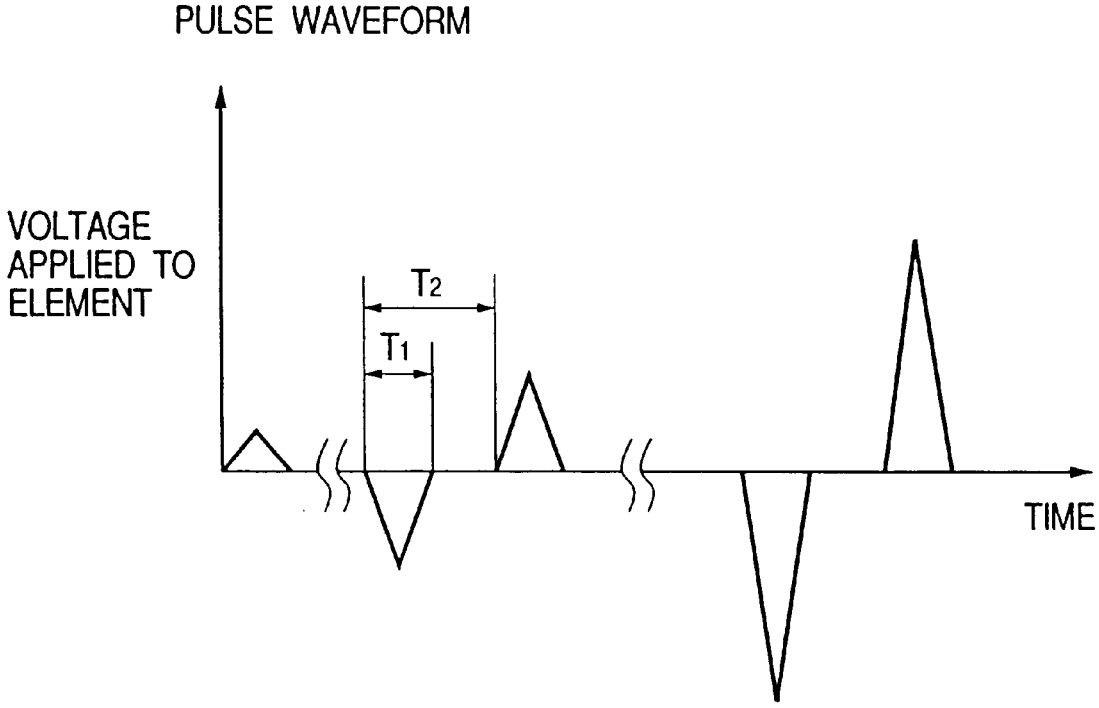

On the other hand, where the carbon was formed with application of the pulses of FIG. 6B, as illustrated in FIG. 17B, the Ni metal was deposited in the columnar shape in the pores on the lower electrode 2 of Al and rim-shape amorphous carbon was further formed along the inner walls of the pores on the top surface of columnar Ni. Further, amorphous carbon was also formed similarly on the side of the upper electrode 4. The carbon was formed to the position 20 nm apart from the bottom surface of the upper electrode and a small gap was formed between the two carbon layers. The gap was several nm.

The above proved the following. First, the rim-shape carbon is formed along the inner walls of the pores, because the deposition rate is controlled under the low partial pressure on the top surface of the columnar metal layer formed in the pores of the anodic oxide layer which is obtained by anodic oxidation of the metal. Second, the small gap of several nm is formed between the carbon films on the upper electrode side and on the lower electrode side. Third, the emission current and electron emission efficiency are equivalent as long as the small gap is located in the range of 20 nm from the bottom surface of the upper electrode. Since the distance from the gap to the top surface of the upper electrode is 30 nm including the thickness of the upper electrode in the both examples, the probability is assumed to be low of loss of the electrons emitted from the lower electrode side, in the pores. Fourth, the stabilization step enables the device current and emission current to demonstrate the monotonically increasing characteristics without occurrence of the voltage-controlled negative resistance characteristics, or the VCNR characteristics.

Example 2 of the Second Embodiment

In the present example the substrate was constructed in the device layout similar to Example 1 of the second embodiment. The upper electrode was formed in a variety of thicknesses and influence thereof was investigated. Step 1 to step 3, and step 6 were carried out in the same manner as in Example 1. The description of step 1 to step 3, and step 6 will be omitted herein and only steps 4 and 5 will be described in detail.

(Step 1: Step of Forming the Lower Electrodes of Metal on the Substrate)

This step was carried out in the same manner as step 1 of Example 1.

(Step 2: Step of Anodizing the Lower Electrodes)

This step was carried out in the same manner as step 2 of Example 1.

(Step 3: Step of Forming Columnar Metal in the Pores of the Anodic Oxide Layers)

This step was carried out in the same manner as step 3 of Example 1.

(Step 4: Step of Forming the Upper Electrode on the Metal or the Semiconductor Thus Anodized)

The upper electrode 72 was formed in either of four thicknesses of 5, 10, 100, and 500 nm on each substrate in the same manner as the lower electrodes, thus forming four substrates.

(Step 5: Step of Forming Carbon in the Pores of the Anodic Oxide Layers (Under Existence of Organic Material of Gas Shape))

Each substrate 1 was set in the vacuum chamber also serving as a measuring device and the voltage was applied to the upper electrode and lower electrode under an ambience containing gas of benzonitrile at $10^{-4}$ Pa. Three devices out of the five devices were processed by applying the rectangular waves of the voltage waveform having the pulse width T1 of 1 ms and the pulse spacing T2 of 10 ms in the pulse waveform of FIG. 6A for fifteen minutes with the lower electrode side at the higher potential. After that, the upper electrode was kept at the higher potential and the voltage was applied for five minutes. At the same time, the current of device was monitored. The voltage was 15 V.

(Step 6: Stabilization Step)

This step was carried out in the same manner as step 2 of Example 1.

Next, each substrate was set in the vacuum process system of FIG. 5 and the voltage was applied to the lower electrode and upper electrode of each device, and to the anode electrode to measure the currents (the device current and emission current) and the device voltage characteristics. Further, the electron beam was observed by luminescence of the fluorescent member placed at the anode.

Figure 18:
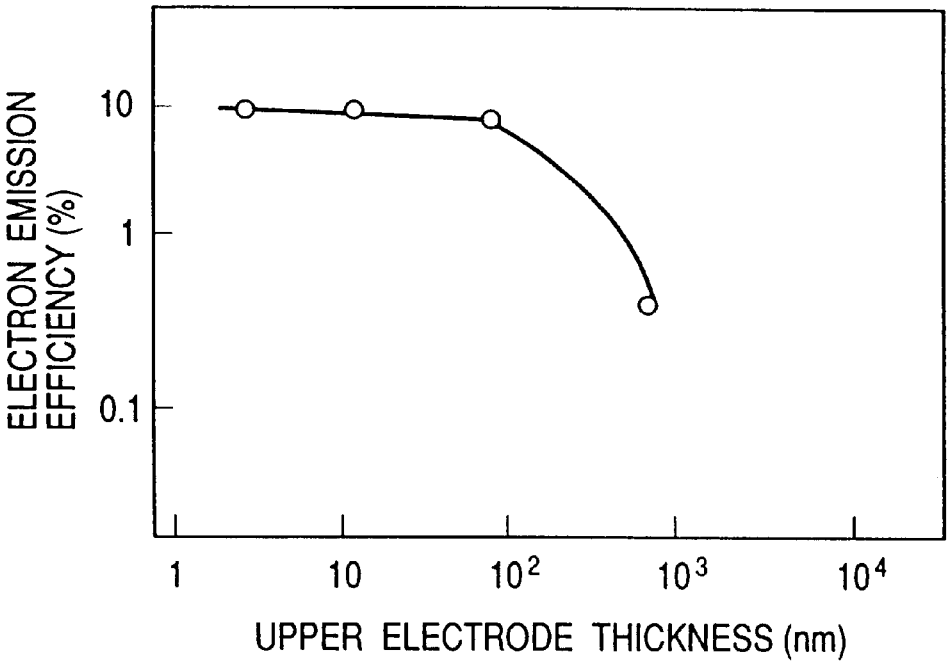
FIG. 18 is a graph to show the relation between electron emission efficiency and thickness of the upper electrode in the electron-emitting device of the second embodiment.

FIG. 18 shows the relation between thickness of the upper electrode and emission efficiency. As shown in FIG. 18, the electron emission efficiency did not decrease below the thickness of about 200 nm and then decreased with increasing thickness of the upper electrode over 200 nm. The electron emission efficiency is defined as a ratio of emission current to device current. Further, the beam size also decreased.

In observation of the form of the upper electrode, particularly, in the case of the upper electrode having the large thickness, where the thickness was greater than the diameter of the pores, the inside of the pores was also covered in part. When the small gap was observed with section TEM, the small gap was formed at the edge of the bottom surface of the upper electrode in either sample, as in Example 1.

The above verified the following. First, the small gap is formed at the edge of the upper electrode, irrespective of the thickness of the upper electrode. Second, the emission current and electron emission efficiency decrease, depending upon the thickness of the upper electrode. This is assumed to be due to the high probability of loss at the upper electrode of the porous shape, of the electrons emitted from the lower electrode side.

Example 3 of the Second Embodiment

In the present example the substrate was constructed in the device layout similar to Example 1 of the second embodiment. In the present example, $SiO_2$ was used as the insulating layer instead of the anodic oxide layer of aluminum in Example 1. Production steps of the present example will be described specifically.

(Step 1: Step of Forming the Lower Electrodes of Metal on the Substrate)

The substrate 1 was prepared by depositing $SiO_2$ in the thickness of 1 $\mu$m on soda lime glass and then the substrate 1 was washed well with detergent, pure water, and organic solvent or the like. The material Pt for the lower electrode was deposited in the thickness of 500 nm on the substrate by sputtering and thereafter the lower electrode wires 71 were formed in stripes on the substrate 1 by the photolithography technology.

(Step 2: Step of Forming the Insulating Layer)

Next, $SiO_2$ was deposited in the thickness of 50 nm by sputtering.

(Step 3: Step of Forming the Upper Electrode on the Insulating Layer)

The upper electrode 72 was made of Pt in the thickness of 10 nm in the same manner as the lower electrodes were.

(Step 4: Step of Forming the Pores in the Insulating Layer)

In the stack structure of lower electrode/$SiO_2$/upper electrode as described above, four types of pores were formed as follows by the focused ion beam method; (the diameter 50 nm and the pitch 100 nm of the pores), (the diameter 200 nm and the pitch 400 nm of the pores), (the diameter 500 nm and the pitch 1000 nm of the pores), and (the diameter 1000 nm and the pitch 2000 nm of the pores). Here, the pitch is a distance between centers of adjacent pores.

(Step 5: Step of Forming Carbon in the Pores of the Insulating Layer (Under Existence of Organic Material of Gas Shape))

The substrate 1 was set in the vacuum chamber also serving as a measuring device and the voltage was applied to the upper electrode and lower electrode under an ambience containing gas of benzonitrile at $10^{-4}$ Pa. The rectangular waves of the voltage waveform having the pulse width T1 of 1 ms and the pulse spacing T2 of 10 ms in the pulse waveform of FIG. 6A were applied for fifteen minutes and then the lower electrode side was kept at the higher potential for five minutes.

(Step 6: Stabilization Step)

Then the benzonitrile gas was exhausted sufficiently and thereafter the system was evacuated for two hours while being heated at 300° C.

Then the substrate was set in the vacuum process system of FIG. 5 and the voltage was applied to the lower electrode and upper electrode of each device, and to the anode electrode to measure the currents (the device current and emission current), and the device voltage characteristics.

Figure 19:
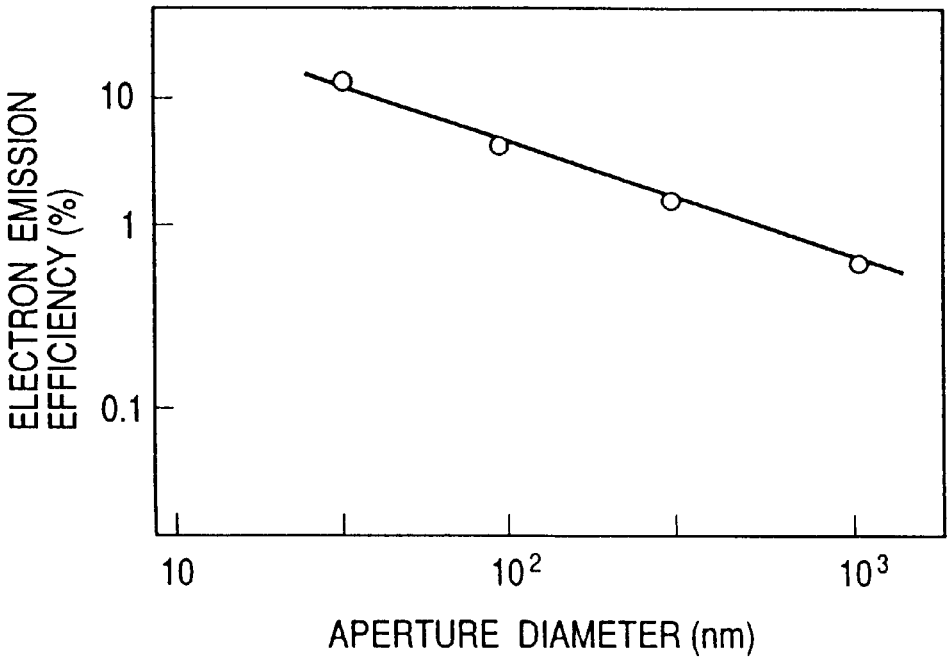
FIG. 19 is a graph to show the relation between electron emission efficiency and diameter of aperture in the electron-emitting device of the second embodiment.

The electron emission efficiency was dependent upon the diameter of the pores as illustrated in FIG. 19, and the electron emission efficiency increased with decreasing diameter of pore.

Example 4 of the Second Embodiment

The present example is an example of application to the image pickup device of FIGS. 9A and 9B described previously, in which a plurality of electron-emitting devices prepared by the same method as in Example 1 of the second embodiment are placed in a two-dimensional array on the substrate.

The production method of the image pickup device of the present example is the same as in the first embodiment. The image pickup device produced in this way was operated based on the principle of operation stated previously, whereupon the signal current was obtained in 1:1 correspondence to the size of the electron-emitting device, thereby verifying the operation.

Example 5 of the Second Embodiment

The present example is an example of construction of the display device of FIGS. 10A and 10B described previously, in which a plurality of electron-emitting devices produced by the same method as in Example 1 of the second embodiment are arrayed in a two-dimensional pattern on the substrate. The production method of the display device of the present example is the same as in the first embodiment. The display device produced in this way was operated based on the principle of operation discussed previously, and a bright image was displayed in high definition.

Third Embodiment

Figure 20A:
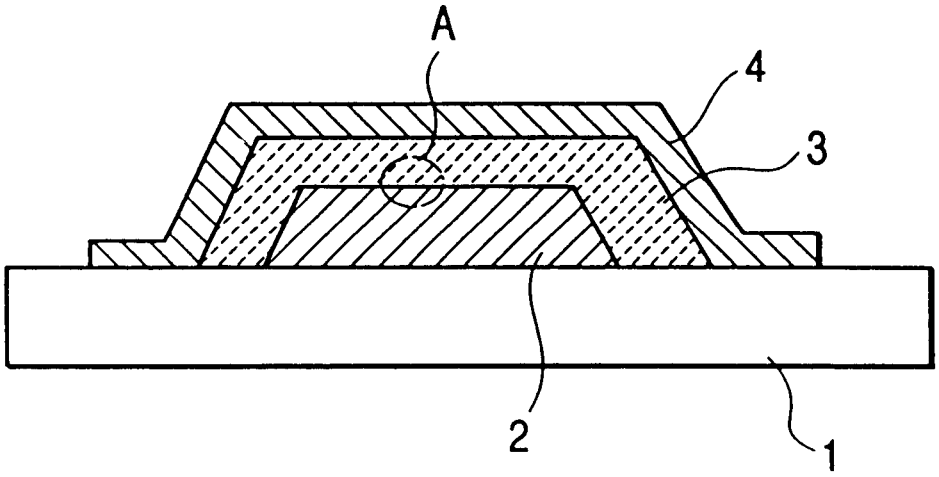
FIG. 20A and FIG. 20B are a sectional view and a perspective view of an electron-emitting device in the third embodiment of the present invention.
Figure 20B:
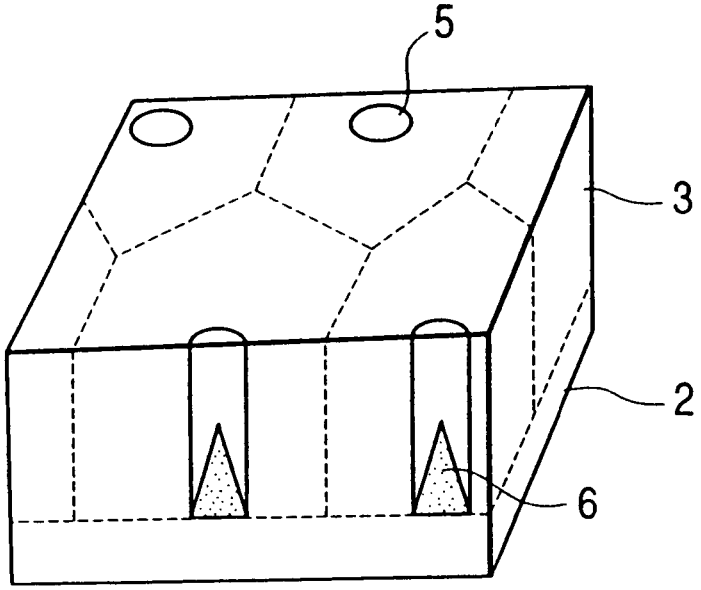

FIG. 20A is a sectional view of the electron-emitting device of the present embodiment. FIG. 20B is a partly enlarged, schematic view of part A in the sectional view of FIG. 20A. The present embodiment is application of the anodic oxide layer to the insulating layer. FIGS. 21A to 21D illustrate respective electron-emitting devices having a variety of electron-emitting bodies. FIGS. 22A and 22B show other structural examples.

In FIGS. 20A and 20B and FIGS. 21A to 21D, numeral 1 denotes a substrate, 2 an upper electrode, 3 an anodic oxide layer, 4 an upper electrode, 5 pores of the porous structure, 6 electron-emitting bodies, and 207 a small gap.

The substrate 1 to be employed herein can be selected from quartz glass, glass with a decreased content of impurity such as Na, soda lime glass, a glass substrate obtained by depositing $SiO_2$ on soda lime glass by sputtering or the like, ceramics such as alumina, an Si substrate, an Si substrate with a deposited layer of $SiO_2$, and so on. Particularly, when the substrate 1 is a semiconductor substrate, a driver or the like for driving the electron-emitting device can also be mounted simultaneously.

The lower electrode 2 is selected from metals, such as Al, Ta, Nb, Ti, Zr, Hf, or Si, and semiconductors that can undergo anodic oxidation. The thickness of the lower electrode 2 is properly determined according to the thickness of the anodic oxide layer, the electrical resistance of the lower electrode, and so on. The materials for the lower electrode are not limited to only the metals that can be anodized, but they may also be of a stack form of a metal that cannot be anodized and a metal that can be anodized.

The anodic oxide layer 3 is formed by anodic oxidation of the lower electrode in part. In the anodic oxide layer 3 there exist regular or irregular pores 5. This will also be called porous structure in the present specification. The regular or irregular pores 5 can be formed by selecting anodic oxidation conditions including a composition of an anodic oxidation bath, the temperature of the bath, the voltage, the time, etc., according to the material for the lower electrode 2. Preferably, the regular pores are selected. Diameters of the pores range from several ten nm to several hundred nm and depths thereof from several ten nm to several thousand nm. The density of the pores is $10^8$ to $10^{12}$ pores/cm$^2$. The shape of the pores is not limited only to the circle, but the ellipse, square, etc. can also be applied to the electron-emitting devices of the present invention. The variety of shapes can also be formed using the focused ion beam or the like. Therefore, the expression "length of pore" will also be used in place of the diameter of pore in the present invention. Each pore 5 has carbon of an electron-emitting body 6 electrically connected to the lower electrode 2.

The electron-emitting bodies can be formed in a variety of forms. The upper electrode 4 is kept at the higher potential than the lower electrode 2 is, so as to create a locally high electric field in the electron-emitting bodies, thereby causing electrons to tunnel from the electron-emitting bodies into the vacuum. The above "vacuum" is equivalent to the vacuum ambience in which the substrate with the electron-emitting device formed is set.

Figure 21A:
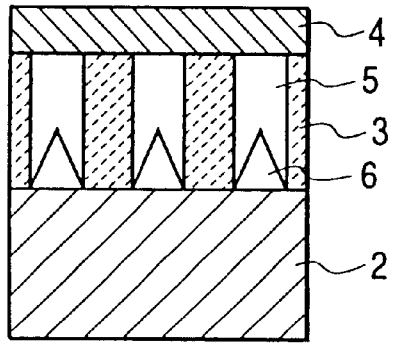
FIG. 21A, FIG. 21B, FIG. 21C, and FIG. 21D are sectional views for explaining structures of the electron-emitting device of the third embodiment.
Figure 22A:
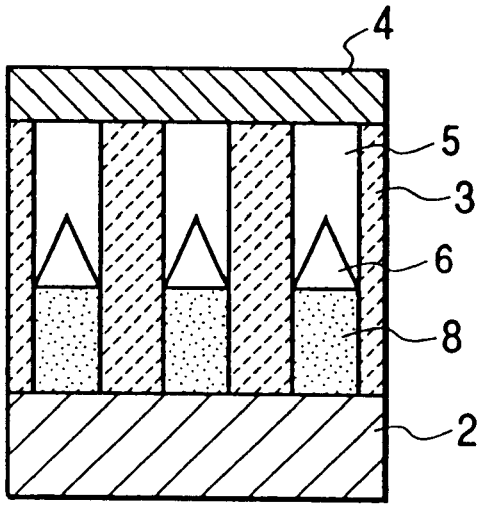
FIG. 22A and FIG. 22B are sectional views for explaining other structures of the electron-emitting device of the third embodiment.
Figure 22B:
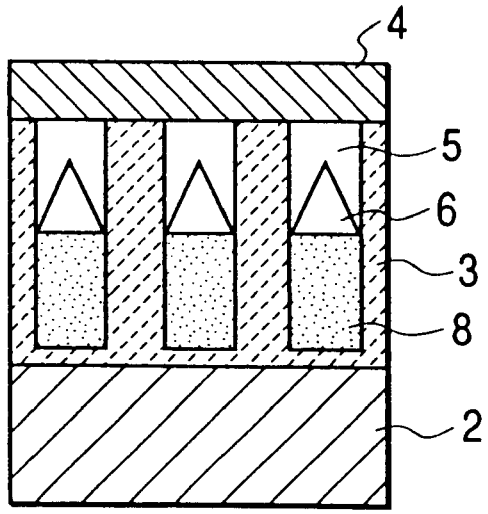

FIG. 21A is an example in which needlelike electrodes are provided in the pores. The needlelike electrodes are equivalent to those called the Spindt type stated previously.

Figure 21B:
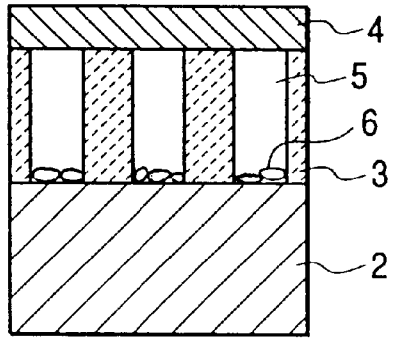

FIG. 21B is an example in which small particles are provided in the pores. Grains of the small particles correspond to the tips of the needlelike electrodes of FIG. 21A.

Since in the electron-emitting bodies of FIGS. 21A and 21B the local electric field is strong and the thickness of the vacuum part is large, the capacitance can be relatively lower than in the structures of FIGS. 21C and 21D described below.

Figure 21C:
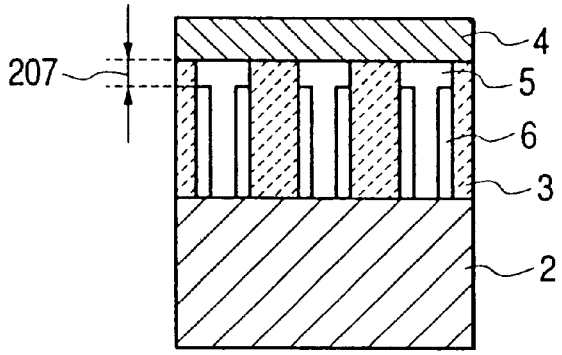

FIG. 21C is an example in which a high electric field is created in a small gap 207 between a rim-shape conductive body formed along the inner wall of each pore and the upper electrode to emit electrons. Since the electron-emitting bodies are formed in the rim shape or the linear shape along the inner walls of the pores, the area capable of emitting electrons can be increased considerably, as compared with the structure of FIG. 21A, so that large electron emission current can be obtained.

Figure 21D:
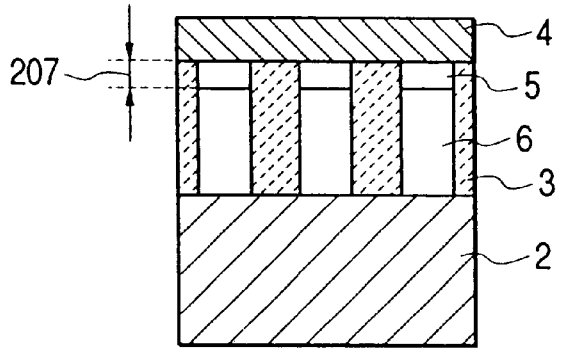

FIG. 21D is an example in which the electron-emitting bodies 6 are conductive bodies of the columnar shape formed in the pores and in which a high electric field is created in a small gap 207 between the columnar conductive bodies 6 and the upper electrode to emit electrons. Since the electron-emitting bodies are of the rim shape or the linear shape along the inner walls of the pores, the area capable of emitting electrons can be increased considerably, as compared with the structure of FIG. 21A, so that large electron emission current can be obtained.

The upper electrode is formed on the anodic oxide layer, and the electron-transmitting portions above the pores are preferably made of a conductive material with excellent electron transmission characteristics and heat resistance and particularly preferably made of carbon or the like. Here, the "carbon" means a carbon material having at least one of graphite, amorphous carbon, and diamondlike carbon.

In order that the upper electrode can cover the apertures of the pores, the thickness of the upper electrode is set to be not less than 0.5×L where L is the length of the pores.

Letting λ stand for the mean free path of transmission of electrons, the thickness of the upper electrode is not more than 2λ for efficient transmission. In general, electron transmittance T is expressed by the following.

$$T = A\exp(-t/\lambda)$$

In the above equation, A represents a constant and t the thickness of the upper electrode. From the above equation, the transmittance of not less than 10% of injected electrons can be expected if the thickness of the upper electrode is not more than 2λ. In the above equation, the mean free path λ can be calculated from dependence of emission current on the thickness of the upper electrode.

For example, in the case of the carbon, which is the particularly preferred material in the present invention, the above requirements simultaneously determine preferred ranges for the thickness of the upper electrode and for the length of the pores; for example, when the thickness of the upper electrode is 50 nm, the length of the pores is not more than 100 nm.

The thickness of the upper electrode on the insulating layer may be different from the thickness of the upper electrode portions that transmit electrons above the pores and they are properly determined from the needs in the production process and the like.

The other structural examples of the electron-emitting device of the present invention will be described using the schematic sectional views of FIGS. 22A and 22B. As the structure of the electron-emitting bodies 6, the example of FIG. 21A will be used, but, without having to be limited to this structure, either one of the structures of the electron-emitting bodies of FIGS. 21B, 21C, 21D, etc. can also be employed.

FIG. 22A is an example in which the conductive bodies 8 of the columnar shape and the electron-emitting bodies 6 are provided in the pores. In this case, existence of the conductive bodies 8 decreases the resistance of the region from the lower electrode to the electron-emitting bodies, so that the insulating layer can be formed in a sufficiently large thickness. This can decrease the capacitance between the lower electrode and the upper electrode, which is advantageous in driving.

FIG. 22B is an example in which an insulating layer of a thickness permitting tunneling is provided between the lower electrode 2 and the electron-emitting bodies 6 in the pores, thereby forming a nonlinear device of metal/insulating layer/carbon. This structure imparts the function of current limitation. This structure can prevent current fluctuation due to discharge or the like and in turn prevent damage to the electron-emitting device during driving of the electron-emitting device of the present invention. A specific production method for producing the insulating metal oxide layer in the thickness permitting tunneling will be described hereinafter.

Figure 23:
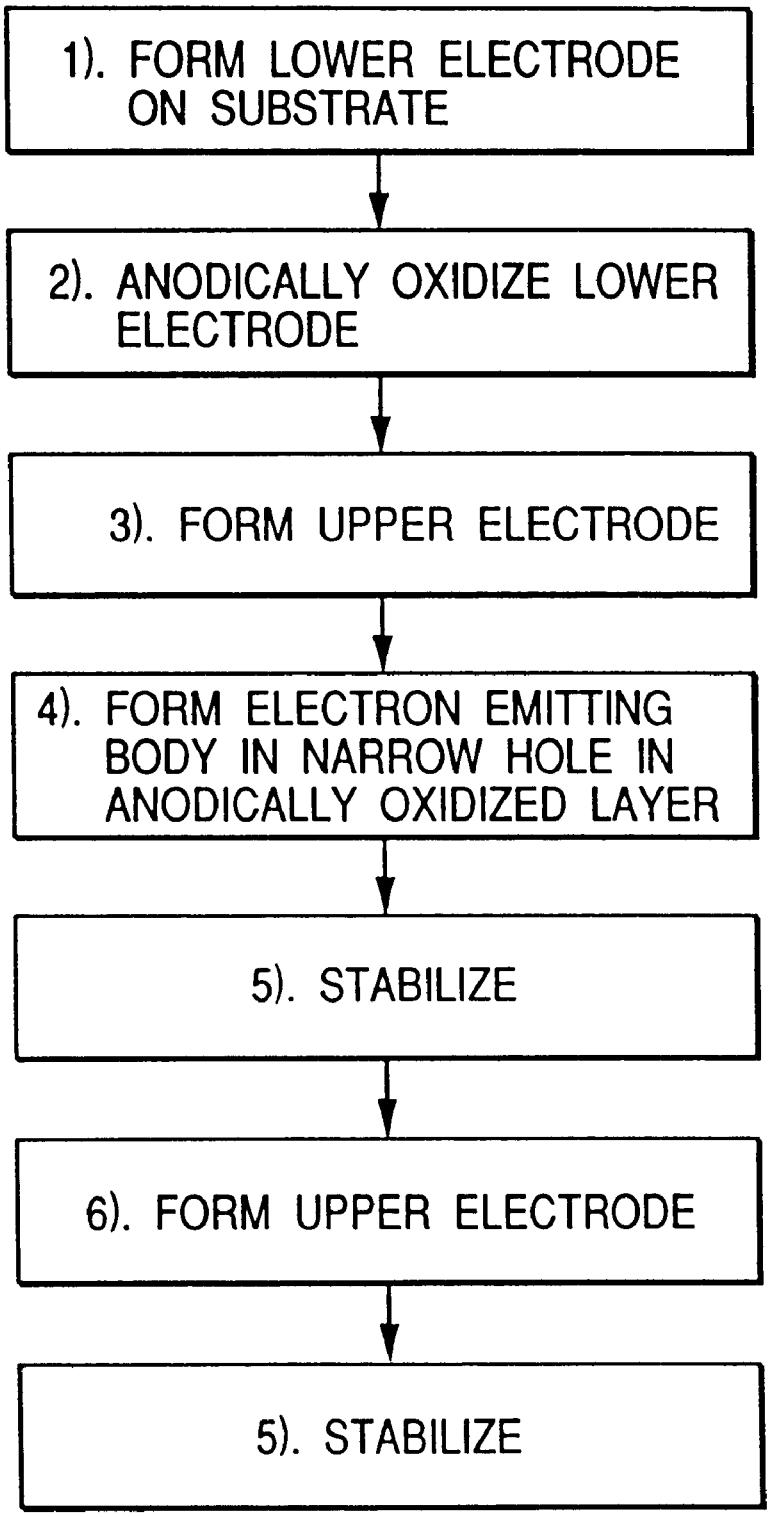
FIG. 23 is a flowchart of a process for producing the electron-emitting device of the third embodiment.

There are a variety of methods for producing the above electron-emitting device, among which an example is schematically illustrated in the production step diagram of FIG. 23. An example of the production method of the electron-emitting device of FIG. 21D will be described referring to FIG. 23.

(Step 1) Step of Forming the Lower Electrode of the Metal or the Semiconductor on the substrate The substrate 1 is cleaned well with detergent, pure water, and organic solvent or the like, the material for the lower electrode is deposited by vacuum evaporation, sputtering, or the like, and thereafter the lower electrode 2 is formed on the substrate, for example, by the photolithography technology. The lower electrode may also be formed by electrolytic crystallization.

(Step 2) Step of Anodizing the Lower Electrode

The anodic oxidation system will be first described herein using the conceptual drawing thereof illustrated in FIG. 15. Numeral 51 denotes an anodic oxidation tank, 52 an anodic oxidation electrolyte solution, 53 an electrode, 54 an anodic oxidation power supply, 55 a temperature controller for controlling the temperature of the anodic oxidation electrolyte solution 52, 56 a vessel for water circulating in the temperature controller, and 57 the circulating water for control of temperature.

The anodic oxidation electrolyte solution 52 for the metal such as Al is an aqueous solution of one selected from inorganic acids such as sulfuric acid, sulfamic acid, and phosphoric acid, and organic acids such as oxalic acid, malonic acid, and succinic acid, and the substance added thereto as solvent is polyhydric alcohol such as ethylene glycol, glycerin, or dextrin. On the other hand, the electrolyte solution for Si is an aqueous solution of HF. Further, an oxidation process such as thermal oxidation may be further added.

The electrode 53 is the metal such as Pt. The anodic oxidation of the lower electrode is effected by energization from the power supply 54 with the electrode 53 as a cathode and the substrate 1 as an anode. The geometrical structure of the anodic oxide layer can be controlled by production conditions. Specifically, the spacing between the pores can be controlled by the anodic oxidation voltage, the depths of the pores by the anodic oxidation time, and the diameters of the pores by such conditions as the composition of the electrolyte solution, the voltage, the current. Further, control of the regular pores or the irregular pores can also be made by control of these conditions.

Next, the substrate with the anodic oxide layer formed thereon is dipped in the anodic oxidation electrolyte solution or the like to adjust the diameter of the pores and the thickness of the dense oxide film. (This step will be called widening.) Then the substrate is washed well with water and then dried in vacuum.

(Step 3) Step of Forming the Upper Electrode on the Metal or the Semiconductor Thus Anodized The upper electrode is formed in the thickness of several nm to several ten nm in the same manner as the lower electrode was.

(Step 4) Step of Forming the Electron-emitting Bodies in the Pores of the Anodic Oxide Layer (Under Existence of Organic Material of Gas State)

This step is a step of forming carbon in the pores of the aforementioned anodic oxide layer by applying the voltage to the upper electrode and lower electrode under existence of the organic material of a gas state. The carbon formed in this step is, for example, graphite (including so-called HOPG, PG, and GC). HOPG indicates the almost perfect graphite crystal structure, PG somewhat disordered crystal structure having crystal grains of 20 nm or so, and GC more disordered crystal structure having the crystal grains of 2 nm or so. In addition, the carbon may also be non-crystalline carbon (which means amorphous carbon and, a mixture of amorphous-carbon with fine crystals of the aforementioned graphite). Accordingly, the carbon is one similar to the upper electrode as described above.

The preferred gas pressure of the organic substance for formation of the carbon differs depending upon the aforementioned application form, the shape of the vacuum vessel, the type of the organic substance, and so on and is thus properly, determined according to the circumstances. An appropriate organic substance can be selected from aliphatic hydrocarbons of alkane, alkene, and alkyne, aromatic hydrocarbons, alcohols, aldehydes, ketones, amines, organic acids such as phenol, carboxylic acid, and sulfonic acid, and so on. Specific examples of such substances include saturated hydrocarbons represented by $C_nH_{2n+2}$ such as methane, ethane, and propane, unsaturated hydrocarbons represented by the composition formula of $C_nH_{2n}$ or the like such as ethylene and propylene, benzene, toluene, methanol, ethanol, formaldehyde, acetaldehyde, acetone, methyl ethyl ketone, methylamine, ethylamine, phenol, formic acid, acetic acid, propionic acid, and so on.

The organic gas is also selected according to the diameter of the pores formed in the anodic oxide layer. This is because adsorption of the organic gas is also dependent on the diameter of the pores.

During this process carbon is deposited from the organic substance present in the ambience into the pores in the anodic oxide layer, whereby the device current If and emission current Ie change remarkably.

Completion of this step is determined while measuring either one of the device current If and the emission current Ie or the both.

The apertures of the upper electrode 4 above the pores can also be formed in the initial stage of application of the above voltage pulses in this step.

(Step 5) Stabilization Step

This step is a step for stabilizing the characteristics of the electron-emitting device thus produced. This step is necessary, particularly, where the formation of the electron-emitting bodies is carried out according to step 4) described above. This step is a step of removing intermediate products of the organic material and also removing the organic gas, water, oxygen, etc. adsorbing to the substrate etc. from the carbon in the pores of the anodic oxide layer in the above step, whereby the step can impart to the device such a property that the device current and the emission current monotonically increase above a certain threshold against the voltage applied to the device. This step is a step of exhausting the organic substance in the vacuum vessel and the evacuation apparatus for evacuating the vacuum vessel is preferably one not using oil in order to avoid influence of the oil from the apparatus on the characteristics of the device. Specifically, the evacuation apparatus can be selected from a sorption pump, an ion pump, and so on.

The partial pressure of the organic component in the evacuation apparatus is set to a partial pressure under which there is little carbon or carbon compound newly deposited, and is preferably not more than $1\times10^{-8}$ Torr and particularly preferably not more than $1\times10^{-10}$ Torr. It is further preferred that the whole of the vacuum apparatus be heated during evacuation of the inside of the vacuum apparatus so as to facilitate removal of molecules of the organic substance adsorbing to the inner wall of the vacuum apparatus and to the electron-emitting device. The heating condition at this time is desirably the temperature of 150 to 300° C. and the heating time of not less than several hours, but the heating condition is not limited particularly to this condition.

The ambience during driving after completion of the stabilization step is preferably maintained in the ambience at the end of the above stabilization operation, but it is not limited to this. Sufficient characteristics can be maintained by an ambience from which the organic substance is removed adequately but the vacuum degree of which is a little degraded.

By employing such a vacuum ambience, deposition of new carbon substance can be suppressed, whereby the device current If and emission current Ie are stabilized as a result.

(Step 6) Step of Forming the Upper Electrode 4

Using a target of graphite, amorphous carbon, or the like, graphite, amorphous carbon, or the like is deposited on the pores and on the upper electrode 4 by sputtering or the like.

Further, the stabilization step of step 5 is carried out, whereby the purpose of the above step 5 is further accomplished.

Example 1 of the Third embodiment

The electron-emitting devices were produced in the same structure as in FIGS. 7A and 7B. Production steps of the present example will be described specifically.

(Step 1: Step of Forming the Lower Electrodes of Metal on Substrate)

The substrate 1 was prepared by depositing $SiO_2$ in the thickness of 1 $\mu$m on soda lime glass and the substrate 1 was washed well with detergent, pure water, and organic solvent or the like. Then the material of Al for the lower electrodes was deposited in the thickness of 500 nm on the substrate by sputtering and thereafter the lower electrode wires 81 were formed in stripes on the substrate 1 by the photolithography technology. For using parts of the lower electrode wires 81 as terminals, they were covered with a known mask resin for plating.

(Step 2: Step of Anodizing the Lower Electrodes)

Using the apparatus of FIG. 15, the anodic oxidation was carried out to anodize parts of the Al lower electrodes prepared in (step 1).

The anodic oxidation electrolyte solution 52 was an aqueous solution of oxalic acid 30 g/l. The electrode 53 was a Pt electrode. The anodic oxidation was carried on at 5° C. for five minutes by the constant voltage of 40 V from the power supply 55 with the cathode of the electrode 53 and the anode of the lower wires 81 provided on the substrate 1. On this occasion, the initial current density was 300 mA/cm$^2$, but the current density decreased with progress of the anodic oxidation and thereafter increased once to be saturated. Then the substrate with the anodic oxide layers was immersed in an aqueous solution of phosphoric acid for thirty minutes to remove the dense anodic oxide layer and thereafter washed well with water.

(Step 3: Step of Forming Columnar Metal in the Pores of the Anodic Oxide Layers)

Formation of the columnar metal in the pores was carried out using the apparatus of FIG. 16. In FIG. 16, portions with the same reference numerals as those in FIG. 15 indicate like portions. Numeral 91 represents a counter electrode for electrolytic deposition of metal, which is a counter electrode made of an inactive electrode such as carbon or Pt, or the same material as the electrodeposited metal. Numeral 92 indicates a container for a metal electrodeposition liquid, 93 a power supply for electrodeposition, and 94 an electrodeposition solution containing the metal.

In this step Ni was electrodeposited by the constant current at the current density of 1 mA/cm$^2$, using the Pt electrode as the counter electrode 91 and 5% $NiSO_4$ and 4% $H_3BO_3$ as the electrodeposition solution 94 containing the metal. An electrodeposition amount of columnar Ni was controlled by time and the columnar Ni was formed in each pore. The electrodeposition time was 100 seconds.

(Step 4: Step of Forming the Upper Electrode on the Metal or the Semiconductor Thus Anodized)

The upper electrode 82 was made of Pt in the thickness of 10 nm in the same manner as the lower electrodes were.

(Step 5: Step of Forming Carbon in the Pores of the Anodic Oxide Layers (Under Existence of Organic Material of Gas State))

The substrate 1 was set in the vacuum chamber also serving as a measuring device and the voltage was applied to the upper electrode and lower electrodes under an ambience containing; gas of acetone at $10^{-1}$ Pa. In step 5, the rectangular waves of the voltage waveform having the pulse width T1 of 1 ms and the pulse spacing T2 of 10 ms in the pulse waveform of FIG. 6A were applied for twenty minutes with the lower electrode side at the higher potential. After that, the upper electrode side was kept at the higher potential and the voltage was applied for 20 minutes. Thereafter, the system was evacuated and the substrate was taken out.

(Step 6: Stabilization Step)

Then the substrate was set in the vacuum chamber of the sputtering apparatus and the chamber was evacuated well. Thereafter, the chamber was evacuated for two hours while being heated at 300° C.

(Step 7: Step of Forming the Upper Electrode)

Next, with a target of graphite, carbon was deposited in the thickness of 45 nm by sputtering, thereby forming the upper electrode.

Then the substrate was set in the vacuum process system of FIG. 5 and the voltage was applied to the lower electrode and upper electrode of each device, and to the anode electrode to measure the currents (the device current and emission current), and the device voltage characteristics. The electron beam was observed by luminescence of the fluorescent member set at the anode. After the measurements, the sample thus formed was then observed with the electron microscope, TEM, and so on.

Comparative Example

An MIM type electron-emitting device was produced as a comparative example.

The following steps were carried out; (step 1: step of forming the lower electrode of metal on the substrate), (step 2: step of anodizing the lower electrode), and (step 4: step of forming the upper electrode on the metal or the semiconductor thus anodized). Steps 1 and 4 are the same as in the example, but the anodic oxidation conditions of step 2 were changed. The anodic oxidation conditions were as follows; the anodic oxidation solution was an ammonium tartrate solution, constant current anodic oxidation was carried out at 500 $\mu$A/cm$^2$, and the thickness of the insulating layer was 6 nm.

Each device demonstrated the monotonically increasing characteristics for both the device current and the emission current over their threshold. The current was negligible below the threshold (Vth). When the electron beam was observed by luminescence of the fluorescent member, it was equivalent to that of the MIM electron-emitting device of the comparative example. The electron emission efficiency of the comparative example was 0.1%, whereas that of the example was 5% on average. At the same time, the electron emission current increased corresponding to the efficiency.

In observation of cross section with the electron microscope, the regular pores were observed in the anodic oxide layers. The diameter of the pores was 80 nm. The polelike Ni metal and carbon were stacked in the pores and there was the small gap of 5 to 10 nm with respect to the upper electrode.

The above verified that the spread of electron beam was equivalent to that of the MIM electron-emitting device and that the electron-emitting devices demonstrated high electron emission efficiency and emission current. Thanks to the stabilization step, both the device current and emission current showed the monotonically increasing characteristics having the threshold Vth without occurrence of the voltage-controlled negative resistance characteristics, or the VCNR characteristics.

Example 2 of the Third Embodiment

In the present example the substrate was constructed in the device layout similar to Example 1 of the third embodiment. In the present example, the anodic oxidation conditions of aluminum and the diameter of the pores in Example 1 were changed and influence thereof was investigated.

(Step 1: Step of Forming the Lower Electrodes of Metal on the Substrate)

This step was carried out in the same manner as step 1 of Example 1.

(Step 2: Step of Anodizing the Lower Electrodes)

This step was carried but in the same manner as step 2 of Example 1.

Next, the diameters of the pores were changed by changing the time for which the substrate with the anodic oxide layers formed therein was immersed in the aqueous solution of phosphoric acid. The diameters of the pores were 20, 30, 40, 50, and 80 nm.

(Step 3: Step of Forming Columnar Metal in the Pores of the Anodic Oxide Layers)

The formation of columnar metal in the pores was carried out using the apparatus of FIG. 16. In this step, Ni was electrodeposited using the Pt electrode as the counter electrode 91, 5% $NiSO_4$ and 4% $H_3BO_3$ as the electrodeposition solution 94 containing the metal, and the alternating current of 60 Hz at the current density of 1 mA/cm$^2$. An electrodeposition amount of columnar Ni was controlled by time and columnar Ni was formed in each:pore. Ni also migrated into the dense oxide layer at the bottom of the pores of the anodic oxide layers, so that the columnar Ni was electrically connected to the lower electrode.

(Step 4: Step of Forming the Upper Electrode on the Metal or the Semiconductor Thus Anodized)

This step was not carried out.

(Step 5: Step of Forming the Electron-emitting Bodies in the Pores of the Anodic Oxide Layers)

A layer of W was deposited in the thickness of 7 nm by sputtering and thereafter reduced and aggregated in hydrogen gas, thereby forming small particles thereof. The grain size of the small particles was 10 nm.

(Step 6: Stabilization Step)

Next, the substrate was set in the vacuum chamber of the sputtering apparatus and the chamber was evacuated well.

(Step 7: Step of Forming the Upper Electrode)

Next, with a target of graphite, carbon was deposited in the thickness of 20 nm by sputtering, thereby forming the upper electrode.

According to observation with the electron microscope, the carbon was also able to cover the regions above the pores as long as the diameter of the pores was below 40 nm; the carbon above the pores failed to cover parts or the whole of the regions above the pores if the diameter of the pores was not less than 50 nm. This proved that the thickness t of the upper electrode needs to satisfy the following condition against the length L of the pores:

$$0.5 \times L \leqq t.$$

In the same manner as the example, it was verified that the devices having the pore diameters not more than 40 nm were able to emit electrons in the beam spread equivalent to that of the comparative example.

Example 3 of the Third Embodiment

In the present example the substrate was constructed in the device layout similar to Example 1 of the third embodiment. In the device structure of FIG. 21B, samples were formed with a variety of thicknesses of the upper electrode and influence thereof was investigated. The same steps as in Example 1 were carried out except for steps 5 and 7.

(Step 1: Step of Forming the Lower Electrodes of Metal on the Substrate)

This step was carried out in the same manner as step 1 of Example 1.

(Step 2: Step of Anodizing the Lower Electrodes)

This step was carried out in the same manner as step 2 of Example 1.

(Step 3: Step of Forming Columnar Metal in the Pores of the Anodic Oxide Layers)

This step was carried out in the same manner as step 3 of Example 1.

(Step 4: Step of Forming the Upper Electrode on the Metal or the Semiconductor Thus Anodized)

This step was carried out in the same manner as step 4 of Example 1.

(Step 5: Step of Forming the Electron-emitting Bodies in the Pores of the Anodic Oxide Layers)

W was deposited in the thickness of 7 nm by sputtering and thereafter reduced and aggregated in hydrogen gas, thereby forming small particles thereof.

(Step 6: Stabilization Step)

Then the substrate was;set in the vacuum chamber of the sputtering apparatus and the chamber was evacuated well. After that, the chamber was evacuated for two hours while being heated at 300° C.

(Step 7: Step of Forming the Upper Electrode)

Next, with a target of graphite, the carbon was deposited in either thickness of 10, 35, 50, 65, 80, and 200 nm by sputtering, thereby forming the upper electrode.

Then the substrate was set in the vacuum process system of FIG. 5 and the voltage was applied to the lower electrode and upper electrode of each device, and to the anode electrode to measure the currents (the device current and emission current), and the device voltage characteristics. Further, the electron beam was observed by luminescence of the fluorescent member placed at the anode.

The electron beam was more spread in the device of the thickness of 10 nm than in the comparative example. The devices having the thicknesses of 35, 50, 65, and 80 nm were equivalent to the comparative example. With the device having the thickness of 200 nm, the emission current was too small to measure.

Figure 24:
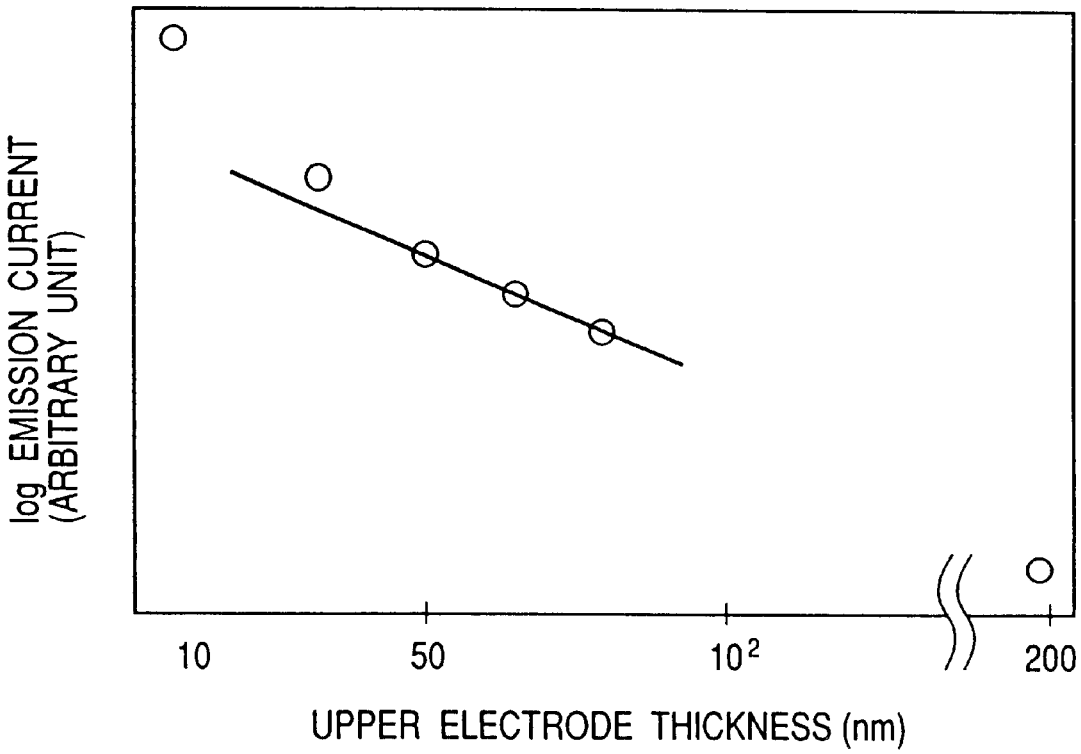
FIG. 24 is a graph to show the relation between electron emission current and thickness of the upper electrode in the third embodiment.

As illustrated in FIG. 24, the electron emission current was very high: at the upper electrode thickness of 10 nm and showed exponential dependence in the range of 35, 50, 65, and 80 nm. The current at the thickness of 200 nm was of the noise level. The mean free path of carbon was calculated based on this result.

According to observation of the forms of the upper electrodes, the upper electrode failed to cover the regions above the pores in the samples of the thicknesses of 10 and 35 nm and holes were observed in the upper electrode. There were no holes observed in the regions above the pores in the samples having the thicknesses of 50, 65, and 80 nm.

The above results verified the following. There is an optimum value of the thickness of the upper electrode against the diameter of the pores. If the upper electrode is too thin, the upper electrode will fail to cover the pores and the electron beam will spread. Within the optimum range, the spread of beam is decreased and the emission current decreases depending upon the thickness. Further, sufficient emission current can be obtained if the upper electrode has the thickness not more than $2\lambda$ as described previously.

Example 4 of the Third Embodiment

The present example is an example of application to the image pickup device of FIGS. 9A and 9B described previously, in which a plurality of electron-emitting devices prepared by the same method as in Example 1 of the third embodiment are placed in a two-dimensional array on the substrate.

The production method of the image pickup device of the present example is the same as in the first embodiment. The image pickup device produced in this way was operated based on the principle of operation stated previously, whereupon the signal current was obtained in 1:1 correspondence to the size of the electron-emitting device, thereby verifying the operation.

Example 5 of the Third Embodiment

The present example is an example of construction of the display device of FIGS. 10A and 10B described previously, in which a plurality of electron-emitting devices produced by the same method as in Example 1 of the third embodiment are arrayed in a two-dimensional pattern on the substrate. The production method of the display device of the present example is the same as in the first embodiment. The display device produced in this way was operated based on the principle of operation discussed previously, and a bright image was displayed in high definition.

Fourth Embodiment

Figure 25A:
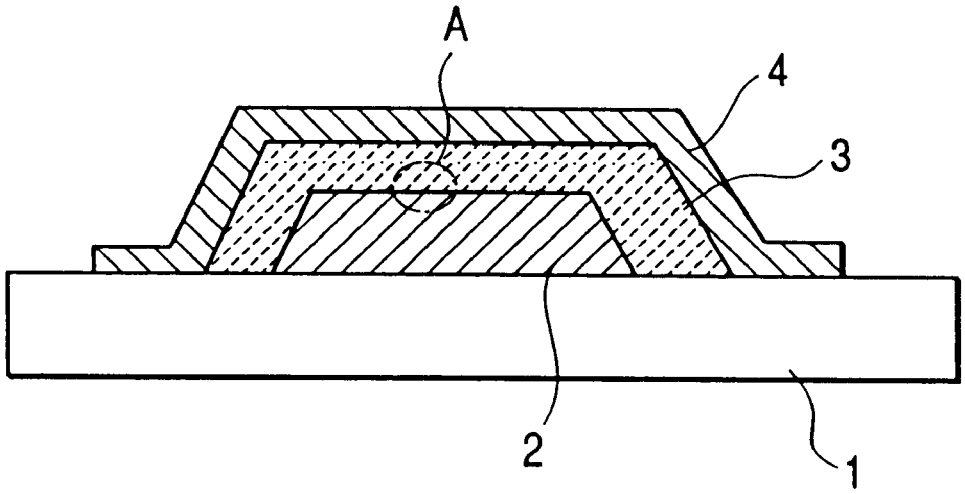
FIG. 25A and FIG. 25B are a sectional view and a perspective view of an electron-emitting device in the fourth embodiment of the present invention.
Figure 25B:
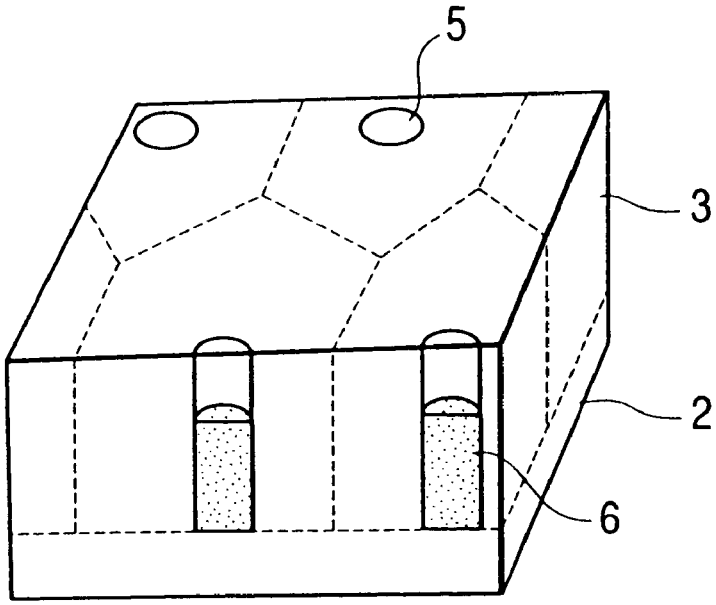

FIG. 25A is a sectional view of the electron-emitting device of the fourth embodiment. FIG. 25B is a partly enlarged schematic view of part A in the sectional view of FIG. 25A.

The substrate 1 to be employed herein can be selected from quartz glass, glass with a decreased content of impurity such as Na, soda lime glass, a glass substrate obtained by depositing $SiO_2$ on soda lime glass by sputtering or the like, ceramics such as alumina, an Si substrate, an Si substrate with a deposited layer of $SiO_2$, and so on. Particularly, when the substrate 1 is a semiconductor substrate, a driver or the like for driving the electron-emitting device can also be mounted simultaneously.

The lower electrode 2 is selected from metals, such as Al, Ta, Nb, Ti, Zr, Hf, or Si, and semiconductors that can undergo anodic oxidation. The thickness of the lower electrode 2 is properly determined according to the thickness of the anodic oxide layer, the electrical resistance of the lower electrode, and so on. The materials for the lower electrode are not limited to only the metals that can be anodized, but they may also be of a stack form of a metal that cannot be anodized and a metal that can be anodized.

The anodic oxide layer 3 is formed by anodic oxidation of the lower electrode in part. In the anodic oxide layer 3 there exist regular or irregular pores 5. This will also be called porous structure in the present specification. The regular or irregular pores 5 can be formed by selecting anodic oxidation conditions including a composition of an anodic oxidation bath, the temperature of the bath, the voltage, the time, etc., according to the material for the lower electrode 2. Preferably, the regular pores are selected. Diameters of the pores range from several ten nm to several hundred nm and depths thereof from several ten nm to several thousandnm. The density of the pores is $10^8$ to $10^{12}$ pores/cm$^2$. The shape of the pores is not limited only to the circle, but the ellipse, square, etc. can also be applied to the electron-emitting devices of the present invention. The variety of shapes can also be formed using the focused ion beam or the like. Therefore, the expression "length of pore" will also be used in place of the diameter of pore in the present invention. In each pore 5 the carbon 6 electrically connected to the lower electrode 2 is formed in the polelike shape filling a part of the pore. Electrons are emitted from the peripheral part of the pole in each pore or from the region of the top surface of the pole and the emission of electrons is determined by the shape of the pole and the shape of the upper electrode on the anodic oxide layer. Accordingly, electrons are emitted in a linear shape or in a linear and surface shape from each pore, according to the pore.

The carbon may also be formed in the similar fashion from the side of the upper electrode 4.

There is a gap created between the carbon formed on the lower electrode 2, and the upper electrode or, in the case where the carbon is also formed from the side of the upper electrode 4, between the carbon from the upper electrode 4 side and the carbon formed on the lower electrode 2. This gap is preferably several nm to several ten nm, and is properly determined according to the time of the step of applying the voltage to the upper electrode and lower electrode under existence of the organic material described hereinafter, the voltage applied, and so on.

The upper electrode is formed above the anodic oxide layer and is made preferably of a material having a high melting point, such as Pt, W, Mo, or Hf.

Figure 26A:
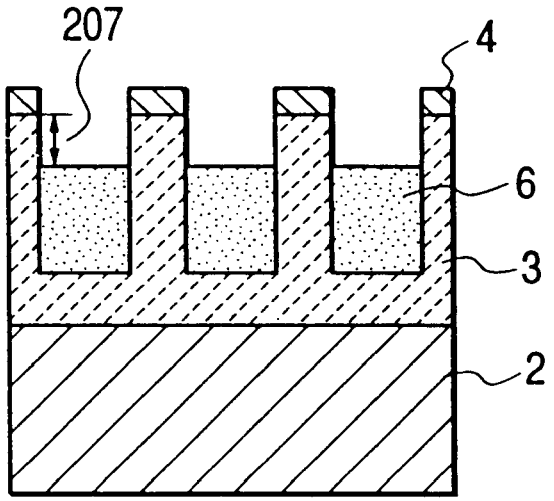
FIG. 26A and FIG. 26B are sectional views for explaining structures of the electron-emitting device of the fourth embodiment.
Figure 26B:
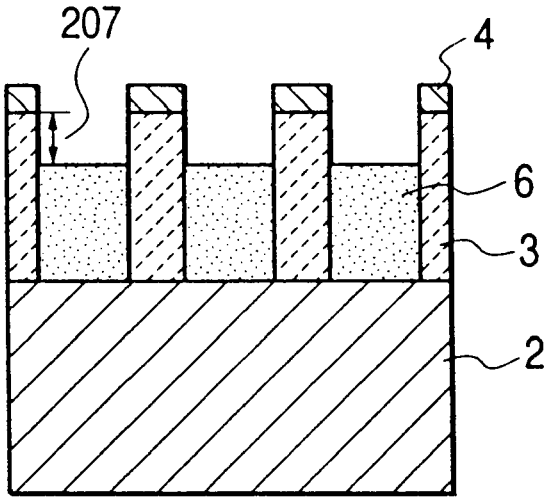

Structural examples of the above electron-emitting device of the present invention will be explained using the schematic sectional views of FIGS. 26A and 26B. In FIGS. 26A and 26B, numeral 207 designates a small gap and the same portions as in FIGS. 25A and 25B are denoted by the same reference numerals. There are two kinds of structures illustrated in FIGS. 26A and 26B, but other structures may also be employed, without having to be limited to these illustrated structures. The following describes examples using the metal for the upper electrode and the lower electrode, but they may also be made of the semiconductor.

The structure of FIG. 26A is metal (lower electrode)/metal oxide layer/pores, each having a carbon electron-emitting body 6/vacuum/metal (upper electrode) 4 formed in the regions except for the regions above the pores. The structure of FIG. 26B is metal (lower electrode)/pores, each having an electron-emitting body 6/vacuum/metal (upper electrode) 4 formed in the regions except for the regions above the pores.

In the structure of FIG. 26A, the metal oxide layer 3 is obtained on the occasion of anodic oxidation of the lower electrode, and two structural regions, a dense film structural region without pores and a film structural region with pores, can be obtained in this metal oxide layer 3, depending upon the anodic oxidation conditions. As illustrated in FIG. 26A, the formation of the dense film structural region of the above metal oxide layer between the lower electrode 2 and the electron-emitting bodies 6 in the pores results in forming a nonlinear device in the structure of metal/insulator/carbon, so as to impart the function of current limitation, which can prevent the current fluctuation in discharge or the like on the occasion of driving the electron-emitting device of the present invention and which can in turn prevent damage to the electron-emitting device. A specific production method of the above metal oxide layer will be described hereinafter, but it is first formed, for example, under conditions for forming the porous metal oxide and thereafter the thickness of the dense film structural region is adjusted in the widening step of pores described hereinafter.

The structure of FIG. 26B does not have the metal oxide layer without the pores and the electron-emitting bodies (carbon) in the pores are electrically connected directly to the lower electrode. This structure is constructed by anodizing the lower electrode, thereafter sufficiently widening the pores by the widening step of pores described hereinafter, and further forming the electron-emitting bodies (carbon) in the pores, whereby the lower electrode becomes electrically connected to the electron-emitting bodies in some cases. On this occasion, the metal oxide layer without the pores between the lower electrode and the metal oxide layer with the pores may be electrically broken by the pulse voltage applied in the step of forming the carbon in the pores of the anodic oxide layer described hereinafter, so that the electron-emitting bodies are electrically connected to the lower electrode. In the structure of FIG. 26B, the electron-emitting device is also provided with the nonlinear characteristics by tunneling between the electron-emitting bodies and the vacuum. The electrical connection with the lower electrode can also be achieved in such a way that the metal is precipitated by alternating current into the pores of the anodic oxide film by the coloring method of the anodic oxide film conventionally well known whereupon the precipitating metal into the pores migrates into the dense anodic oxide film to implement the electrical connection. The above "vacuum" is one equivalent to the vacuum ambience in which the substrate with the electron-emitting device formed,thereon is set.

In the electron-emitting device of the present invention described above, the carbon making the electron-emitting bodies is preferably at least one of graphite, amorphous carbon, and diamondlike carbon, particularly, in terms of heat resistance, stability of electron emission characteristics, and improvement in repeatability, as stated previously.

Next described is an electron-emitting mechanism of the electron-emitting device of the present invention in the structural examples of FIG. 26A and FIG. 26B.

In the surface conduction electron-emitting device stated previously in the related background art, according to Japanese Laid-open Patent Application No. 9-082214, electrons are once emitted into the vacuum outside the anode from a certain position on the anode side (which is also called the higher potential side) of the fissure region, in the fissure region of the surface conduction electron-emitting device. The electrons once emitted move in the electric field created by the cathode (which is also called the lower potential side) and the anode, and electrons flying over the singular point (hereinafter referred to as a stagnation point) of the electric field are attracted to the anode plate by the electric field created by the voltage applied to the anode plate set opposite to the electron-emitting device with intervention of vacuum. The electrons that do not reach the singular point of the electric field drop onto the anode, and some of electrons are scattered here to be deflected and again emitted into the vacuum. Electrons moving over the singular point of the electric field as a result of repetition of this scattering also reach the anode plate.

It is described in the prior art application that, in order to largely increase the electron emission efficiency, the electric field needs to be set in such conditions that most of the electrons once emitted are attracted to the anode plate without dropping onto the anode in the above-mechanism of electron emission and that the electron emission efficiency can be increased by providing the field correcting electrode outside the device electrode and applying a sufficiently higher voltage thereto than the voltage applied to the device for emission of electron.

In contrast with it, in the case of the electron-emitting device of the present invention, when the higher potential is applied to the upper electrode and the lower potential than that to the upper electrode is applied to the lower electrode, a potential difference between them is placed in the small gap between the upper electrode 4 and the electron-emitting body 6, whereupon electrons are emitted from the electron-emitting bodies into the vacuum. Since a strong electric field is placed in the small gap corresponding to the fissure of the aforementioned prior art, the electrons emitted from the electron-emitting bodies 6 into the vacuum collide with the upper electrode 4 to be scattered, just as in the case of the surface conduction electron-emitting device described previously in the related background art. It is, however, assumed that, in the case of the electron-emitting device of the present invention, the electrons reach the anode plate over the singular point of the electric field without repetition of scattering.

Figure 27:
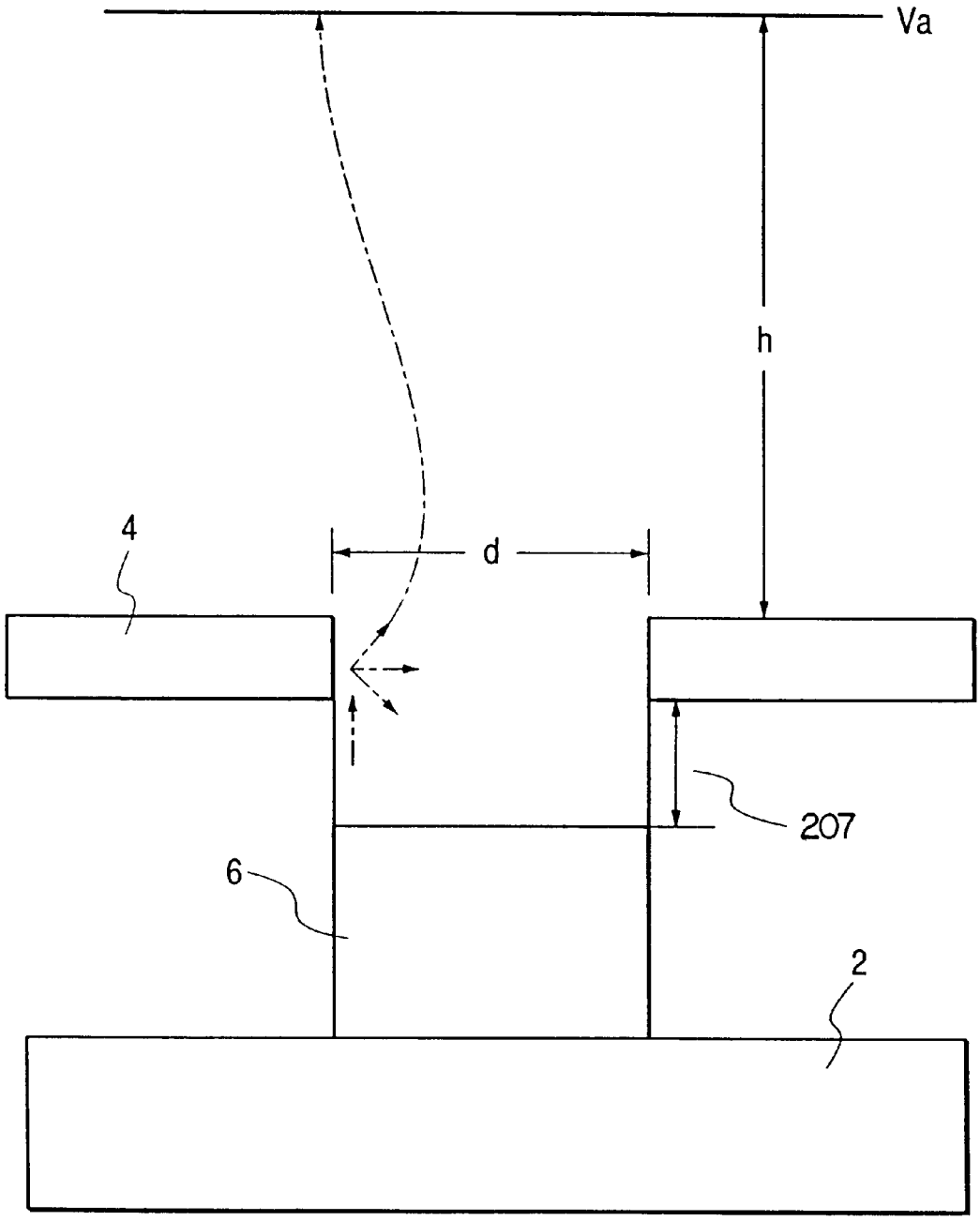
FIG. 27 is a sectional view for explaining the. principle of operation of the electron-emitting device in the fourth embodiment.

Now, the principle of the electron-emitting device of the present invention will be described using FIG. 27. FIG. 27 is a diagram to explain the principle of the electron-emitting device of the present invention. In the figure, h indicates the distance between the electron-emitting device and the anode electrode, d the length of pore, and Va the potential of the anode electrode.

Here, the following discussion is made with focusing attention on electrons emitted from the side of the upper electrode 4 of the electron-emitting body 6 on one side. Since the electrons are emitted along the periphery of the pore from the electron-emitting body 6, the electrons are also emitted from the upper electrode opposed to the upper electrode 4. The electrons emitted from the electron-emitting body 6 into the vacuum collide with the upper electrode 4 because of the electric field placed in the small gap 207 to be first scattered isotropically. Since the strong electric field from the opposite upper electrode present at the very close distance considerably constricts the stagnation point described above, as compared with that in the conventional surface conduction electron-emitting device, the electrons scattered isotropically reach the anode plate without repetitive scattering, mostly after scattered only once. On the other hand, where the thickness of the upper electrode 4 is small, the electrons also reach the anode plate, mostly after scattered only once, without repetitive scattering. It is considered that the above accounts for the increase of the electron emission efficiency. On the other hand, the same can also be applied to the electron-emitting bodies 6 having the electron-emitting regions formed in the rim shape of the pores, and this is conceivably the cause of increase of the electron emission efficiency.

An important factor for the effect of the electric field of the opposite upper electrode is the diameter of the aperture. Supposing the work function of the electron-emitting body is 4 to 5.5 eV, the electric field for emission of electrons into the small gap is not less than $10^7$ V/cm. When the stagnation point being the singular point of the electric field as defined in the aforementioned prior art is applied to the prior art electron-emitting device and the present invention, the distance Xs of the stagnation point without 34 is represented by the following equation.

$$Xs=h\cdot Vf/(\pi\cdot Va)$$

On the other hand, the stagnation point Xs' with 34 is indicated by the following equation.

$$Xs'=h\cdot Vf/\{\pi\cdot Va+h\cdot Vf/(\pi\cdot d)\}$$

Therefore, the smaller the diameter of the aperture, the more the stagnation point is constricted. Particularly, from the reason that the constriction effect of the stagnation point can be expected even at the upper electrode voltage of several ten V, the diameter of the aperture is preferably not more than 0.5 $\mu$m and more preferably not more than 0.2 $\mu$m. Further, the thickness of the upper electrode is preferably as thin as possible in order to suppress the repetitive scattering and, from examples, the thickness is preferably not more than 0.2 $\mu$m in terms of the efficiency. For specifying the condition by the thickness of the upper electrode, the small gap contributing to the emission of electrons has to be present at the edge of the upper electrode. From the viewpoint of suppressing the repetitive scattering, it corresponds to the distance from the small gap to the upper surface of the upper electrode.

The driving voltage is a low driving voltage, because the gap is small. Since the direction of the voltage to draw the electrons is coincident with the direction toward the anode plate, a spread of the electron beam, though scattered isotropically, is suppressed relatively.

Figure 28:
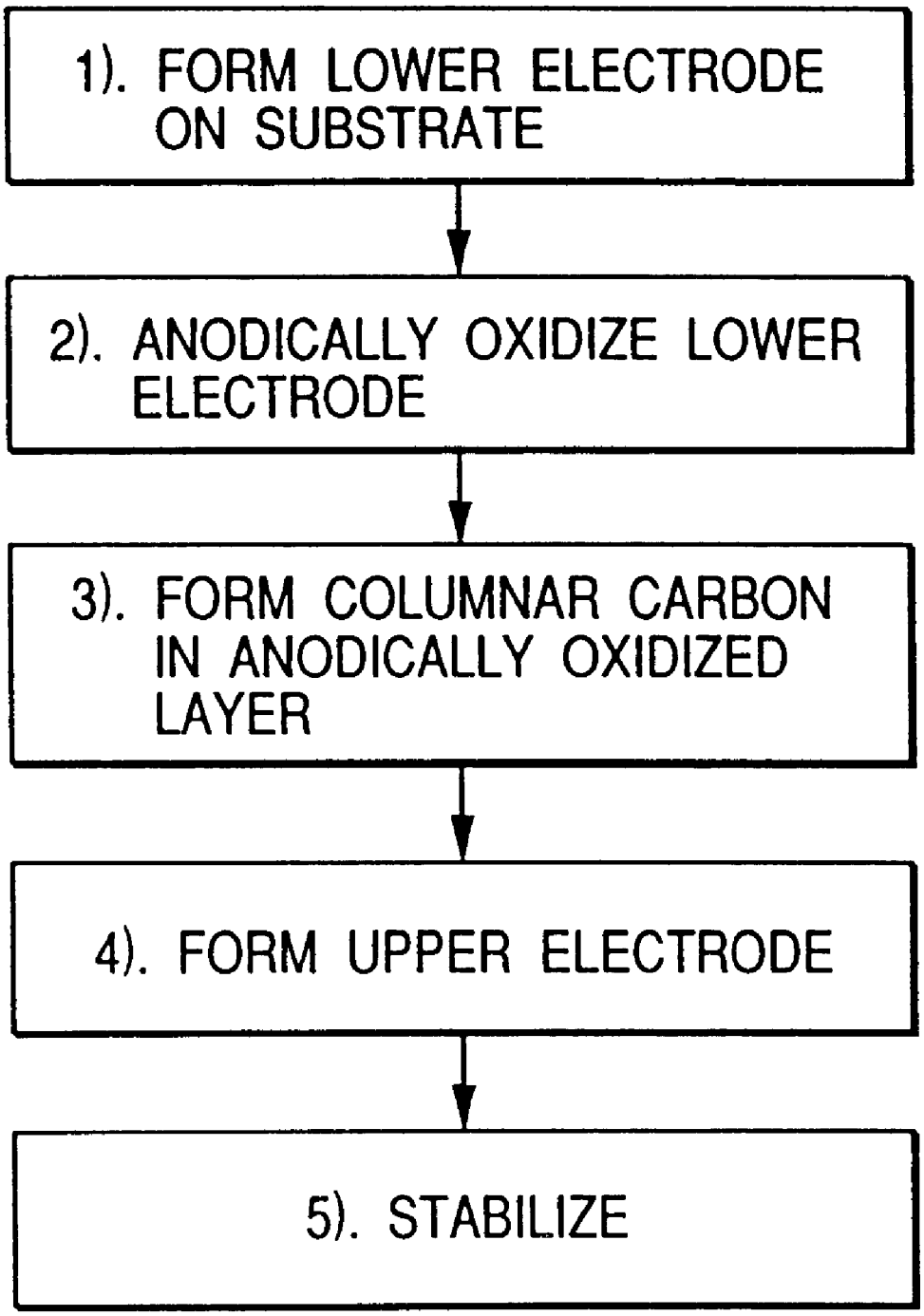
FIG. 28 is a flowchart of a process for producing the electron-emitting device of the fourth embodiment.

There are a variety of methods for producing the electron-emitting device described above, among which a first production method will be described referring to the production step diagram of FIG. 28.

(Step 1) Step of Forming the Lower Electrode of the Metal or the Semiconductor on the Substrate The substrate 1 is cleaned well with detergent, pure water, and organic solvent or the like, the material for the lower electrode is deposited by vacuum evaporation, sputtering, or the like, and thereafter the lower electrode 2 is formed on the substrate, for example, by the photolithography technology. The lower electrode may also be formed by electrolytic crystallization.

(Step 2) Step of Anodizing the Lower Electrode

The conceptual drawing of the anodic oxidation system was already described referring to FIG. 15. The electrode 53 is the metal such as Pt. The anodic oxidation of the lower electrode is effected by energization from the power supply 54 with the electrode 53 as a cathode and the substrate 1 with the lower electrode formed thereon, as an anode. The geometrical structure of the anodic oxide layer can be controlled by production conditions. Specifically, the spacing between the pores can be controlled by the anodic oxidation voltage, the depths of the pores by the anodic oxidation time, and the diameters of the pores by such conditions as the composition of the electrolyte solution, the voltage, the current. Further, control of the regular pores or the irregular pores can also be made by control of these conditions.

Next, the substrate with the anodic oxide layer formed thereon is dipped in the anodic oxidation electrolyte solution or the like to adjust the diameter of the pores and the thickness of the dense oxide film. (This step will be called widening.) Then the substrate is washed well with water and then dried in vacuum.

(Step 3) Step of Forming the Upper Electrode on the Metal or the Semiconductor Thus Anodized The upper electrode is formed in the thickness of not more than 200 nm in the same manner as the lower electrode was.

(Step 4) Step of Forming the Electron-emitting Bodies in the Pores of the Anodic Oxide Layer (Under Existence of Organic Material of Gas State)

This step is a step of forming carbon in the pores of the aforementioned-anodic oxide layer by applying the voltage to the upper electrode and lower electrode under existence of the organic material of a gas state. The carbon formed in this step includes, for example, graphite (including so-called HOPG, PG, and GC). HOPG indicates the almost perfect graphite crystal structure, PG somewhat disordered crystal structure having crystal grains of 20 nm or so, and GC more disordered crystal structure having the crystal grains of 2 nm or so. In addition, the carbon may also be non-crystalline carbon (which means amorphous carbon and, a mixture of amorphous carbon with fine crystals of the aforementioned graphite). The vacuum process system used in this step was already described referring to FIG. 5.

Particularly, where the carbon of the electron-emitting bodies is deposited from the lower electrode so as to form a constant gap with respect to the upper electrode, the carbon can be formed by applying the voltage with the upper electrode at the lower potential and the lower electrode at the higher potential. After the voltage is applied with the upper electrode at the lower potential and the lower electrode at the higher potential, the voltage is further applied with the upper electrode at the higher potential and the lower electrode at the lower potential, whereby the carbon is also deposited on the upper electrode after formation of a constant gap above the deposition of carbon of the electron-emitting bodies from the lower electrode, thereby forming a constant separation from the upper electrode. Since the position of the gap affects the electron emission characteristics as described previously, it is preferable to deposit the carbon from the lower electrode and then form the constant gap from the upper electrode.

The preferred gas pressure of the organic substance for formation of the carbon differs depending upon the aforementioned application form, the shape of the vacuum vessel, the type of the organic substance, and so on and is thus properly determined according to the circumstances. An appropriate organic substance can be selected from aliphatic hydrocarbons of alkane, alkene, and alkyne, aromatic hydrocarbons, alcohols, aldehydes, ketones, amines, organic acids such as phenol, carboxylic acid, and sulfonic acid, and so on. Specific examples of such substances include saturated hydrocarbons represented by $C_nH_{2n+2}$ such as methane, ethane, and propane, unsaturated hydrocarbons represented by the composition formula of $C_nH_{2n}$ or the like such as ethylene and propylene, benzene, toluene, methanol, ethanol, formaldehyde, acetone, methyl ethyl ketone, methylamine, ethylamine, phenol, formic acid, acetic acid, propionic acid, and so on. The organic gas is also selected according to the diameter of the pores formed in the anodic oxide layer. This is because adsorption of the organic gas is also dependent on the diameter of the pores.

During this process carbon is deposited from the organic substance present in the ambience into the pores in the anodic oxide layer, whereby the device current If and emission current Ie change remarkably.

Completion of this step is determined while measuring either one of the device current If and the emission current Ie or the both.

The apertures of the upper electrode 4 above the pores, as illustrated in FIGS. 26A and 26B, can also be formed in the initial stage of application of the above voltage pulses in this step.

(Step 5) Stabilization Step

This step is a step for stabilizing the characteristics of the electron-emitting device thus produced. This step is a step of removing intermediate products of the organic material and also removing the organic gas, water, oxygen, etc. adsorbing to the substrate etc. from the carbon in the pores of the anodic oxide layer in the above step, whereby the step can impart to the device such a property that the device current and the emission current monotonically increase above a certain threshold against the voltage applied to the device. This step is a step of exhausting the organic substance in the vacuum vessel and the evacuation apparatus for evacuating the vacuum vessel is preferably one not using oil in order to avoid influence of the oil from the apparatus on the characteristics of the device. Specifically, the evacuation apparatus can be selected from a sorption pump, an ion pump, and so on.

The partial pressure of the organic component in the evacuation apparatus is set to a partial pressure under which there is little carbon or carbon compound newly deposited, and is preferably not more than $1\times10^{-8}$ Torr and particularly preferably not more than $1\times10^{-10}$ Torr. It is further preferred that the whole of the vacuum apparatus be heated during evacuation of the inside of the vacuum apparatus so as to facilitate removal of molecules of the organic substance adsorbing to the inner wall of the vacuum apparatus and to the electron-emitting device. The heating condition at this time is desirably the temperature of 150 to 300° C. and the heating time of not less than several hours, but the heating condition is not limited particularly to this condition.

The ambience during driving after completion of the stabilization step is preferably maintained in the ambience at the end of the above stabilization operation, but it is not limited to this. Sufficient characteristics can be maintained by an ambience from which the organic substance is removed adequately but the vacuum degree of which is a little degraded.

By employing such a vacuum ambience, deposition of new carbon substance can be suppressed, whereby the device current If and emission current Ie are stabilized as a result.

Next described is a second production method where the carbon or diamondlike carbon is formed in liquid. The method will be described as to the case where the device is constructed in the structure of either FIG. 26A or FIG. 26B.

(Step 1) Step of Forming the Lower Electrode of the Metal or the Semiconductor on the Substrate This step is carried out in the same manner as the method described in step 1 of the first production method.

(Step 2) Step of Anodizing the Lower Electrode

This step is also carried out in the same manner as the method described in step 2 of the first production method and, after the anodic oxidation and widening step, the anodized substrate is washed with water and is taken into the electrolytic tank of (step 3).

(Step 3) Step of Forming the Electron-emitting Bodies in the Pores of the Anodic Oxidation Layer (Under Existence of Organic Material of Liquid State)

This step is a step of forming the electron-emitting bodies in the pores of the aforementioned anodic oxide layer by applying the voltage to the electrode 53 of FIG. 15 and the lower electrode under existence of an organic material of a liquid state.

Using the apparatus similar to FIG. 15, electrolysis is conducted in the electrolyte solution of alcohol between the cathode of the lower electrode side and the anode, whereby diamondlike carbon can be deposited from the lower electrode side in the pores formed by the anodic oxidation.

The diamondlike carbon grows in the columnar shape in the pores with a lapse of the electrolytic time.

(Step 4) Step of Forming the Upper Electrode on the Metal or the Semiconductor Thus Anodized The upper electrode is formed in the thickness of not more than 20 nm in the same manner as the lower electrode was.

(Step 5) Stabilization Step

This step is carried out in the same manner as the stabilization step described in step 5 of the first production method.

Example 1 of the Fourth Embodiment

The electron-emitting devices were produced in the same structure as in FIGS. 7A and 7B. Production steps of the present example will be described specifically.

(Step 1: Step of Forming the Lower Electrodes of Metal on Substrate)

The substrate 1 was prepared by depositing $SiO_2$ in the thickness of 1 $\mu$m on soda lime glass and the substrate 1 was washed well with detergent, pure water, and organic solvent or the like. Then the material of Al for the lower electrodes was deposited in the thickness of 500 nm on the substrate by sputtering and thereafter the lower electrode wires 71 were formed in stripes on the substrate 1 by the photolithography technology. For using parts of the lower electrode wires 71 as terminals, they were covered with a known mask resin for plating.

(Step 2: Step of Anodizing the Lower Electrodes)

Using the apparatus of FIG. 15, the anodic oxidation was carried out to anodize parts of the Al lower electrodes prepared in (step 1).

The anodic oxidation electrolyte solution 52 was an aqueous solution of oxalic acid 30 g/l. The electrode 53 was a Pt electrode. The anodic oxidation was carried on at 5° C. for five minutes by the constant voltage of 40 V from the power supply 55 with the cathode of the electrode 53 and the anode of the lower wires 71 provided on the substrate 1. On this occasion, the initial current density was 300 mA/cm$^2$, but the current density decreased with progress of the anodic oxidation and thereafter increased once to be saturated. Then the substrate with the anodic oxide layers was immersed in an aqueous solution of phosphoric acid for thirty minutes to remove the dense anodic oxide layer and thereafter washed well with water.

(Step 3: Step of Forming Columnar Metal in the Pores of the Anodic Oxide Layers)

Formation of the columnar metal in the pores was carried out using the apparatus of FIG. 16. In this step Ni was electrodeposited by the constant current at the current density of 1 mA/cm$^2$, using the Pt electrode as the counter electrode 91 and 5% $NiSO_4$ and 4% $H_3BO_3$ as the electrodeposition solution 94 containing the metal. An electrodeposition amount of columnar Ni was controlled by time and the columnar Ni was formed in each pore. The electrodeposition time was 100 seconds.

(Step 4: Step of Forming the Upper Electrode on the Metal or the Semiconductor Thus Anodized)

The upper electrode 72 was made in the thickness of 10 nm in the same manner as the lower electrodes were.

(Step 5: Step of Forming Carbon in the Pores of the Anodic Oxide Layers (Under Existence of Organic Material of Gas State))

The substrate 1 was set in the vacuum chamber also serving as a measuring device and the voltage was applied to the upper electrode and lower electrodes under an ambience containing gas of acetone at $10^{-1}$ Pa. In step 3, three devices out of the five devices were processed by applying the rectangular waves of the voltage waveform having the pulse width T1 of 1 ms and the pulse spacing T2 of 10 ms in the pulse waveform of FIG. 6A with the lower electrode side at the higher potential for fifteen minutes. Thereafter, the upper electrode was kept at the higher potential and the voltage was applied for five minutes. At the same time, the current of device was monitored. The voltage was 17 V. The two remaining devices out of the five devices were processed by applying the voltage of 17 V similarly in the pulse waveform of FIG. 6B for twenty minutes.

(Step 6: Stabilization Step)

Then the acetone gas was exhausted sufficiently and thereafter the system was evacuated for two hours while being heated at 300° C.

Then the substrate was set in the vacuum process system of FIG. 5 and the voltage was applied to the lower electrode and upper electrode of each device, and to the anode electrode to measure the currents (the device current and emission current) and the device voltage characteristics. Further, electron beams were observed by luminescence of the fluorescent member placed at the anode. After the measurements, the sample thus formed was then observed with the electron microscope, TEM, and so on.

The device current and emission current both of each device demonstrated the monotonically increasing characteristics over their threshold. The current was negligible below the threshold (called Vth). Values of emission current of the devices obtained with application of the pulses of FIG. 6A were equivalent to those of the devices obtained with application of the pulses of FIG. 6B and, therefore, their emission efficiencies were also equivalent.

In observation with the electron emission, the regular pores were observed in the anodic oxide layers. The density of the pores was $1\times10^9$ pores/cm$^2$.

Figure 29A:
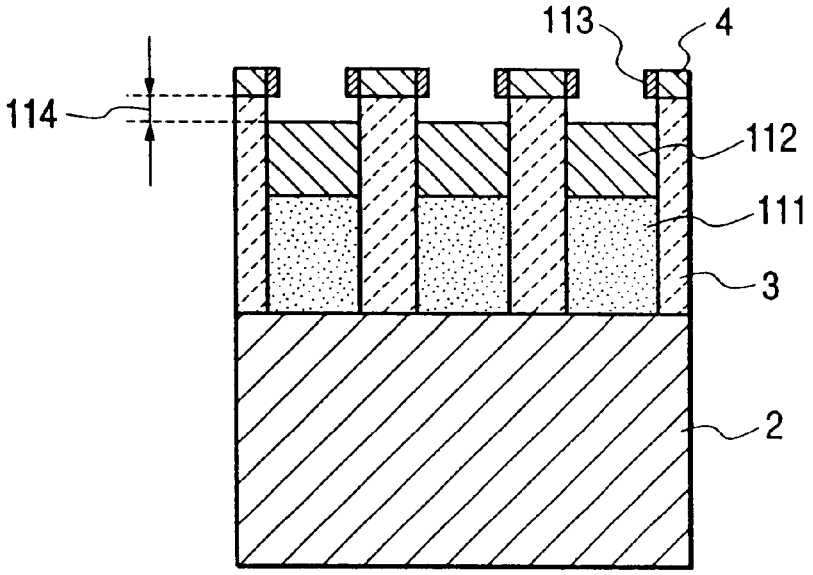
FIG. 29A and FIG. 29B are sectional views for explaining configurations of the electron-emitting device of the fourth embodiment.
Figure 29B:
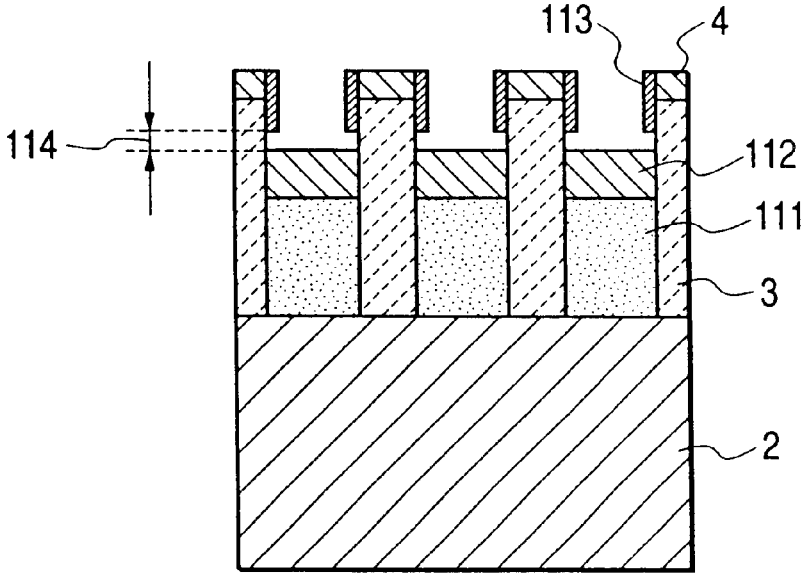

Further, cross-sectional samples were prepared and the inside of the pores was observed. The cross sections of the devices were as illustrated in FIG. 29A and FIG. 29B. In FIGS. 29A and 29B, the same reference symbols as those in FIGS. 26A and 26B denote like portions. FIG. 29A is a cross section of the devices in which carbon was formed by applying the pulses of FIG. 6A in step 5, while FIG. 29B is a cross section of the devices in which carbon was formed by applying the pulses of FIG. 6B in step 5. Numeral 111 represents columnar metal Ni, 112 carbon formed in the columnar shape in the pores, 113 carbon formed on the upper electrode side, and 114 a small gap.

As illustrated in FIG. 29A, where the carbon was formed with application of the pulses of FIG. 6A, the Ni metal was deposited in the columnar shape 110 nm high in the pores from the lower electrode 2 of Al and columnar amorphous carbon was further formed in the pores on the top surface of columnar Ni. Further, amorphous carbon was also formed similarly on the side of the upper electrode 4. A small gap was formed between the carbon on the upper electrode 4 side and the carbon on the lower electrode 2 side and the gap was formed at the edge of the upper electrode. The gap was several nm. The thickness of the anodic oxide film was 150 nm.

On the other hand, where the carbon was formed with application of the pulses of FIG. 6B, as illustrated in FIG. 29B, the Ni metal was deposited in the columnar shape in the pores on the lower electrode 2 of Al and columnar amorphous carbon was further formed in the pores on the top surface of columnar Ni. Further, amorphous carbon was also formed similarly on the side of the upper electrode 4. The carbon was formed to the position 20 nm apart from the bottom surface of the upper electrode and a small gap was formed between the two carbon layers. The gap was several nm.

The above proved the following. First, the metal is anodized, the columnar metal is formed in the pores, and the columnar carbon is formed in the pores on the top surface of the columnar metal. Second, the small gap of several nm is formed between the carbon films on the upper electrode side and on the lower electrode side. Third, the emission current and electron emission efficiency are equivalent as long as the small gap is located in the range of 20 nm from the bottom surface of the upper electrode. Since the distance from the gap to the top surface of the upper electrode is not more than 30 nm including the thickness of the upper electrode in the both examples, the probability is assumed to be low of loss of the electrons emitted from the lower electrode side, in the pores. Fourth, the stabilization step enables the device current and emission current to demonstrate the monotonically increasing characteristics without occurrence of the voltage-controlled negative resistance characteristics, or the VCNR characteristics.

Example 2 of the Fourth Embodiment

In the present example the substrate was constructed in the device layout similar to Example 1 of the fourth embodiment. The upper electrode was formed in a variety of thicknesses and influence thereof was investigated. Step 1 to step 3, and step 6 were carried out in the same manner as in Example 1. The description of step 1 to step 3, and step 6 will be omitted herein and only steps 4 and 5 will be described in detail.

(Step 1: Step of Forming the Lower Electrodes of Metal on the Substrate)

This step was carried out in the same manner as step 1 of Example 1.

(Step 2: Step of Anodizing the Lower Electrodes)

This step was carried out in the same manner as step 2 of Example 1.

(Step 3: Step of Forming Columnar Metal in the Pores of the Anodic Oxide Layers)

This step was carried out in the same manner as step 3 of Example 1.

(Step 4: Step of Forming the Upper Electrode on the Metal or the Semiconductor Thus Anodized)

The upper electrode 72 was formed in either of four thicknesses of 5, 10, 100, and 500 nm on each substrate in the same manner as the lower electrodes, thus forming four substrates.

(Step 5: Step of Forming Carbon in the Pores of the Anodic Oxide Layers (Under Existence of Organic Material of Gas Shape))

Each substrate 1 was set in the vacuum chamber also serving as a measuring device and the voltage was applied to the upper electrode and lower electrode under an ambience containing gas of acetone at $10^{-1}$ Pa. Three devices out of the five devices were processed by applying the rectangular waves of the voltage waveform having the pulse width T1 of 1 ms and the pulse spacing T2 of 10 ms in the pulse waveform of FIG. 6A for fifteen minutes with the lower electrode side at the higher potential. After that, the upper electrode was kept at the higher potential and the voltage was applied for five minutes. At the same time, the current of device was monitored. The voltage was 17 V.

(Step 6: Stabilization Step)

This step was carried out in the same manner as step 2 of the Example 1.

Next, each substrate was set in the vacuum process system of FIG. 5 and the voltage was applied to the lower electrode and upper electrode of each device, and to the anode electrode to measure the currents (the device current and emission current) and the device voltage characteristics. Further, the electron beam was observed by luminescence of the fluorescent member placed at the anode.

Figure 30:
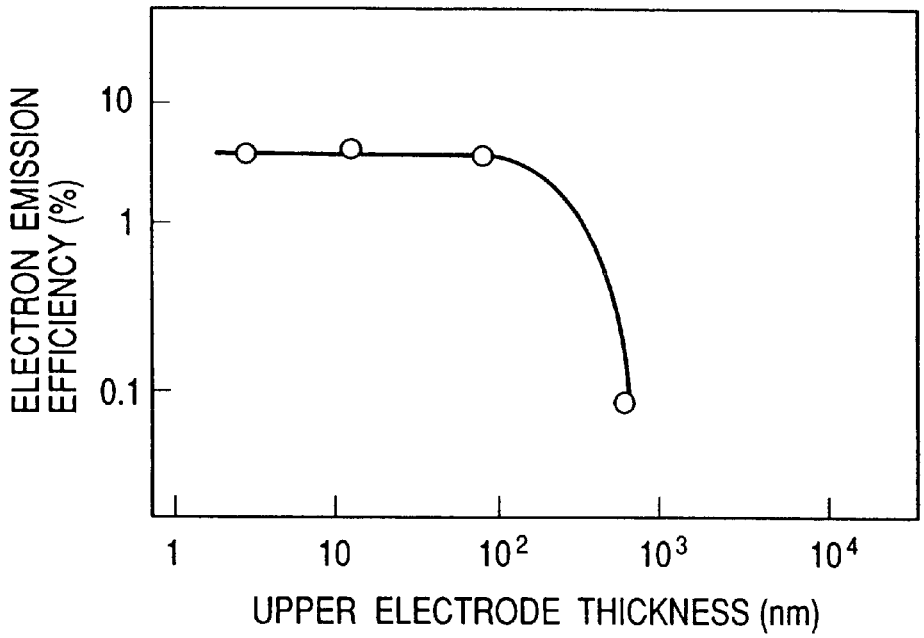
FIG. 30 is a graph to show the relation between electron emission efficiency and thickness of the upper electrode in the electron-emitting device of the fourth embodiment.

FIG. 30 shows the relation between thickness of the upper electrode and electron emission efficiency. As shown in FIG. 30, the electron emission efficiency did not decrease below the thickness of about 200 nm and then decreased with increasing thickness of the upper electrode over 200 nm. The electron emission efficiency is defined as a ratio of emission current to device current. Further, the beam size also decreased.

In observation of the form of the upper electrode, particularly, in the case of the upper electrode having the large thickness, where the thickness was greater than the diameter of the pores, the inside of the pores was also covered in part. When the small gap was observed with section TEM, the small gap was formed at the edge of the bottom surface of the upper electrode in either sample, as in Example 1.

The above verified the following. First, the small gap is formed at the edge of the upper electrode, irrespective of the thickness of the upper electrode. Second, the emission current and electron emission efficiency decrease, depending upon the thickness of the upper electrode. This is assumed to be due to the high probability of loss at the upper electrode of the porous shape, of the electrons emitted from the lower electrode side.

Example 3 of the Fourth Embodiment

In the present example the substrate was constructed in the device layout similar to Example 1 of the fourth embodiment. In the present example, $SiO_2$ was used as the insulating layer instead of the anodic oxide layer of aluminum in Example 1. Production steps of the present example will be described specifically.

(Step 1: Step of Forming the Lower Electrodes of Metal on the Substrate)

The substrate 1 was prepared by depositing $SiO_2$ in the thickness of 1 $\mu$m on soda lime glass and then the substrate 1 was washed well with detergent, pure water, and organic solvent or the like. The material Pt for the lower electrode was deposited in the thickness of 500 nm on the substrate by sputtering and thereafter the lower electrode wires 71 were formed in stripes on the substrate 1 by the photolithography technology.

(Step 2: Step of Forming the Insulating Layer)

Next, $SiO_2$ was deposited in the thickness of 50 nm by sputtering.

(Step 3: Step of Forming the Upper Electrode on the Insulating Layer)

The upper electrode 72 was made of Pt in the thickness of 10 nm in the same manner as the lower electrodes were.

(Step 4: Step of Forming the Pores in the Insulating Layer)

In the stack structure of lower electrode/$SiO_2$/upper electrode as described above, four types of pores were formed as follows by the focused ion beam method; (the diameter 50 nm and the pitch 100 nm of the pores), (the diameter 200 nm and the pitch 400 nm of the pores), (the diameter 500 nm and the pitch 1000 nm of the pores), and (the diameter 1000 nm and the pitch 2000 nm of the pores). Here, the pitch is a distance between centers of adjacent pores.

(Step 5: Step of Forming Carbon in the Pores of the Insulating Layer (Under Existence of Organic Material of Gas Shape))

The substrate 1 was set in the vacuum chamber also serving as a measuring device and the voltage was applied to the upper electrode and lower electrode under an ambience containing gas of acetone at $10^{-2}$ Pa. The rectangular waves of the voltage waveform having the pulse width T1 of 1 ms and the pulse spacing T2 of 10 ms in the pulse waveform of FIG. 6A were applied for fifteen minutes and then the lower electrode side was kept at the higher potential for five minutes.

(Step 6: Stabilization Step)

Then the acetone gas was exhausted sufficiently and thereafter the system was evacuated for two hours while being heated at 300° C.

Then the substrate was set in the vacuum process system of FIG. 5 and the voltage was applied to the lower electrode and upper electrode of each device, and to the anode electrode to measure the currents (the device current and emission current), and the device voltage characteristics.

Figure 31:
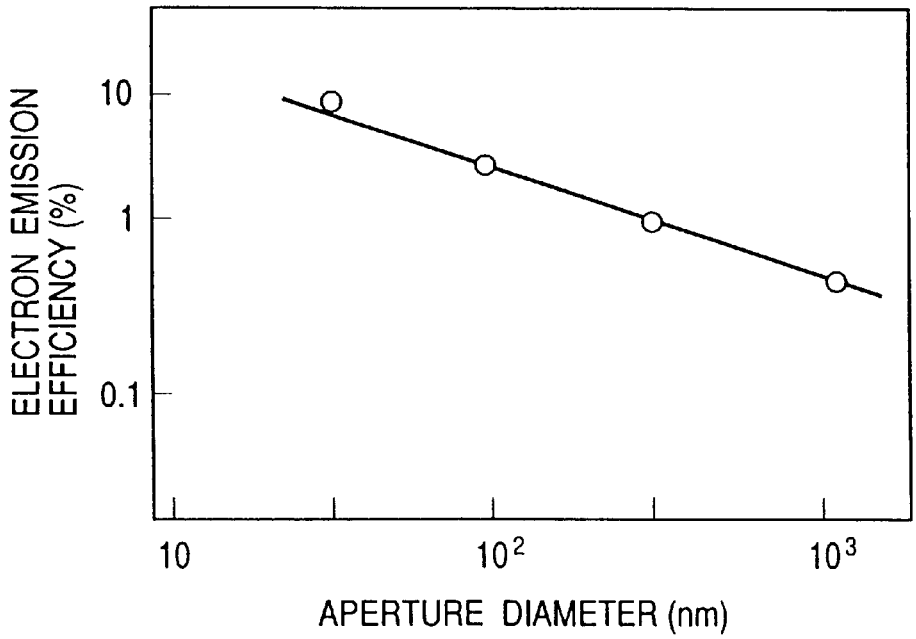
FIG. 31 is a graph to show the relation between electron emission efficiency and diameter of aperture in the electron-emitting device of the fourth embodiment.
Figure 32:
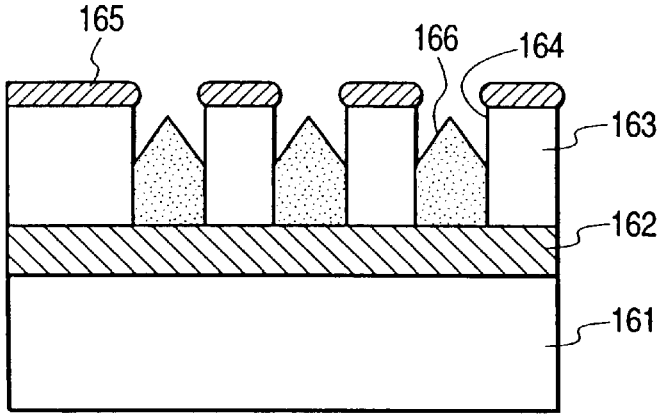
FIG. 32 is a sectional view of a conventional FE type electron-emitting device.
Figure 33:
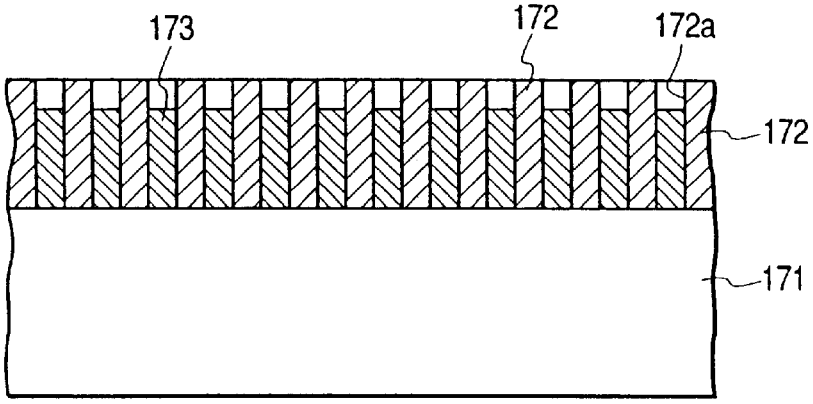
FIG. 33 is a sectional view of another conventional FE type electron-emitting device.
Figure 34:
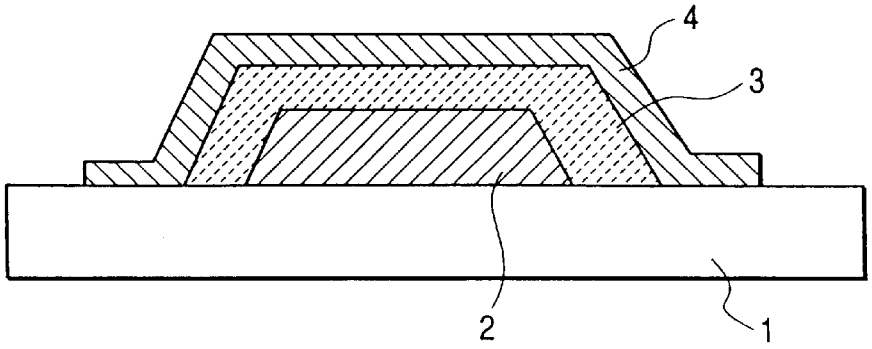
FIG. 34 is a sectional view of a conventional MIM type electron-emitting device.
Figure 35A:
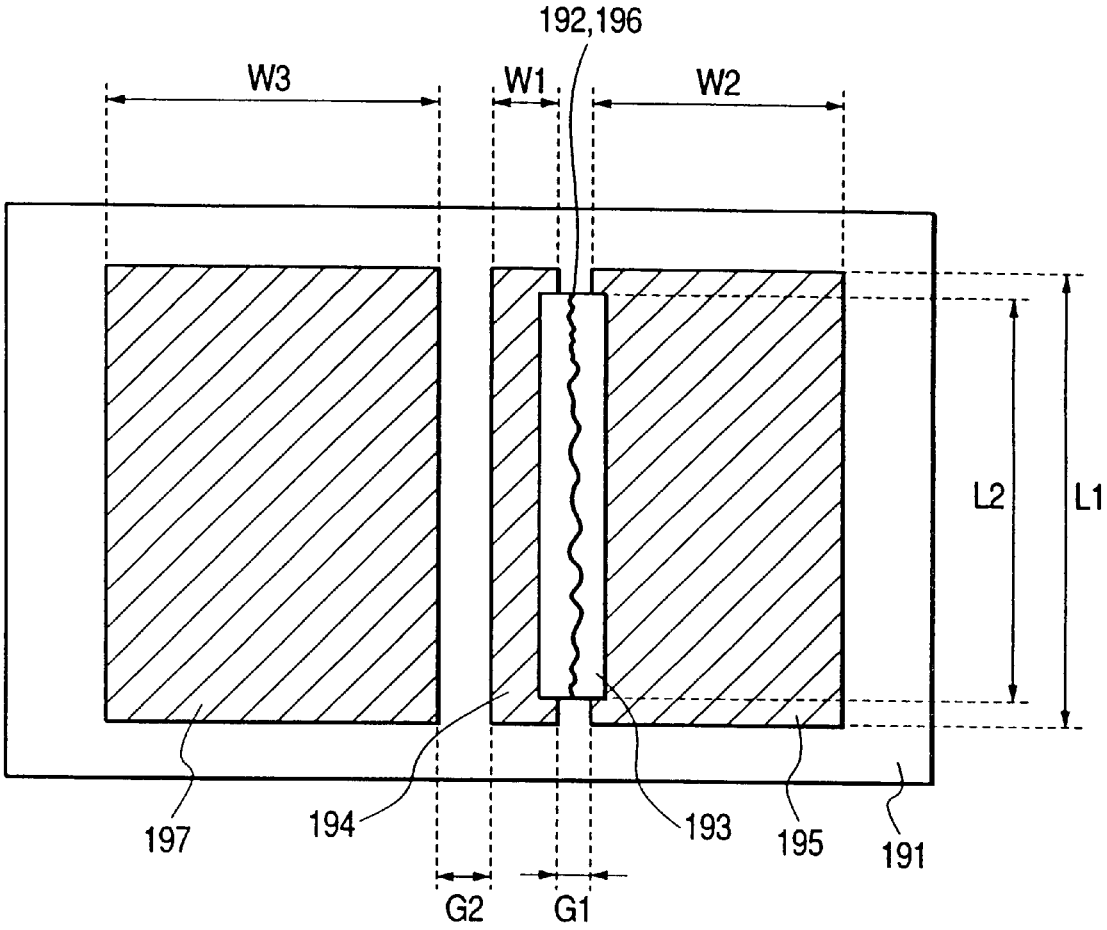
FIG. 35A and FIG. 35B are a plan view and a sectional view of a conventional surface conduction electron-emitting device.
Figure 35B:
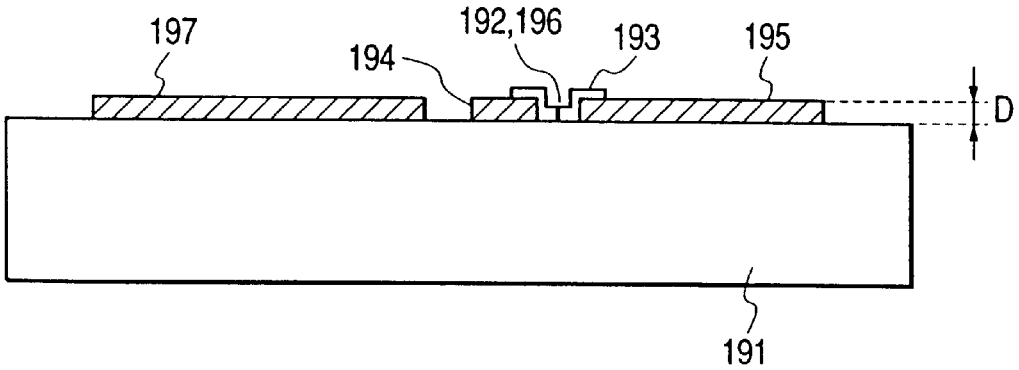

The electron emission efficiency was dependent upon the diameter of the pores as illustrated in FIG. 31, and the electron emission efficiency increased with decreasing diameter of pore.

Example 4 of the Fourth Embodiment

The present example is an example of application to the image pickup device of FIGS. 9A and 9B described previously, in which a plurality of electron-emitting devices prepared by the same method as in Example 1 of the fourth embodiment are placed in a two-dimensional array on the substrate.

The production method of the image pickup device of the present example is the same as in the first embodiment. The image pickup device produced in this way was operated based on the principle of operation stated previously, whereupon the signal current was obtained in 1:1 correspondence to the size of the electron-emitting device, thereby verifying the operation.

Example 5 of the Fourth Embodiment

The present example is an example of construction of the display device of FIGS. 10A and 10B described previously, in which a plurality of electron-emitting devices produced by the same method as in Example 1 of the fourth embodiment are arrayed in a two-dimensional pattern on the substrate. The production method of the display device of the present example is the same as in the first embodiment. The display device produced in this way was operated based on the principle of operation discussed previously, and a bright image was displayed in high definition.

According to the present invention in the first embodiment as described above, the electron-emitting device is constructed in such structure that the insulating layer having the pores formed by anodic oxidation or the like is provided on the lower electrode, at least carbon is formed in the pores, and the gap is given between the carbon and the upper electrode; therefore, when the voltage is applied between the lower electrode and the upper electrode so as to establish the higher potential on the upper electrode, the electrons injected from the lower electrode tunnel into the vacuum to be emitted. Since the distance of the gap between the carbon formed from the lower electrode, and the upper electrode is nearly constant, the characteristics of the electron-emitting device with little variation can be obtained without dependence of the driving voltage on the thickness of the insulating layer, different from the conventional MIM electron-emitting devices. Since the electron-emitting bodies grown from the lower electrode side is of at least one of graphite, amorphous carbon, and diamondlike carbon, the device is produced with excellent heat resistance and with stable electron emission characteristics in good repeatability. Since the pores are formed in high density and further on the regular basis, the electron-emitting device can be obtained with large emission current and with high efficiency. The spread of the electron beam is decreased and the electron beam equivalent to the formation region of electron emitting device can be formed depending upon conditioning. When an electron source is constructed by placing a plurality of such electron-emitting devices of the present invention, the stable electron source can be provided with little variation from the above reasons. When the electron source is constructed in such structure that the plurality of electron-emitting devices thus placed are located at intersecting portions between the upper wires electrically connected to the upper electrodes and the lower wires electrically connected to the lower electrodes and that the upper wires and the lower wires are arranged nearly perpendicular to each other, a specific electron-emitting device can be selected and modulated out of the plurality of electron-emitting devices, by the voltage applied to an upper wire and a lower wire thereof. An image pickup device with high resolution and with excellent uniformity can be provided with little variation by combining the above electron source with a photoconductive member disposed opposite to the electron source. Further, a display device with high definition and with excellent uniformity can be provided with little variation by combining the above electron source of the present invention with an image forming member disposed opposite to the electron source.

According to the present invention in the second embodiment, the electron-emitting device is constructed in such structure that on the substrate there are the lower electrode, the insulating layer having the pores, and the upper electrode stacked in this order, the insulating layer has the pores, and the electron-emitting regions are provided in the pores, wherein each electron-emitting region is comprised of the small gaps between the lower electrode and the upper electrode and wherein each small gap is formed by the conductive body formed along the inner wall of pore and the upper electrode; therefore, when the voltage is applied between the lower electrode and the upper electrode so as to place the higher potential on the upper electrode, the electrons from the lower electrode tunnel through the gap between the lower electrode and the upper electrode into the vacuum and the electrons are efficiently emitted with being affected by the potential of the conductive body formed along the inner wall of pore. In addition, because the distance from the small gap to the top surface of the upper electrode is not more than 200 nm, the electrons colliding with and scattered by the upper electrode do not undergo repetitive scattering, thereby increasing the electron emission efficiency. Since the length of the pores is not more than 500 nm, the singular point of the electric field is constricted even by the potential of the upper electrode of the lower voltage, thereby increasing the electron emission efficiency. Since the distance of the gap between the conductive body formed along the inner wall of pore on the lower electrode, and the upper electrode is determined by the carbon material formed and the voltage applied and is almost constant, the characteristics of the electron-emitting device with little variation can be obtained without dependence of the driving voltage on the thickness of the insulating layer, unlike the conventional MIM electron-emitting devices. Since the electron-emitting bodies of the conductive material grown from the lower electrode side are of at least either one of graphite, amorphous carbon, and diamondlike carbon, the device can be produced with excellent heat resistance and with stable electron emission characteristics in good repeatability. The conductive bodies may be constructed in such structure that a conductive body of columnar metal or the like is preliminary formed in each pore and rim-shape carbon is further formed along the inner wall of pore on the columnar metal. In this case, the insulating layer can be made thicker, and the capacitance is thus lowered of the insulating layer between the upper electrode and the lower electrode, which is advantageous in driving of the electron-emitting device. Since the pores can be formed in high density and on the regular basis, the efficient electron-emitting device can be obtained with large emission current. Since emission of electrons from the conductive electron-emitting bodies formed in the pores mainly occurs from the linear electron-emitting bodies of the rim shape, the electron-emitting region can be increased drastically, as compared with the small region at the cone tip in the conventional field emission devices. While the conventional surface conduction electron-emitting devices have the one-dimensional or linear electron-emitting region, the electron-emitting region of the present invention can be formed two-dimensionally and can thus be increased drastically. Accordingly, the emission current density (a ratio of emission current to electron emission area) is decreased, whereby degradation can be suppressed of the characteristics of the electron-emitting device. When compared with the conventional field emission devices, the spread of electron beam is decreased and the electron beam equivalent to the formation region of the electron-emitting device can be formed depending upon the conditions. When an electron source is constructed by arraying a plurality of such electron-emitting devices of the present invention, the stable electron source can be provided with little variation from the above reasons. When the electron source is constructed in such structure that the plurality of electron-emitting devices thus arranged are located at intersecting points between the upper wires electrically connected to the upper electrodes and the lower wires electrically connected to the lower electrodes or that each device is located near each intersecting point and the upper wires and the lower wires are arranged nearly perpendicular to each other, a specific electron-emitting device can be selected and modulated out of the plurality of electron-emitting devices, by the voltage applied to an upper wire and a lower wire thereof. When the electron-emitting devices are not located at the intersecting points between the upper wires and the lower wires, but are located near the intersecting points, degrees of freedom are increased for design of wires and devices. Namely, the size of device can be selected so as to match with a necessary emitted electron amount. The degrees of freedom of design are also increased, because the decrease of the capacitance at the intersecting point between wires separates the size from the device size designed from the necessary electron emission amount of device. An image pickup device with high resolution and with excellent uniformity can be provided with little variation by combining the above electron source with a photoconductive member disposed opposite to the electron source. Further, an image forming apparatus with high definition and with excellent uniformity can be provided with little variation by combining the above electron source of the present invention with an image forming member disposed opposite to the electron source.

According to the present invention in the third embodiment, the electron-emitting device is constructed in such structure that on the substrate there are the lower electrode., the insulating layer having the pores, and the upper electrode stacked in this order, the insulating layer has the pores, and the electron-emitting bodies are provided in the pores, wherein, with the thickness t of the upper electrode, the length L of the pores, and the mean free path $\lambda$ of electron transmission of the upper electrode, the device satisfies the condition of $0.5\times L \leqq t < 2\lambda$; therefore, when the voltage is applied between the lower electrode and the upper electrode so as to establish the higher potential on the upper electrode, the electrons injected from the lower electrode tunnel from the electron-emitting bodies into the vacuum, further pass through the upper electrode, and fly to the anode plate. Since the thickness of the upper electrode is not less than $0.5\times L$ where L is the length of the pores, the upper electrode can cover the apertures of the pores. Since the thickness of the upper electrode is not more than $2\lambda$ where $\lambda$ is the mean free path of electron transmission of the upper electrode, the emitted electrons can efficiently pass through the upper electrode to reach the anode plate. Since the space between the electron-emitting bodies and the upper electrode is the vacuum with small dielectric constant, scattering of electron due to the insulating layer does not occur, when compared with the MIM type provided with the insulating layer, and loss of emitted electrons is thus decreased. Further, the electric capacitance is lowered considerably, which is advantageous in driving of the electron-emitting device, e.g., in power consumption. Since the electron-transmitting portions of the upper electrode have the large mean free path of electron transmission and are of the carbon material having at least either one of graphite, amorphous carbon, and diamondlike carbon with excellent electron transmittance, the emitted electrons efficiently pass through the upper electrode to reach the anode electrode. Since carbon is a material with high heat resistance, there occurs little degradation during driving of the electron-emitting device, whereby stability is enhanced. Since the carbon material is bound by covalent bond, the shape of the upper electrode covering the regions above the pores can be implemented easier than the metal electrode. In the case of the electron-emitting device of the present invention where the electron-emitting bodies are the needlelike electrodes deposited on the lower electrode or the small particles deposited on the lower electrode, the local electric field is large and the driving voltage is decreased because of the pores, thereby lowering power consumption. In the case of the electron-emitting device of the present invention where the electron-emitting bodies are the rim-shape conductive bodies formed along the inner walls of the pores or the columnar conductive bodies formed in the pores and where there is the small gap between the electron-emitting bodies and the upper electrode, the driving voltage is low because of the small gap and the capacitance is lowered because of the vacuum. Further, where the conductive bodies of the columnar shape are provided between the electron-emitting bodies and the lower electrode, the thickness of the insulating layer can be separated from the electron emission field and the thickness of the insulating layer can thus be made larger. This can decrease the capacitance between the upper electrode and the lower electrode, which is advantageous in driving. Since the pores can be formed in high density and on the regular basis, the efficient electron-emitting device can be obtained with large emission current. Since the device is driven at the low emission current density (the ratio of emission current to electron emission area) in practical driving, degradation of the characteristics of the electron-emitting device can be suppressed. When the electron-emitting device of the present invention is compared with the conventional field emission devices having the apertures in the upper electrode above the pores, the device of the invention has the upper electrode above the pores as well; therefore, the spread of electron beam is decreased and the electron beam equivalent to that by the MIM device can be formed. When an electron source is constructed by arraying a plurality of such electron-emitting devices of the present invention, the stable electron source can be provided with high definition from the above reasons. When the electron source is constructed in such structure that the plurality of electron-emitting devices thus arranged are located at intersecting points between the upper wires electrically connected to the upper electrodes and the lower wires electrically connected to the lower electrodes or that each device is located near each intersecting point and the upper wires and the lower wires are arranged nearly perpendicular to each other, a specific electron-emitting device can be selected and modulated out of the plurality of electron-emitting devices, by the voltage applied to an upper wire and a lower wire thereof. When the electron-emitting devices are not located at the intersecting points between the upper wires and the lower wires, but are located near the intersecting points, degrees of freedom are increased for design of wires and devices. Namely, the size of device can be selected so as to match with a necessary emitted electron amount. The degrees of freedom of design are also increased, because the decrease of the capacitance at the intersecting point between wires separates the size from the device size designed from the necessary electron emission amount of device. An image pickup device with high resolution and with excellent uniformity can be provided with little variation by combining the above electron source with a photoconductive member disposed opposite to the electron source. Further, an image forming apparatus with high definition and with excellent uniformity can be provided with little variation by combining the above electron source of the present invention with an image forming member disposed opposite to the electron source.

According to the present invention in the fourth embodiment, the electron-emitting device is constructed in such structure that on the substrate there are the lower electrode, the insulating layer having the pores, and the upper electrode stacked in this order, the insulating layer has the pores, and the electron-emitting regions are provided in the pores, wherein each electron-emitting regions is comprised of the small gap between the lower electrode and upper electrode and wherein the distance from the small gap to the top surface of the upper electrode is not more than 200 nm; therefore, when the voltage is applied between the lower electrode and the upper electrode so as to establish the higher potential on the upper electrode, the electrons injected from the lower electrode tunnel through the gap between the lower electrode and the upper electrode into the vacuum to be emitted. Further, the electrons colliding with and scattered by the upper electrode do not undergo repetitive scattering, thereby increasing the electron emission efficiency. Since the length of the pores is not more than 500 nm, the singular point of the electric field is constricted even by the potential of the upper electrode of the lower voltage, thereby increasing the electron emission efficiency. Since the distance of the gap between the conductive bodies formed on the lower electrode, and the upper electrode is determined by the carbon material formed and the voltage applied and is almost constant, the characteristics of the electron-emitting device with little variation can be obtained without dependence of the driving voltage on the thickness of the insulating layer, unlike the conventional MIM type electron-emitting devices. Since the electron-emitting bodies of the conductive bodies of the columnar shape grown from the lower electrode are of at least either one of graphite, amorphous carbon, and diamondlike carbon, the device can be produced with excellent heat resistance and with stable electron emission characteristics in high repeatability. The conductive bodies may be of a stack of the columnar metal and carbon in which the metal is preliminarily formed in the pores and then carbon is formed. In this case, the insulating layer can be made thicker, so that the capacitance 13 lowered of the insulating layer between the upper electrode and the lower electrode, which is advantageous in driving of the electron-emitting device. Since the pores can be formed in high density and on the regular basis, the efficient electron-emitting device can be obtained with large emission current. Since the electrons from the electron-emitting bodies formed in the pores are emitted mainly from the periphery of the electron-emitting bodies of the columnar shape, the electron-emitting region can be increased drastically, as compared with the small region at the cone tip in the conventional field emission devices. As compared with the conventional surface conduction electron-emitting devices, the electron-emitting region can be increased largely, because it can be formed two-dimensionally. Accordingly, the emission current density (the ratio of emission current to electron emission area) is decreased, so that degradation of the characteristics of the electron-emitting device can be suppressed. In the electron-emitting device of the present invention the spread of electron beam is decreased, as compared with the conventional field emission devices. When an electron source is constructed by arraying a plurality of such electron-emitting devices of the present invention, the stable electron source can be provided with little variation from the above reasons. When the electron source is constructed in such structure that the plurality of electron-emitting devices thus arranged are located at intersecting points between the upper wires electrically connected to the upper electrodes and the lower wires electrically connected to the lower electrodes or that each device is located near each intersecting point and the upper wires and the lower wires are arranged nearly perpendicular to each other, a specific electron-emitting device can be selected and modulated out of the plurality of electron-emitting devices, by the voltage applied to an upper wire and a lower wire thereof. When the electron-emitting devices are not located at the intersecting points between the upper wires and the lower wires, but are located near the intersecting points, degrees of freedom are increased for design of wires and devices. Namely, the size of device can be selected so as to match with a necessary emitted electron amount. The degrees of freedom of design are also increased, because the decrease of the capacitance at the intersecting point between wires separates the size from the device size designed from the necessary electron emission amount of device. An image pickup device with high resolution and with excellent uniformity can be provided with little variation by combining the above electron source with a photoconductive member disposed opposite to the electron source. Further, an image forming apparatus with high definition and with excellent uniformity can be provided with little variation by combining the above electron source of the present invention with an image forming member disposed opposite to the electron source.

What is claimed is:

1. An electron-emitting device comprising:

a lower electrode;

an insulating layer having a pore disposed on the lower electrode;

an upper electrode disposed on the insulating layer;

a first carbon deposit in contact with, and connected electrically to, said upper electrode and disposed in said pore; and a second carbon deposit in contact with, and connected electrically to, said lower electrode, said second carbon deposit being electrically conductive and disposed in said pore;

wherein a gap is formed between said first carbon deposit and said second carbon deposit.

2. The electron-emitting device according to claim 1, wherein a thickness of said upper electrode is not more than 200 nm.

3. The electron-emitting device according to claim 1, wherein a length of said pore is not more than 500 nm.

4. The electron-emitting device according to claim 1, wherein said small gap is not more than 20 nm.

5. The electron-emitting device according to claim 1, wherein said second carbon deposit has a pole-like shape.

6. The electron-emitting device according to claim 1, wherein said insulating layer is an anodic oxide layer.

7. The electron-emitting device according to claim 1, wherein, between said carbon deposit and said lower electrode, an insulating layer is disposed.

8. The electron-emitting device according to claim 1, wherein said second carbon deposit is at least one of graphite, amorphous carbon, and diamond like carbon.

9. An electron-emitting device comprising a lower electrode, an insulating layer having a pore, and an upper electrode stacked in this order on a substrate, wherein a carbon deposit is provided in said pore, and a small gap is provided between said upper electrode and said carbon deposit and, wherein said carbon deposit is electrically conductive, is electrically connected to said upper electrode, and covers at least an inner side surface of said pore, wherein a gap is provided between the carbon deposit on said lower electrode and the carbon deposit connected to said upper electrode.

10. An electron-emitting device comprising a lower electrode, an insulating layer having a pore, and an upper electrode stacked in this order on a substrate, wherein an electron-emitting region is provided in said pore, said electron-emitting region being comprised of a small gap between said lower electrode and upper electrode, said small gap being formed by an electroconductive body of a rim shape formed along an inner wall of said pore, and the upper electrode.

11. The electron-emitting device according to claim 10, wherein said insulating layer is an anodic oxide layer.

12. The electron-emitting device according to claim 10, wherein said electroconductive body formed along the inner wall of the pore is formed on an electroconductive body of a pole-like shape formed in said pore.

13. The electron-emitting device according to claim 12, wherein said electroconductive body of the pole-like shape is metal.

14. The electron-emitting device according to claim 10, wherein said electroconductive body formed along the inner wall of the pore is a carbon deposit.

15. The electron-emitting device according to claim 10, wherein a thickness of said upper electrode is not more than 200 nm.

16. The electron-emitting device according to claim 10, wherein a length of said pore is not more than 500 nm.

17. The electron-emitting device according to claim 10, wherein said small gap is not more than 20 nm.

18. The electron-emitting device according to claim 10, wherein said carbon deposit is at least one of graphite, amorphous carbon, and diamond like carbon.

19. An electron-emitting device comprising a lower electrode, an insulating layer having a pore, and an upper electrode stacked in this order on a substrate, wherein an electron-emitting body is provided in said pore, and wherein the following condition is satisfied:

$$0.5 \times L \leqq t < 2\lambda$$

where t is a thickness of said upper electrode, L is a length of said pore, and λ is a mean free path of electron transmission of said upper electrode.

20. The electron-emitting device according to claim 19, wherein said upper electrode has a carbon deposit.

21. The electron-emitting device according to claim 19, wherein said electron-emitting body is a needle-like electrode deposited on said lower electrode.

22. The electron-emitting device according to claim 19, wherein said electron-emitting body is a small particle deposited on said lower electrode.

23. The electron-emitting device according to claim 19, wherein said electron-emitting body is an electroconductive body of a rim shape formed along an inner wall of said pore and a small gap is provided between the electroconductive body of the rim shape formed along the inner wall of the pore, and the upper electrode.

24. The electron-emitting device according to claim 19, wherein said electron-emitting body is an electroconductive body of a columnar shape formed in said pore and a small gap is provided between the electroconductive body of the columnar shape formed in said pore, and the upper electrode.

25. The electron-emitting device according to claim 19, wherein said electron-emitting body is formed on an electroconductive body of a pole-like shape formed in said pore.

26. The electron-emitting device according to claim 25, wherein said electroconductive body of the pole-like shape is metal.

27. The electron-emitting device according to claim 19, wherein said electron-emitting body has a carbon deposit.

28. The electron-emitting device according to claim 19, wherein said insulating layer is an anodic oxide layer.

29. The electron-emitting device according to claim 19, wherein said electron-emitting body lies on an insulating layer formed on the lower electrode.

30. The electron-emitting device according to claim 19, wherein said carbon deposit is at least one of graphite, amorphous carbon, and diamond like carbon.

31. An electron source comprising a plurality of electron-emitting devices as set forth in any one of claims 1–4.

32. The electron source according to claim 31, wherein said plurality of electron-emitting devices are located at intersecting point between upper wires electrically connected to upper electrodes and lower wires electrically connected to lower electrodes and wherein said upper wires and said lower wires are arranged perpendicular to each other.

33. An image pickup device comprising the electron source as set forth in claim 31, and a photoconductive member disposed opposite to said electron source.

34. A display device comprising the electron source as set forth in claim 31, and an image forming member disposed opposite to said electron source.

* * * * *

UNITED STATES PATENT AND TRADEMARK OFFICE

CERTIFICATE OF CORRECTION

PATENT NO. : 6,472,814 B1
DATED : October 29, 2002
INVENTOR(S) : Masato Yamanobe et al.

It is certified that error appears in the above-identified patent and that said Letters Patent is hereby corrected as shown below:

Column 1,
Line 24, "PHYSICAL" should read -- Physical --; and
Line 38, "No. 5-298252" should read -- No. 5-198252 --.

Column 2,
Line 59, "was hindrance" should read -- hindered --; and
Line 60, "against" should be deleted.

Column 3,
Line 13, "source;" should read -- source, --; and
Line 55, "where" should read -- wherein --.

Column 5,
Line 47, "the." should read -- the --; and
Line 57, "embodiment:" should read -- embodiment; --.

Column 9,
Line 4, "structure." should read -- structure --; and
Line 8, "non-crystallin" should read -- non-crystalline --.

Column 17,
Line 14, "RF" should read -- HF --; and
Line 47, "Inside" should read -- inside --.

Column 19,
Line 25, "results" should read -- results in --; and
Line 26, "metal insulator/rim-shape" should read -- metal/insulator/rim-shape --.

Column 24,
Line 6, "pulse." should read -- pulse --; and
Line 48, "and 117" should be deleted.

Column 30,
Line 16, "substrate" should read -- Substrate --.

UNITED STATES PATENT AND TRADEMARK OFFICE

CERTIFICATE OF CORRECTION

PATENT NO. : 6,472,814 B1
DATED : October 29, 2002
INVENTOR(S) : Masato Yamanobe et al.

It is certified that error appears in the above-identified patent and that said Letters Patent is hereby corrected as shown below:

Column 31,
Line 22, "properly," should read -- properly --.

Column 33,
Line 30, "containing;" should read -- containing --.

Column 34,
Line 57, "each:pore." should read -- each pore. --.

Column 35,
Line 53, "was;set" should read -- was set --.

Column 36,
Line 8, "high:" should read -- high --.

Column 37,
Line 22, "thousandnm." should read -- thousand nm. --.

Column 38,
Line 24, "widening" should read -- step of widening --;
Line 25, "step of" should be deleted;
Line 31, "widening step of" should read -- step of widening --;
Line 48, "precipitating" should be deleted;
Line 49, "into" should read -- precipitating into --; and
Line 53, "formed,thereon" should read -- formed thereon --.

Column 39,
Line 20, "above-mechanism" should read -- above mechanism --.

Column 40,
Line 45, "is coincident" should read -- coincides --.

Column 44,
Line 51, "with" should read -- of --.

UNITED STATES PATENT AND TRADEMARK OFFICE

CERTIFICATE OF CORRECTION

PATENT NO. : 6,472,814 B1
DATED : October 29, 2002
INVENTOR(S) : Masato Yamanobe et al.

It is certified that error appears in the above-identified patent and that said Letters Patent is hereby corrected as shown below:

Column 48,
Line 14, "electrode," should read -- electrode --.

Column 49,
Line 26, "preliminary" should read -- preliminarily --.

Column 50,
Line 21, "electrode.," should read -- electrode, --.

Column 52,
Line 30, "capacitance 13" should read -- capacitance --; and
Line 32, "of" should be deleted.

Column 53,
Line 29, "pore;" should read -- pore, --.

Column 55,
Line 5, "claims 1-4." should read -- claims 1-30. --; and
Line 8, "point" should read -- points --.

Signed and Sealed this

Eighteenth Day of November, 2003

JAMES E. ROGAN
*Director of the United States Patent and Trademark Office*